US008322702B2

(12) United States Patent
Izuchi et al.

(10) Patent No.: US 8,322,702 B2
(45) Date of Patent: Dec. 4, 2012

(54) IMAGE RECORDING APPARATUS

(75) Inventors: Masatoshi Izuchi, Ichinomiya (JP); Yuji Koga, Nagoya (JP); Keisuke Wakakusa, Nagoya (JP); Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/230,609

(22) Filed: Sep. 12, 2011

(65) Prior Publication Data

US 2012/0001378 A1 Jan. 5, 2012

Related U.S. Application Data

(63) Continuation of application No. 12/039,038, filed on Feb. 28, 2008, now Pat. No. 8,020,849.

(30) Foreign Application Priority Data

Feb. 28, 2007 (JP) ..... 2007-050306
May 30, 2007 (JP) ..... 2007-143921

(51) Int. Cl.
*B65H 3/44* (2006.01)
*B65H 5/26* (2006.01)

(52) U.S. Cl. ..... 271/9.11; 271/3.11; 271/3.14

(58) Field of Classification Search ..... 271/3.01, 271/3.04, 3.14, 9.11, 65
See application file for complete search history.

(56) References Cited

U.S. PATENT DOCUMENTS

RE35,341 E 10/1996 Kikuchi et al.
6,152,561 A 11/2000 Watanabe
6,382,617 B1 * 5/2002 Yen et al. ..... 271/3.14
6,474,884 B2 11/2002 Chiu
6,659,444 B2 12/2003 Kawarama
6,848,685 B2 * 2/2005 Katsuyama ..... 271/162
7,243,915 B2 7/2007 Wong et al.
7,543,809 B2 * 6/2009 Shiohara ..... 271/9.11
7,549,624 B2 6/2009 Watanabe
7,584,950 B2 * 9/2009 Asada et al. ..... 271/9.07
(Continued)

FOREIGN PATENT DOCUMENTS

JP S57-199244 U 12/1982
JP S61-130163 A 6/1986
JP S63-104369 U 7/1988
(Continued)

OTHER PUBLICATIONS

Japan Patent Office, Notification of Reason for Refusal for Japanese Patent Application No. 2007-050306 (counterpart to co-pending U.S. Appl. No. 12/039,038), dispatched Nov. 9, 2010.

*Primary Examiner* — Prasad Gokhale
(74) *Attorney, Agent, or Firm* — Baker Botts L.L.P.

(57) ABSTRACT

An image recording apparatus according to one aspect comprises: a first tray disposed within an opening of a main body to allow a recording medium to be placed thereon; a second tray disposed above the first tray, the second tray having a second end portion located on a side of the opening; a conveying unit; and a recording unit. The second tray is movable between a first posture and a second posture. When the second tray is in the first posture, a top surface of the second tray in the vicinity of the second end portion is positioned at a predetermined height relative to the first tray. When the second tray moves from the first posture to the second posture, the top surface in the vicinity of the second end portion is moved toward the first tray.

20 Claims, 44 Drawing Sheets

U.S. PATENT DOCUMENTS

| | | | | |
|---|---|---|---|---|
| 7,784,781 | B2 * | 8/2010 | Asada | 271/145 |
| 7,963,517 | B2 * | 6/2011 | Shiohara et al. | 271/9.08 |
| 2002/0117796 | A1 * | 8/2002 | Miyamoto | 271/3.14 |
| 2005/0201793 | A1 | 9/2005 | Satozaki | |
| 2006/0261535 | A1 | 11/2006 | Shiohara et al. | |
| 2006/0262355 | A1 * | 11/2006 | Kurata et al. | 358/305 |
| 2007/0075476 | A1 * | 4/2007 | Shiohara | 271/9.01 |
| 2007/0182083 | A1 * | 8/2007 | Asada et al. | 271/9.01 |

FOREIGN PATENT DOCUMENTS

| | | | |
|---|---|---|---|
| JP | H05-116830 | A | 5/1993 |
| JP | 2001-063898 | A | 3/2001 |
| JP | 2001-226018 | A | 8/2001 |
| JP | 2003-054814 | A | 2/2003 |
| JP | 2005-289645 | A | 10/2005 |
| JP | 2006-273567 | A | 10/2006 |

* cited by examiner

IMAGE RECORDING APPARATUS

CROSS-REFERENCE TO RELATED APPLICATIONS

This application is a continuation application of U.S. patent application Ser. No. 12/039,038 filed on Feb. 28, 2008, which claims the benefit of Japanese Patent Application No. 2007-050306 filed on Feb. 28, 2007, and Japanese Patent Application No. 2007-143921 filed on May 30, 2007, the disclosures of which are incorporated herein by reference in their entirety.

TECHNICAL FIELD

The present invention generally relates to an image recording apparatus in which a recording medium on which an image has been recorded is discharged within a body.

BACKGROUND

Image recording apparatuses, such as ink-jet printers and laser printers, includes a sheet feed tray and a sheet discharge tray. Recording sheets to be used for recording of an image are accommodated in the sheet feed tray. A recording sheet is fed from the sheet feed tray. An image is recorded on the fed recording sheet during the conveyance thereof. The recorded recording sheet is discharged to the sheet discharge tray. Among this type of image recording apparatuses, a so-called in-body discharge type image recording apparatus in which a sheet discharge tray is provided inside a main body is known.

An image forming apparatus described in JP-A-2001-063898 includes an image reading unit and an image forming unit. In this image forming apparatus, an image of a document is read by the image reading unit and the image of the document is recorded on a recording sheet by the image forming unit. The recording sheet on which an image has been recorded is discharged to a sheet discharge tray. The sheet discharge tray is provided between the image reading unit provided in an upper portion in the main body, and the image forming unit provided in a lower portion thereof. The sheet discharge tray is inclined so that the leading end of the recording sheet in its discharge direction may become lower than the trailing end of the recording sheet. Thereby, since the top surface of the sheet discharge tray is directed to the outside of the image forming apparatus, a user can easily take out the recording sheet from the sheet discharge tray, compared with a case where the sheet discharge tray is provided horizontally.

JP-A-5-116830 discloses a configuration that facilitates take-out of a recording sheet discharged to a position apart from the front of a main body in which an operation panel is provided. In the image forming apparatus described in JP-A-5-116830, a discharge tray and a discharge port is provided on a lateral side of the main body. A recording sheet on which an image has been recorded is discharged to the discharge tray. The discharge port allows the recording sheet to be taken out of the sheet discharge tray therethrough. The recording sheet on which an image has been recorded is discharged to the sheet discharge tray on the rear side of the main body. The sheet discharge tray is inclined so that the front side of the main body may become lower than the rear side thereof. For this reason, the recording sheet discharged to the sheet discharge tray slides from the rear side of the main body to the front side thereof along the inclined sheet discharge tray. This facilitates take-out of the recording sheet from the front side of the main body.

JP-A-5-116830 also discloses a configuration that makes the sheet discharge tray rotatable between a horizontal posture in which the sheet discharge tray is disposed horizontally, and an inclined posture in which the sheet discharge tray is inclined as mentioned above. As a user pushes down the sheet discharge tray on the front side of the main body, the sheet discharge tray rotates which facilitates take-out of a recording sheet from the sheet discharge tray.

In the image forming apparatus disclosed in JP-A-2001-63898, the sheet discharge tray is inclined. Therefore, the space occupied by the sheet discharge tray increases compared with the case where the sheet discharge tray is provided horizontally, which may increase the size of the apparatus. In the image forming apparatus described in JP-A-5-116830, it is necessary to provide the space for allowing the sheet discharge tray to rotate, which may increase the size of the apparatus similarly to the image forming apparatus described in JP-A-2001-63898.

SUMMARY

One aspect of the invention has been made in view of the above circumstances. It is therefore an object of one aspect of the invention the invention to provide a thin image recording apparatus that allows a user to easily take out a recording medium having been recorded thereon an image and discharged within a main body.

According to an aspect of the invention, there is provided an image recording apparatus comprising: a main body having an opening; a first tray disposed within the opening of the main body to allow a recording medium to be placed thereon; a second tray is disposed above the first tray so that the first tray and the second tray are vertically disposed in two stages, the second tray having a second end portion located on a side of the opening; a conveying unit configured to convey a recording medium fed from the first tray and discharge the recording medium onto the second tray; and a recording unit configured to record an image on the recording medium during a conveyance of the recording medium, wherein the second tray is movable between a first posture and a second posture, wherein, when the second tray is in the first posture, a top surface of the second tray in the vicinity of the second end portion is positioned at a predetermined height relative to the first tray, and wherein, when the second tray moves from the first posture to the second posture, the top surface in the vicinity of the second end portion is moved toward the first tray.

BRIEF DESCRIPTION OF THE DRAWINGS

FIG. 17A shows a state where the sheet discharge tray takes a first posture, and FIG. 17B shows a state where the sheet discharge tray takes a second posture;

FIG. 34A shows a state where a sub-tray is maintained in a first posture, and FIG. 34B shows a state where the sub-tray is maintained in a second posture;

FIG. 44A shows a state where the sub-tray is maintained in a first posture, and FIG. 44B shows a state where the sub-tray is maintained in the second posture.

DESCRIPTION

Figure 1:
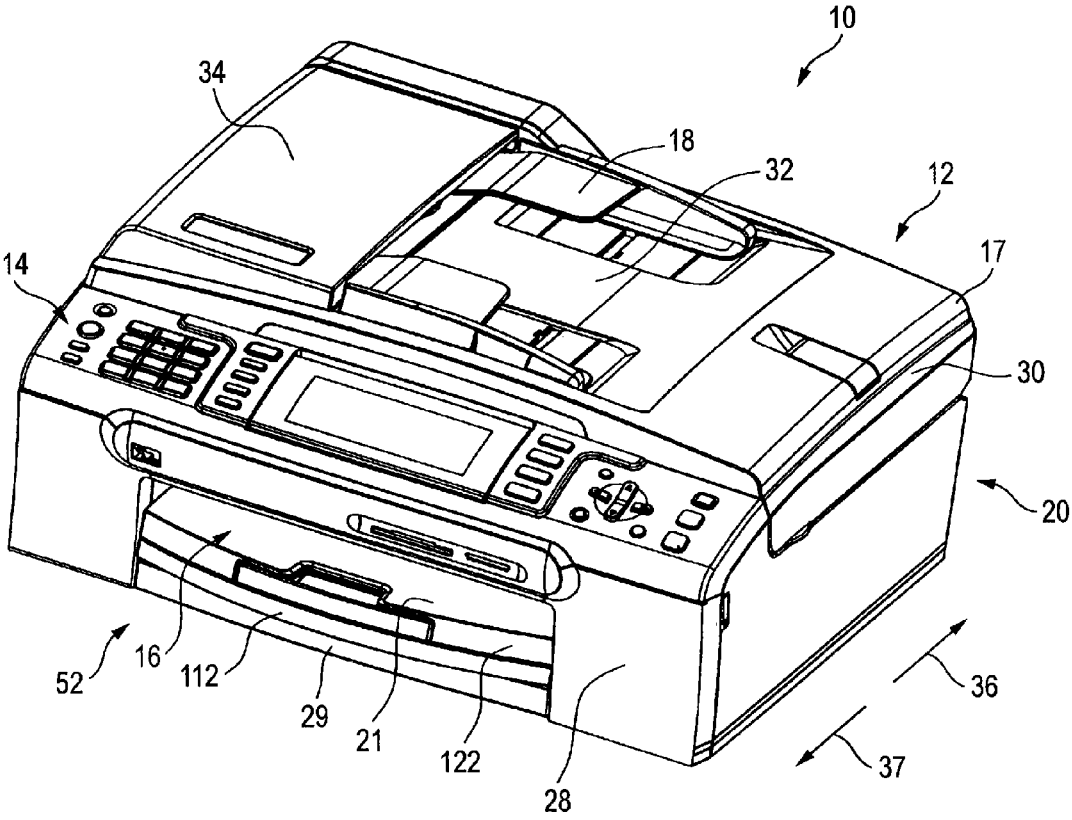
FIG. 1 is a perspective view showing the external configuration of a composite device.

Hereinafter, embodiments of the invention will be described referring to the drawings suitably. The embodiments are merely examples of the invention can be suitably changed without changing the scope of the invention.

(First Embodiment)

The configuration and operation of a composite device 10 according to a first embodiment of an image recording apparatus will first be described. FIG. 1 is a perspective view showing the external configuration of the composite device 10.

As shown in FIG. 1, the composite device 10 is a multi function device (MFD) includes: a print unit 20 (an example of a main body) at its lower portion; and a scanning unit 12 (an example of a reading unit) at its upper portion. This composite device 10 has a printer function, a scanner function, a copy function, and a facsimile function. The print unit 20 corresponds to an image recording apparatus. Accordingly, the image recording apparatus is not limited to the composite device 10, but the image recording apparatus can also be applied to, for example, a single-function printer without having a scanning unit 12, and thus having neither a scanner function nor a copy function.

The composite device 10 is connectable with, mainly, an external information apparatus (not shown), such as a computer. The composite device 10 receives print data including image data, document data, etc. transmitted from the external information apparatus. The composite device 10 records an image on a recording sheet (an example of a recording medium) on the basis of the print data. The composite device 10 can also record an image on a recording sheet on the basis of the image data of a document read by the scanning unit 12. The composite device 10 is connectable with a digital camera etc. to record image data output from the digital camera, etc. on a recording sheet. The composite device 10 allows various storage media, such as a memory card, to be loaded therein so that image data stored in the storage media can be recorded on a recording sheet.

As shown in FIG. 1, the composite device 10 assumes a wide, thin, and substantially rectangular parallelepiped shape that is larger in horizontal width and depth than height. The print unit 20 has an opening 16 formed at the front thereof. The opening 16 allows a user to take out a recording sheet on which an image has been recorded and which is discharged into the opening 16 within the body. A sheet feed tray 29 (an example of a first tray) and a sheet discharge tray 21 (an example of a second tray) are disposed within the opening 16. The sheet feed tray 29 and the sheet discharge tray 21 are disposed at two upper and lower stages with the sheet discharge tray 21 placed above the sheet feed tray 29. The sheet feed tray 29 is a sheet feed cassette 52 (see FIG. 6) in which the sheet discharge tray 21 is integrally provided as a lid of the sheet feed tray 29.

The sheet feed tray 29 accommodates recording sheets to be used for recording of an image. Various kinds of recording sheets may be used as the recording sheets, such as plain papers, glossy papers, ink jet papers, postcards, etc. A recording sheet is subjected to an image recording in the process of being conveyed from the sheet feed tray 29 and is discharged to a space 40 (see FIG. 2) of the print unit 20 within the body. The sheet discharge tray 21 allows the recording sheet, on which the image has been recorded, to be placed thereon.

The sheet feed cassette 52 is inserted into or pulled out of the print unit 20 through the opening 16. In the present embodiment, as shown in FIG. 1, the opening 16 is provided at the front (left in FIG. 2) of the print unit 20 similarly to an operation panel 14. This facilitates take-out of a recording sheet from the sheet discharge tray 21 compared with, for example, a case where the opening 16 is formed at the side of the print unit 20. However, the position of the opening 16 is not limited thereto. The opening 16 may be formed at the side or back of the print unit 20. The sheet feed cassette 52 will be described below in detail.

A door 28 (see FIG. 1) is provided in a lower right portion of the front of the print unit 2 so as to be openable and closable. A cartridge mounting portion (not shown) is provided inside the door 28. When the door 28 is opened, a cartridge mounting portion is exposed to the front so that an ink cartridge can be mounted thereto or demounted therefrom. An ink cartridge is connected with a recording head 39 (see FIG. 5) via an ink tube 41 (see FIG. 4) when mounted to the cartridge mounting portion. A sub-tank along with the recording head 39 is provided in a carriage 38 (see FIG. 4) described later. The sub-tank stores ink supplied from the ink cartridge. The recording head 39 ejects ink supplied from the sub-tank to record an image on a recording sheet.

The scanning unit 12 is provided at an upper portion of the composite device 10. The scanning unit 12 reads an image of a document. The scanning unit 12 has a flatbed scanner (FBS), and an automatic document feeder (ADF) 34. The scanning unit 12 includes a platen 30 and a document cover 17. The platen 30 functions as the FBS. A platen glass, on which a document is to be placed, is provided on the top surface of the platen 30. An image sensor configured to read an image of a document is provided inside the platen 30. The document cover 17 brings a document placed on the platen glass into close contact with the platen glass, and is provided so as to be openable or closable with respect to the platen 30. A first document tray 32 and a second document tray 18 along with the ADF 34 are provided in the document cover 17.

In the scanning unit 12, an image of a document placed on the platen glass or a document placed on the first document tray 32 is read by the image sensor. The start of reading of the document is instructed in a state where the document placed on the first document tray 32. The document placed on the first document tray 32 is conveyed along a predetermined conveying path by the ADF 34, and is discharged to the second document tray 18. The image of the document is read by an image sensor in a predetermined position of the conveying path during conveyance of the document.

The start of reading of the document is instructed in a state where the document placed on the platen glass. The image sensor faces the platen glass and is moved in the sub-scanning direction (width direction of the print unit 20) of the document. In this process, the image of the document on the platen glass is read by the image sensor through the platen glass.

The operation panel 14 is provided at the upper portion of the front of the composite device 10. The operation panel 14 contains a liquid crystal display that displays various kinds of information, input keys that allow a user to input information, etc. The composite device 10 operates on the basis of operation inputs from the operation panel 14, or information transmitted from a computer, etc.

Figure 2:
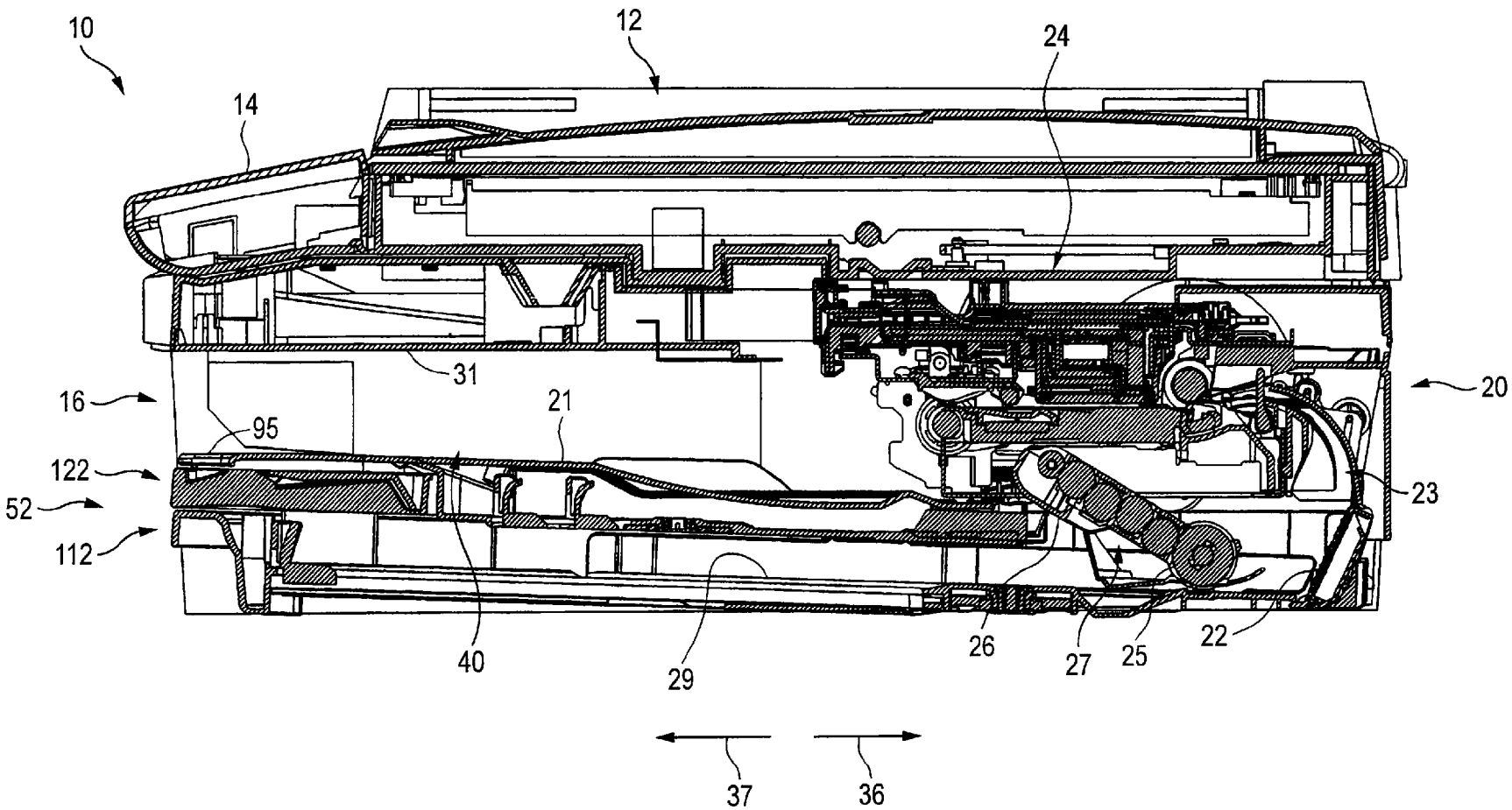
FIG. 2 is a longitudinal cross-sectional view showing the internal configuration of the composite device.

FIG. 2 is a longitudinal cross-sectional view showing the internal configuration of the composite device 10.

As shown in FIG. 2, the sheet feed tray 29 is provided at the bottom of the composite device 10. An inclined plate 22 (see FIG. 6) is provided at the deep side (the right in FIG. 2) of the sheet feed tray 29. The inclined plate 22 inclines so as to fall toward the rear side of the apparatus (the right in FIG. 2). The inclined plate 22 separates a recording sheet fed from the sheet feed tray 29 to guide the separated sheet upward. A conveying path 23 is provided above the inclined plate 22. The conveying path 23 is a path along which the recording sheet is conveyed, and a portion thereof is formed so as to be curved. Specifically, after the conveying path 23 goes upward from the inclined plate 22, the conveying path is curved and extends toward the front (the left in FIG. 2) of the composite device 10, and leads to the sheet discharge tray 21 through an image recording unit 24 (corresponding to a recording unit). A recording sheet accommodated in the sheet feed tray 29 is guided so as to make a U turn upward from below along the conveying path 23, leads to the image recording unit 24, is subjected to image recording by the image recording unit 24, and is then discharged to the space 40 on the sheet discharge tray 21. The conveying path 23 is defined by an outside guide surface and an inside guide surface that face each other with a predetermined gap therebetween except a place where the image recording unit 24 is disposed.

Figure 3:
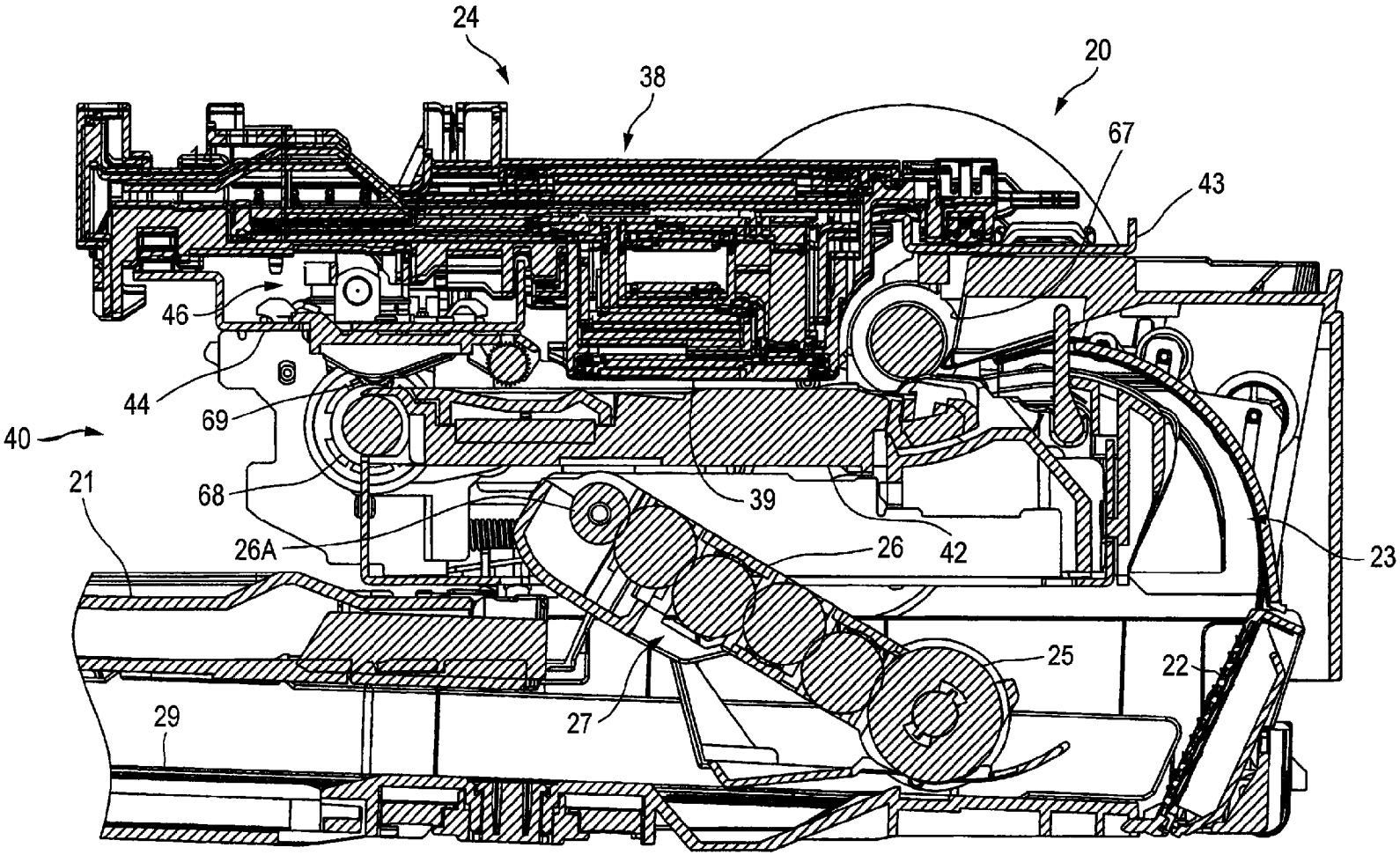
FIG. 3 is a partially enlarged cross-sectional view showing main elements of a print unit.

FIG. 3 is a partially enlarged cross-sectional view showing main elements of the print unit 20.

As shown in FIG. 3, a sheet feed roller 25 (a portion of a conveying unit) is provided above the sheet feed tray 29. The sheet feed roller 25 is brought into pressure contact with a recording sheet to feed the recording sheet to a conveying roller 67 and a pinch roller 64 (see FIG. 19). The sheet feed roller 25 is provided closer to the upstream side (hereinafter simply referred to as the "upstream side") in the conveying direction of a recording sheet than the conveying path 23 that is formed so as to be curved. The sheet feed roller 25 is brought into pressure contact with a recording sheet placed on the sheet feed tray 29 to feed the recording sheet to the inclined plate 22. The sheet feed roller 25 is journalled to a tip of a sheet feed arm 26. The sheet feed roller 25 is rotated by a driving force transmitted thereto from an LF motor 85 (a portion of the conveying unit (see FIG. 5)) by a driving transmission mechanism 27 in which a plurality of gears mesh with each other.

As shown in FIG. 3, the sheet feed arm 26 moves up and down with a base shaft 26A as the axis of rotation so that it can be brought into contact with or separated from the sheet feed tray 29. The sheet feed arm 26 is rotated downward so as to contact the sheet feed tray 29 by its own weight. Thereby, the sheet feed roller 25 is contacted with the sheet feed tray 29. In a case where recording sheets are accommodated in the sheet feed tray 29, the sheet feed roller 25 is brought into pressure contact with a recording sheet in the uppermost position in the sheet feed tray 29. When the sheet feed cassette 52 (see FIG. 6) is inserted or pulled out through the opening 16, the sheet feed arm 26 is retreated upward.

The sheet feed roller 25 is rotated by a driving force transmitted from the LF motor 85 in a state where the roller is brought into pressure contact with the surface of a recording sheet on the sheet feed tray 29. Thereby, the uppermost recording sheet is delivered to the inclined plate 22 by the frictional force between the surface of the sheet feed roller 25 and the recording sheet. The recording sheet is abutted on the inclined plate 22 at its leading end, and is guided upward, i.e., to the conveying path 23. When the uppermost recording sheet is delivered by the sheet feed roller 25, a recording sheet directly under the uppermost recording sheet may be delivered by friction or action of static electricity, but the recording sheet is restrained by abutment on the inclined plate 22.

As shown in FIG. 3, the conveying roller 67 (a portion of the conveying unit) is provided closer to the downstream side (hereinafter simply referred to as the "downstream side") in the conveying direction of a recording sheet than the conveying path 23 that is formed so as to be curved. The pinch roller 64 (a portion of the conveying unit) is provided in a position that faces the conveying roller 67 across the conveying path 23 (see FIG. 19). The pinch roller 64 is not shown in FIG. 3. The pinch roller 64 is urged to the conveying roller 67 so that it can be brought into pressure contact with the conveying roller. When a recording sheet is fed to the conveying path 23 by the sheet feed roller 25, the sheet enter a space between the conveying roller 67 and the pinch roller 64. In that case, the pinch roller 64 retreats by the thickness of the recording sheet, and nips the recording sheet along with the conveying roller 67. The conveying roller 67 is rotated by a driving force transmitted from the LF motor 85 (see FIG. 5). The rotatory power of the conveying roller 67 is reliably transmitted to the recording sheet, and the recording sheet is conveyed onto the platen 42 (see FIG. 3).

As shown in FIG. 3, the image recording unit 24 (see FIG. 4) is provided on the downstream side of the conveying roller 67. In the image recording unit 24, a head control board 33 (see FIG. 5) and the recording head 39 (see FIG. 5) are carried on the carriage 38 (see FIG. 4) that reciprocates in a main scanning direction (direction vertical to the sheet surface of FIG. 3). Here, the main scanning direction is a direction substantially orthogonal to a conveying direction 50 (see FIG. 4) of a recording sheet. Ink is supplied to the recording head 39 through the ink tube 41 (see FIG. 4) from the above-mentioned ink cartridge. The recording head 39 selectively ejects ink to a recording sheet as fine ink droplets. The recording sheet is conveyed on the platen 42 by the conveying roller 67 and the pinch roller 64. In this conveying process, the recording head 39 selectively ejects ink droplets while being scanned in the direction substantially orthogonal to the conveying direction of the recording sheet by the reciprocation of the carriage 38. Thereby, an image is recorded on the recording sheet that passes above the platen 42.

Further, a sheet discharge roller 68 (a portion of the conveying unit (see FIG. 3)) is provided on the downstream side of the image recording unit 24. A spur roller 69 (a portion of the conveying unit) is provided in a position that faces the sheet discharge roller 68 across the conveying path 23. The spur roller 69 is brought into pressure contact with the sheet discharge roller 68. An image is recorded on a recording sheet by the image recording unit 24 while the recording sheet passes above the platen 42 as mentioned above. When this recording sheet enters between the sheet discharge roller 68 and the spur roller 69, the recording sheet is nipped by the sheet discharge roller 68 and the spur roller 69. The driving force from the LF motor 85 (see FIG. 5) is also transmitted to the sheet discharge roller 68 in addition to the conveying roller 67. Thereby, the conveying roller 67 and the sheet discharge roller 68 are intermittently driven with predetermined linefeed width. The conveying roller 67 and the sheet discharge roller 68 are synchronized with each other in rotation. A recording sheet on which an image is recorded is conveyed by the conveying roller 67, the pinch roller 64, the sheet discharge roller 68, and the spur roller 69 (see FIG. 19), and is discharged onto the sheet discharge tray 21 toward the opening 16. The scanning unit 12 is provided above the image recording unit 24 (see FIG. 2). The space 40 (see FIGS. 2 and 3) is provided between the scanning unit 12 and the sheet discharge tray 21. A recording sheet on which an image is recorded is discharged to the space 40 from the conveying path 23, and is accommodated within the sheet discharge tray 21.

Figure 4:
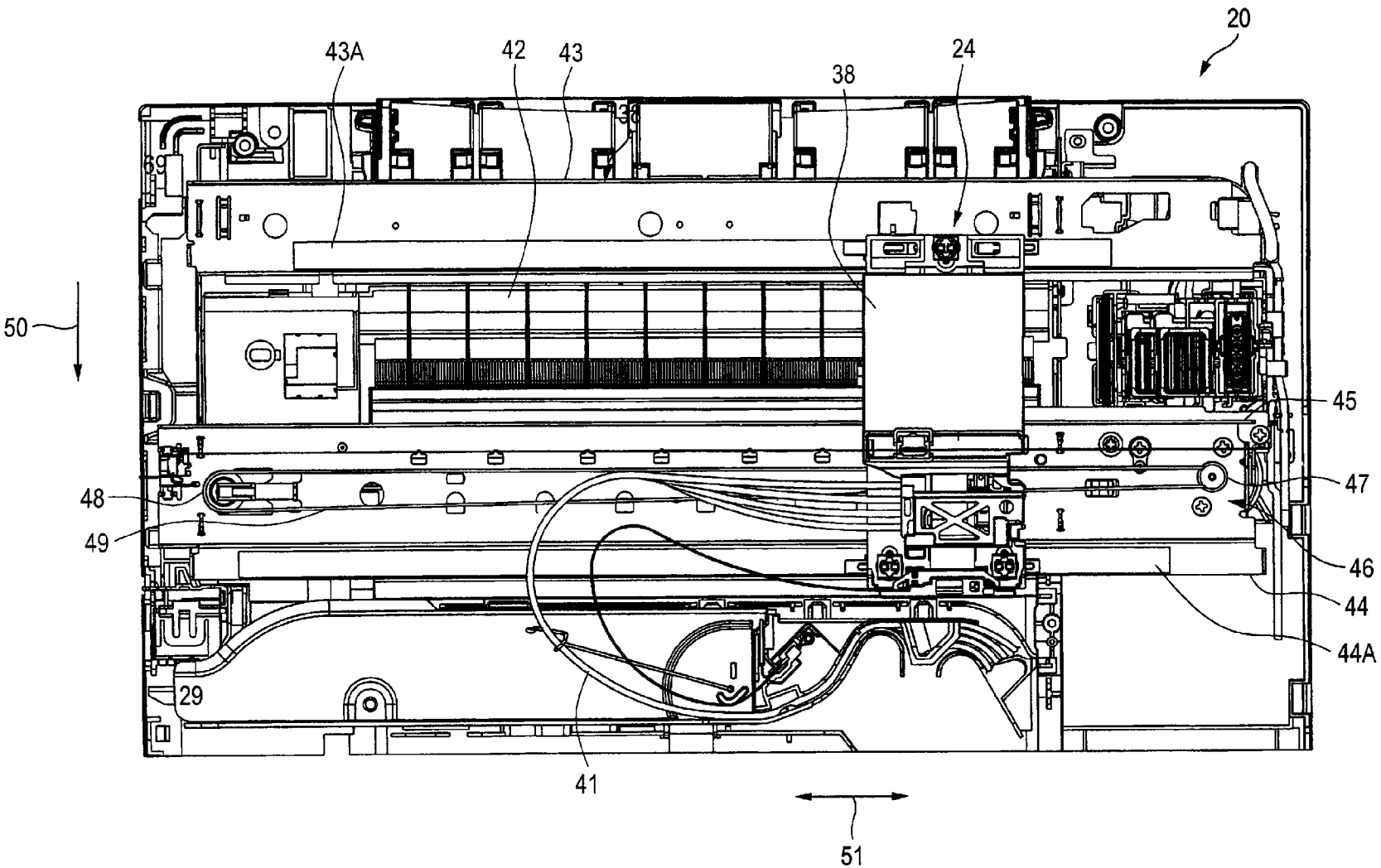
FIG. 4 is a plan view showing the main elements of the print unit.

FIG. 4 is a plan view showing principal elements of the print unit 20.

As shown in FIG. 4, a pair of guide rails 43 and 44 are provided above the conveying path 23 (upper side in FIG. 3). The guide rails 43 and 44 are separated from each other at a predetermined distance in the conveying direction 50 of a recording sheet, and extend in a direction 51 (hereinafter also referred to as the orthogonal direction) orthogonal to the conveying direction 50. The carriage 38 is placed so as to be reciprocable in a horizontal direction (orthogonal direction 51) orthogonal to the conveying direction 50 so that it may straddle the guide rails 43 and 44.

The guide rail 43 is disposed closer to the upstream side than the guide rail 44. The guide rail 43 is a flat plate-shaped rail whose length in the width direction (orthogonal direction 51) of the conveying path 23 (see FIG. 3) is larger than the reciprocation range of the carriage 38. The downstream top surface of the guide rail 43 is a guide surface 43A. An upstream end of the carriage 38 is slidably supported by the guide surface 43A.

The guide rail 44 is disposed closer to the downstream side than the guide rail 43. The guide rail 44 is a flat plate-shaped rail whose length of the width direction of the conveying path 23 is almost the same as the guide rail 43. An upstream edge 45 of the guide rail 44 is bent at almost a right angle upward. The downstream top surface of the guide rail 44 defines a guide surface 44A. A downstream end of the carriage 38 is slidably supported by the guide surface 44A. The carriage 38 nips the edge 45 by rollers (not shown). Thereby, the carriage 38 is slidably carried on the guide surfaces 43A and 44A of the guide rails 43 and 44. The carriage 38 can reciprocate in the horizontal direction (orthogonal direction 51) orthogonal to the conveying direction of a recording sheet on the basis of the edge 45 of the guide rail 44.

A belt driving mechanism 46 is disposed on the top surface of the guide rail 44. The belt driving mechanism 46 is provided along the guide rail 44. The belt driving mechanism 46 has a driving pulley 47, a driven pulley 48, and a driving belt 49. The driving pulley 47 and the driven pulley 48 are respectively provided in the vicinity of both ends of the conveying path 23 in its width direction. The driving belt 49 is an endless annular timing belt having teeth provided therein, and is stretched between the driving pulley 47 and the driven pulley 48. Teeth that mesh with the teeth of the driving belt 49 are formed at a periphery of the driving pulley 47. For this reason, the rotation of the driving pulley 47 is reliably transmitted to the driving belt 49, and thereby the driving belt 49 is moved circumferentially. The carriage 38 is connected with the driving belt 49. For this reason, the carriage 38 reciprocates in the orthogonal direction 51 on the guide rails 43 and 44 on the basis of the operation of the belt driving mechanism 46. The recording head 39 is carried on the carriage 38. For this reason, the recording head 39 can reciprocate with the orthogonal direction 51 as the main scanning direction.

The driving pulley 47 is rotationally provided at one end (right end in FIG. 4) of the top surface of the guide rail 44 around an axis extending in a direction orthogonal to the guide surface 44A. That is, the axial direction of the driving pulley 47 is a vertical direction. Although now shown in FIG. 4, a CR (carriage) motor 80 (see FIG. 5) is provided below the guide rail 44. The driving force of the CR motor 80 is transmitted to a shaft of the driving pulley 47. Thereby, the driving pulley 47 is rotated, and the carriage 38 is reciprocated.

As shown in FIG. 4, the platen 42 is disposed below the conveying path 23 so as to face the recording head 39. The platen 42 is disposed over a central portion through which a recording sheet passes, in the reciprocation range of the carriage 38. The width of the platen 42 is sufficiently larger than the maximum width of a recording sheet that can be conveyed. For this reason, a recording sheet is conveyed along the conveying path 23 so that both ends thereof may always pass above the platen 42. The platen 42 and the guide rails 43 and 44 are parallel to each other in a state where they are separated from each other with a predetermined gap therebetween. For this reason, the bottom surface of the recording head 39 that is slidingly moved on the guide rails 43 and 44, and the top surface of the platen 42 face each other with a predetermined head gap therebetween.

Figure 5:
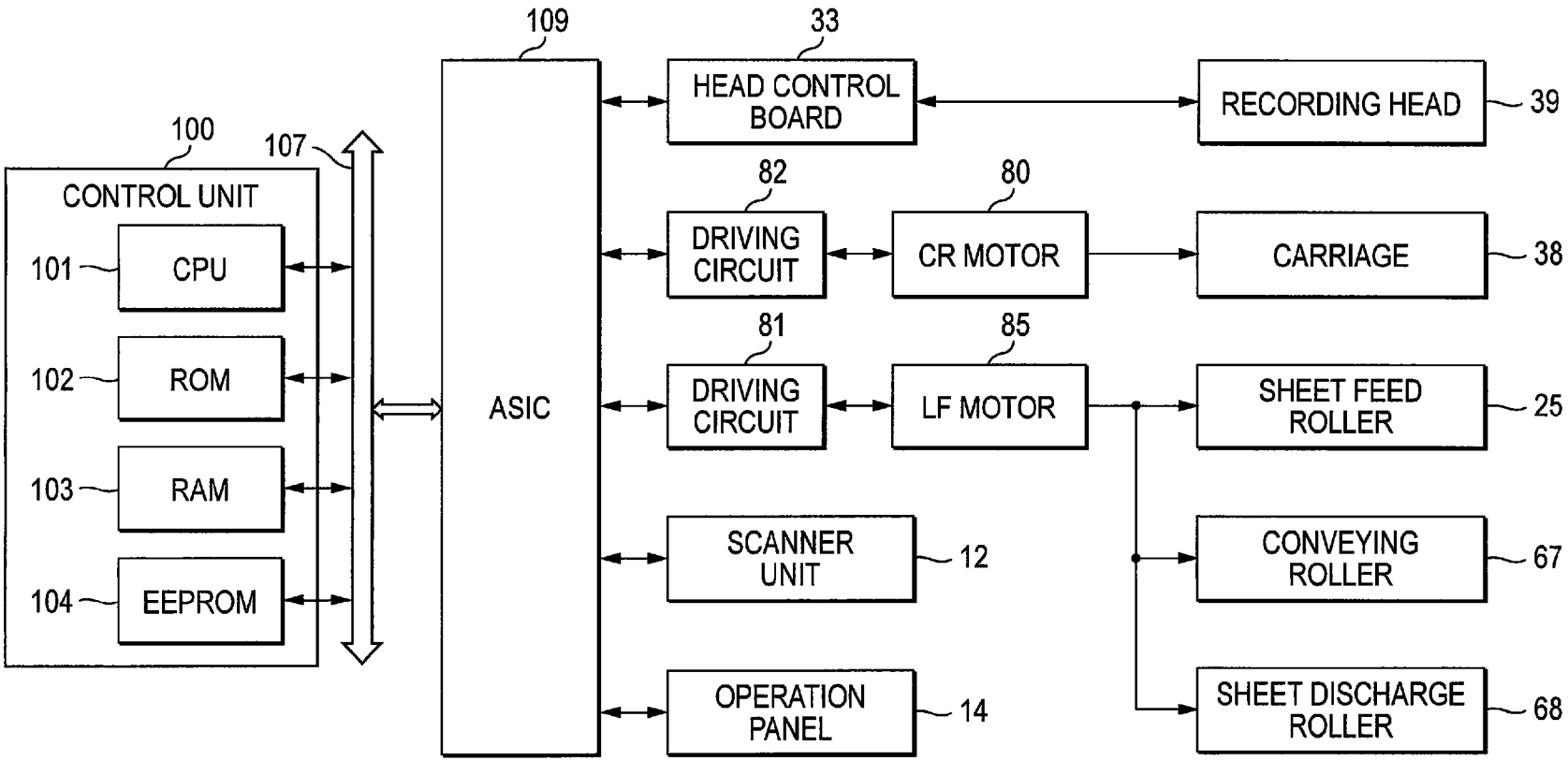
FIG. 5 is a block diagram showing an exemplary configuration of the composite device according to the present embodiment.

FIG. 5 is a block diagram showing an exemplary configuration of the composite device 10 according to the present embodiment.

The control unit 100 controls the whole operation of the composite device 10. As shown in FIG. 5, the control unit 100 is constituted as a microcomputer mainly including a CPU (Central Processing Unit) 101, a ROM (Read Only Memory) 102, a RAM (Random Access Memory) 103, and an EEPROM (Electrically Erasable and Programmable ROM) 104. The control unit 100 is connected to an ASIC (Application Specific integrated Circuit) 109 via a bus 107.

A program for allowing the CPU 101 to control various operations of the composite device 10 is stored in the ROM 102. The RAM 103 is used as a storage region or working area that temporarily stores various data used when the CPU 101 executes the above program. The EEPROM 104 retains data such as settings, flags even after power-off of the composite device 10.

The head control board 33, a driving circuit 82, a driving circuit 81, the scanning unit 12 (see FIG. 1), the operation panel 14 (see FIG. 1), etc. are connected to the ASIC 109.

The head control board 33 control driving of the recording head 39 on the basis of an image signal input from the ASIC 109. Thereby, ink is selectively ejected from a nozzle (not shown) of the recording head 39 with predetermined timing, thereby recording an image on a recording sheet. The head control board 33 along with the recording head 39 is carried on the carriage 38 (see FIG. 4).

The driving circuit 82 supplies a driving signal to the CR motor 80 on the basis of a phase excitation signal, etc. input from the ASIC 109. In response to this driving signal, the CR motor 80 rotates, which controls reciprocation of the carriage 38.

The driving circuit 81 drives the LF motor 85. The sheet feed roller 25, the conveying roller 67, and the sheet discharge roller 68, which are shown in FIG. 3, are connected to the LF motor 85. The driving circuit 81 receives an output signal from the ASIC 109 to drive the LF motor 85. The driving force of the LF motor 85 is selectively transmitted to the sheet feed roller 25, the conveying roller 67, and the sheet discharge roller 68 via a well-known drive mechanism including a gear, a driving shaft, etc.

Figure 6:
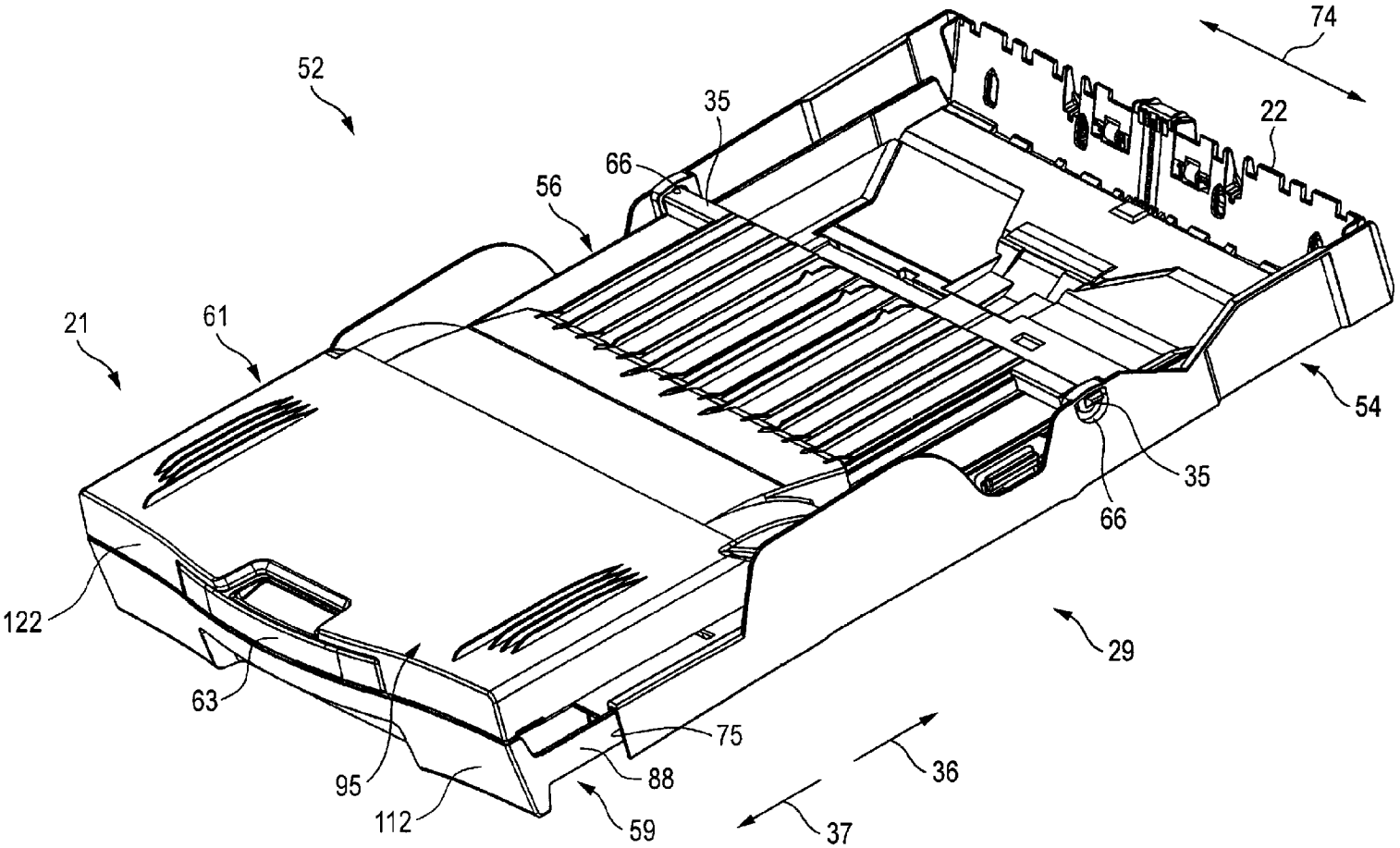
FIG. 6 is a perspective view showing the entire configuration of a sheet feed cassette.

FIG. 6 is a perspective view showing the entire configuration of the sheet feed cassette 52.

The sheet feed cassette 52 includes the sheet feed tray 29 and the sheet discharge tray 21 when roughly classified. The sheet discharge tray 21 is rotatably supported in an upper portion of the sheet feed cassette 29. The sheet discharge tray 21 is configured to be rotatable toward the sheet feed tray 29 and upward around an axis extending in a horizontal direction (hereinafter also referred to as "horizontal direction") 74 substantially orthogonal to a first direction 36 and a second direction 37 described later. When the sheet discharge tray 21 is toppled with respect to the sheet feed tray 29, the top surface of the sheet feed tray 29 is covered with the sheet discharge tray 21 (see FIG. 6). In this state, the sheet discharge tray 21 holds a recording sheet on which an image is recorded, and functions as a lid of the sheet feed tray 29. This prevents dust from entering the sheet feed tray 29. Further, as the sheet discharge tray 21 is erected with respect to the sheet feed tray 29, the top surface of the sheet feed tray 29 is opened, allowing replenishment of recording sheets to the sheet feed tray 29. An upper portion of the sheet feed tray 29 on its deep side is opened so that the driving transmission mechanism 27 (see FIG. 2) may be disposed.

The sheet feed tray 29 has a tray body 54 (an example of a first tray body), and an extension tray 59 (an example of a third slide tray). The sheet feed tray 29 is configured so that the extension tray 59 can slide in the first direction 36 and second direction 37 with respect to the tray body 54. Here, the first direction 36 is a direction in which the extension tray 59, and an extension tray 61 described later are pushed into the opening 16 (see FIGS. 1 and 2). The second direction 37 is a direction in which the extension tray 59 and the extension tray 61 are pulled out from the opening 16. Although described later, the extension tray 59 is provided in the tray body 54 so that its rear end 112 can slide further toward the first direction 36 and the second direction 37 than a rear end 122 (corresponding to the second end portion), that is, the extension tray 59 can be slid in the second direction 37 so that the rear end 112 is positioned downstream the rear end 112 with respect to the second direction 37. As the extension tray 59 is slid in the second direction 37 or first direction 36 with respect to the tray body 54 if necessary, a sheet placing surface of the sheet feed tray 29 is extended or retracted in the conveying direction 50 (see FIG. 4). Thereby, recording sheets of various sizes can be accommodated in the sheet feed cassette 29. The conveying direction 50 and the second direction 37 are same directions.

The sheet discharge tray 21 has a tray body 56 (an example of a first rotary body), and an extension tray 61 (an example of a first slide tray or second slide tray). The sheet discharge tray 21 is configured so that the extension tray 61 can slide in the first direction 36 and second direction 37 with respect to the tray body 56. Although described later, the extension tray 61 is provided in the tray body 56 so that its rear end 122 can slide further toward the first direction 36 and the second direction 37 than the rear end 112, that is, the extension tray 61 can be slid in the first direction 36 so that the rear end 122 is positioned downstream the rear end 112 with respect to the first direction 36. The sheet discharge tray 61 is slid in the second direction 37 or first direction 36 with respect to the tray body 56 to match the extension tray 59. This maintains the state where the upside of the sheet feed tray 29 is covered with the sheet discharge tray 21. That is, even if the position of the extension tray 59 is changed in order to change the size of recording sheets to be accommodated in the sheet feed tray 29, the sheet discharge tray 21 functions as a lid of the sheet feed tray 29.

Figure 7:
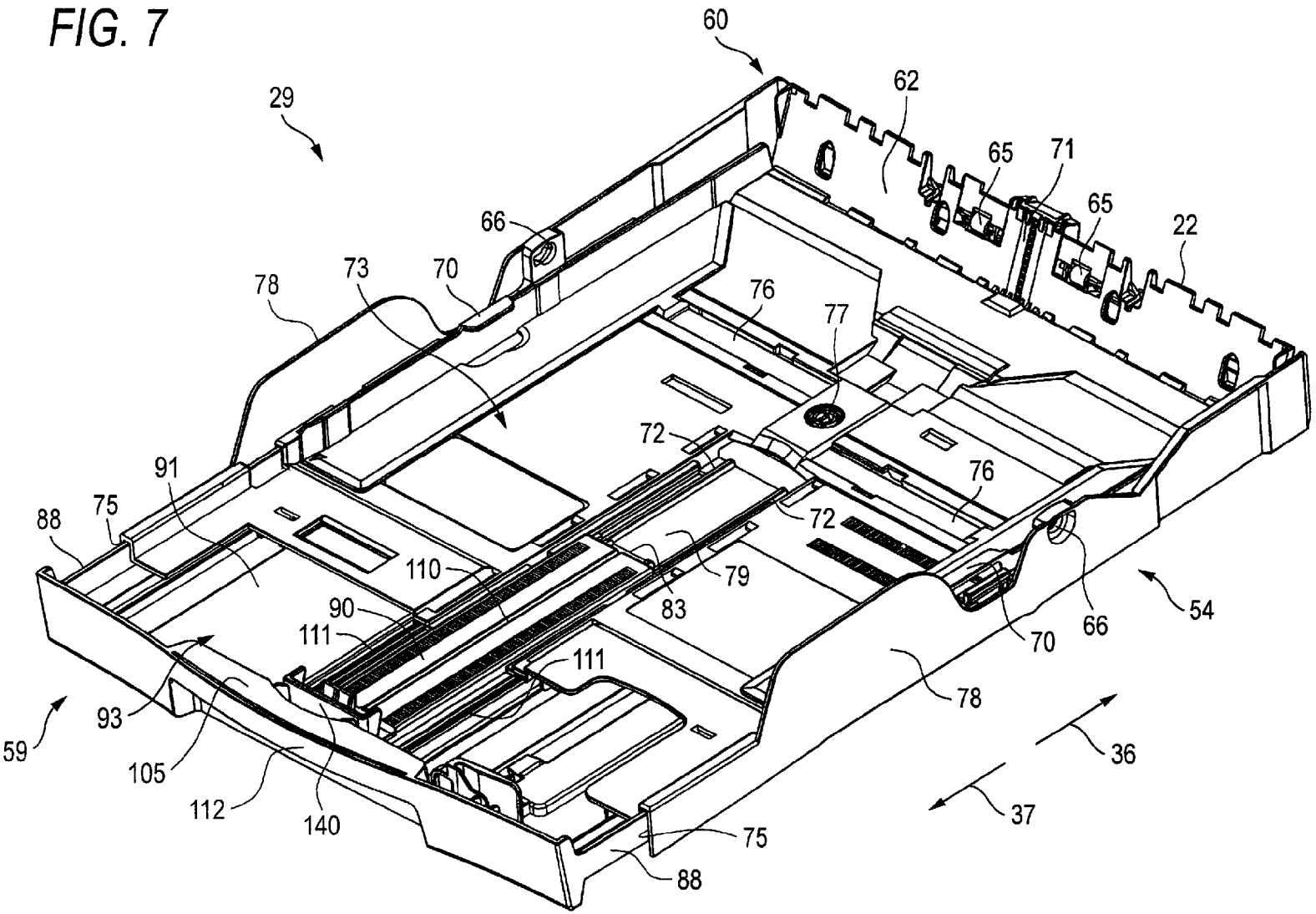
FIG. 7 is a perspective view showing the surface side of a sheet feed tray, and shows a state where an extension tray is pulled out in a second direction with respect to a tray body.
Figure 8:
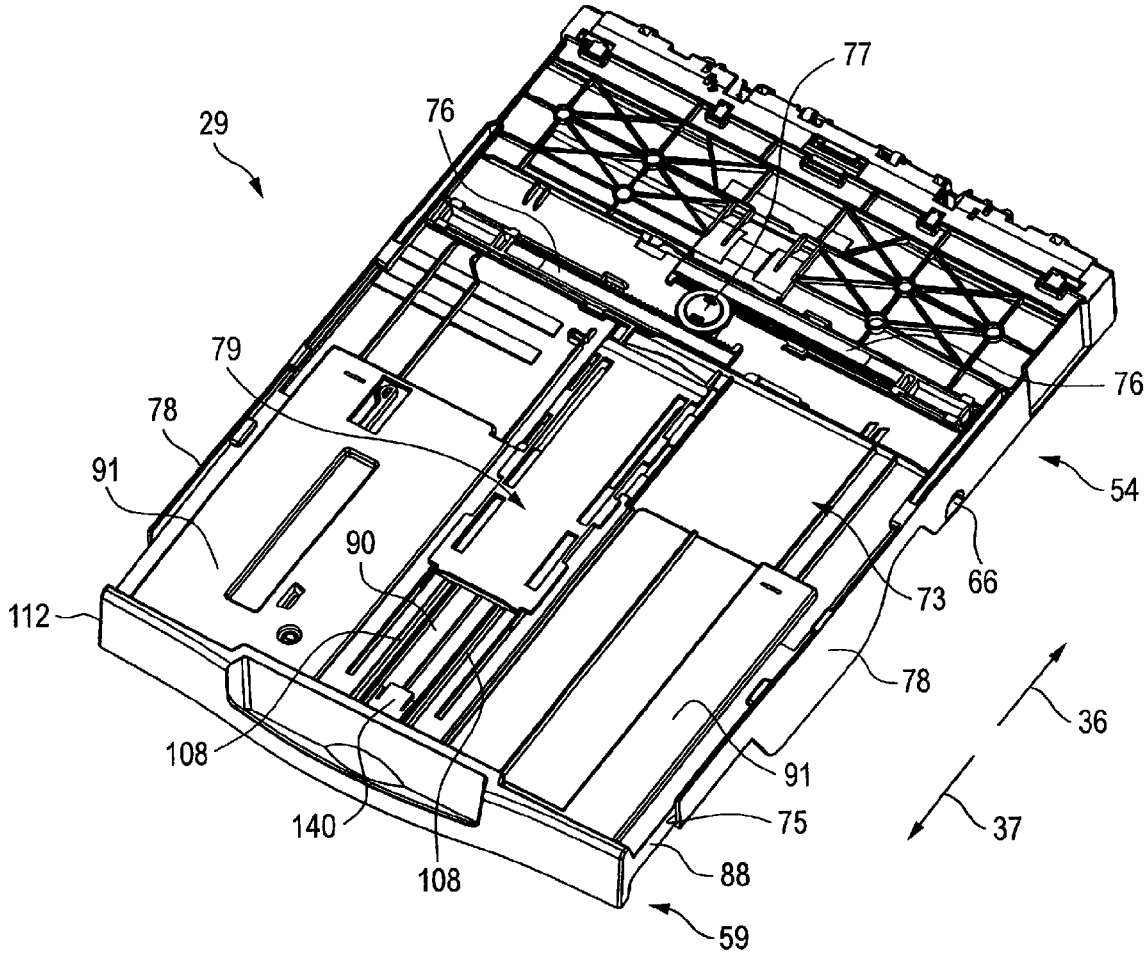
FIG. 8 is a perspective view showing the back side of the sheet feed tray in the state shown in FIG. 7.
Figure 9:
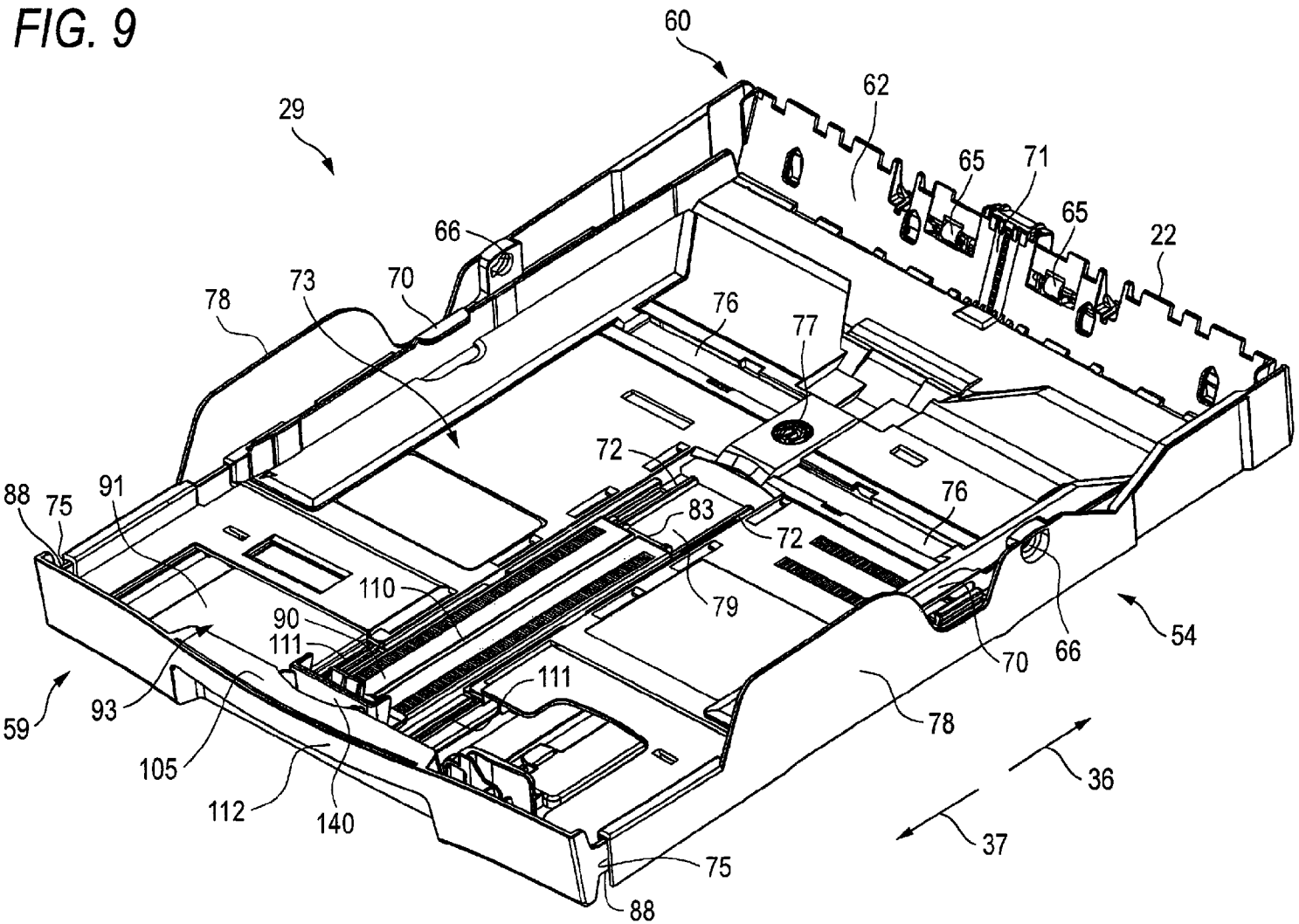
FIG. 9 is a perspective view showing the surface side of the sheet feed tray, and shows a state where the extension tray is pushed in the first direction with respect to the tray body.
Figure 10:
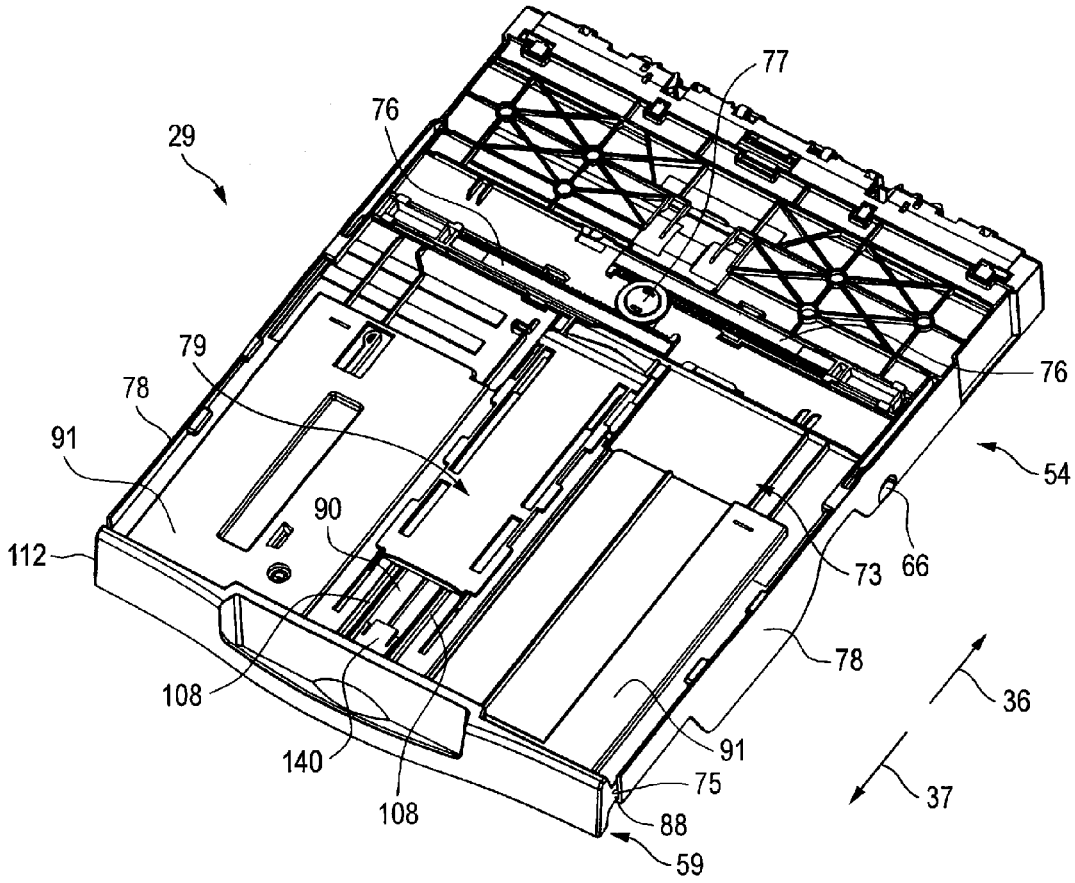
FIG. 10 is a perspective view showing the back side of the sheet feed tray in the state shown in FIG. 9.

FIG. 7 is a perspective view showing the surface side of the sheet feed tray 29, and shows a state where the extension tray 59 is pulled out in the second direction 37 with respect to the tray body 54. FIG. 8 is a perspective view showing the back side of the sheet feed tray 29 in the state shown in FIG. 7. FIG. 9 is a perspective view showing the surface side of the sheet feed tray 29, and shows a state where the extension tray 59 is pushed in the first direction 36 with respect to the tray body 54. FIG. 10 is a perspective view showing the back side of the sheet feed tray 29 in the state shown in FIG. 9. FIGS. 7 to 10 show a state where the sheet discharge tray 21 is detached from the sheet feed tray 29.

As shown in FIGS. 7 to 10, the tray body 54 is formed in a rectangular shape that is long in the first direction 36 and the second direction 37. The inclined plate 22 (see FIGS. 2 and 3) is provided at a front end 60 of the tray body 54. The inclined plate 22 includes a plate-like member that is long in the width direction (horizontal direction 74 in FIG. 6) of the tray body 54. The inclined plate 22 is tilted toward the rear side of the apparatus (toward the first direction 36). Accordingly, when the leading end of a recording sheet abuts on the inclined plate 22, the leading end is guided obliquely upward along an internal surface 62 of the inclined plate 22. That is, the internal surface 62 functions as a guide surface that guides a recording sheet to the conveying path 23 (see FIG. 3).

The internal surface 62 is provided with a separating member 71. The separating member 71 is disposed in the longitudinal center of the inclined plate 22 in the internal surface 62. As for the separating member 71, a plurality of teeth protruding from the internal surface 62 are juxtaposed in the direction of inclination of the inclined plate 22. When a plurality of recording sheets are fed in a state where they are overlapped and the leading end of the sheet abuts on the internal surface 62, the leading end of the sheet bundle are separated by the separating member 71. In that case, the teeth of the separating member 71 enter between recording sheets, forming a gap between the recording sheets. This facilitates separation of the recording sheets. As a result, only the uppermost recording sheet is reliably separated from the underlying sheets, together with a force given to the recording sheets from the sheet feed roller 25 during sheet feeding.

Two rollers 65 are rotatably provided in the internal surface 62. The rollers 65 are provided in symmetrical positions across the separating member 71 in the longitudinal direction of the inclined plate 22. The surfaces of the rollers 65 are exposed from the internal surface 62. As the rollers 65 rotate, conveyance friction applied to a recording sheet is reduced.

Figure 18:
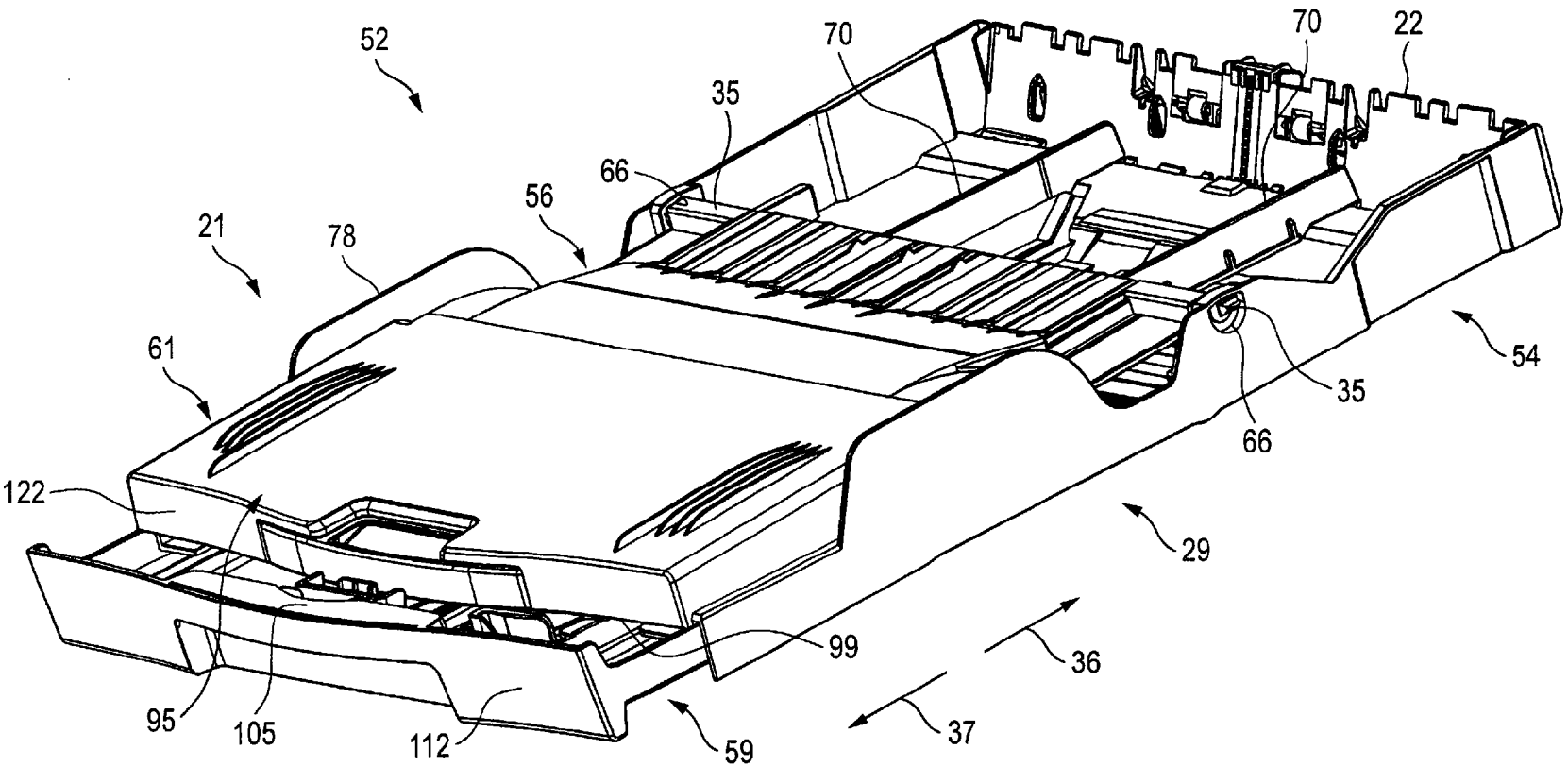
FIG. 18 is a perspective view showing the sheet feed cassette in which the posture of the sheet discharge tray is changed to the second posture.

The tray body 54 is provided with a pair of side guides 70. The side guides 70 are provided so as to be slidable in the width direction (horizontal direction 74) of the tray body 54. The side guides 70 regulate the position of recording sheets, which are placed on the sheet feed tray 29, in their width direction. Specifically, the side guides 70 regulate so that the position of the recording sheets, which are placed on the sheet feed tray 29, in their width direction may be made to coincide substantially with a predetermined reference position (the center of the sheet feed tray 29 in its width direction in the present embodiment). As such, regulating recording sheets so that the central position of the recording sheets in their width direction may be made to coincide with the reference position is generally referred to as the "center registration." FIGS. 7 and 9 show a state where the side guides 70 have been moved to the outside of the tray body 54 in its width direction. FIG. 18 shows a state where the side guides 70 have been moved to the inside of the tray body 54 in its width direction.

The side guides 70 are provided with rack gears 76 (see FIGS. 8 and 10) extending toward the center in the width direction. The rack gears 76 mesh with a pinion gear 77 buried in the center of the tray body 54 in its width direction. When any one of the two side guides 70 slides in the horizontal direction 74, the other guide slides in an interlocking manner in a direction opposite to the sliding direction of the one side guide. Accordingly, in a case where the width of recording sheets placed on the sheet feed tray 29 is shorter than the distance between the side guides 70, the two side guides 70 are moved simultaneously by making one of the side guides 70 slide. Thereby, the central position of the recording sheets in their width direction coincides substantially with the above reference position.

The tray body 54 is provided with side end guides 78. The side end guides 78 are provided at both ends of the tray body 54 in its width direction. The side end guides 78 are vertically erected upward from a bottom 73 of the tray body 54. Bearing holes 66 for supporting the sheet discharge tray (see FIG. 11) are provided in the side end guides 78, respectively.

The side end guides 78 (see FIGS. 7 to 10) have guide grooves 75 with an inverted U-shaped cross-section. The guide grooves 75 regulate the sliding direction of the extension tray 59 to the first direction 36 and the second direction 37. Rails 88 of the extension tray 59 are inserted into the guide grooves 75, respectively.

A recessed portion 79 is formed in the tray body 54. The recessed portion 79 is formed in a rectangular shape that is relatively long in the longitudinal direction of the tray body 54. The recessed portion 79 is provided with two rails 72 (see FIGS. 7 and 9). As shown in FIGS. 7 and 9, the rails 72 are erected vertically from the bottom surface of the recessed portion 79. The rails 72 are provided over the whole longitudinal region of the recessed portion 79. The sliding direction of the extension tray 59 is regulated to the first direction 36 and the second direction 37 by inserting the rails 72 into guide grooves 108 (see FIGS. 8 and 10) of the extension tray 59, respectively.

As shown in FIGS. 7 to 10, the tray body 59 is formed in a rectangular shape that is long in the horizontal direction 74 (see FIG. 6). A horizontal top surface 105 is formed in the center of the rear end 112 (corresponding to the first end portion) of the extension tray 59 in its width direction. The extension tray 61 of the sheet discharge tray 21 is supported by the top surface 105 (see FIG. 6).

The rails 88 are provided at the both width ends of the extension tray 59 to extend in the first direction 36 and the second direction 37 and form wall surfaces in the width direction. The rails 88 is inserted into the guide grooves 75 of the tray body 54. The rails 88 are formed in the position and to have a shape so that the rails 88 can be inserted into the guide grooves 75.

As shown in FIGS. 7 to 10, an upper inserting portion 90 and a lower inserting portion 91 are provided in the extension tray 59. The upper inserting portion 90 is provided in the center of the extension tray 59 in its width direction with the first direction 36 and the second direction 37 as the longitudinal direction. As shown in FIGS. 7 and 9, the upper inserting portion 90 is inserted into the tray body 54 so as to cover above the recessed portion 79. Accordingly, the upper inserting portion 90 is formed at the position and to have the shape so as to correspond to the recessed portion 79.

As shown in FIGS. 8 and 10, the two guide grooves 108 are formed at the back of the upper inserting portion 90 along the lateral direction of the extension tray 59. The rails (see FIGS. 7 and 9) of the tray body 54 are inserted into the guide grooves 108, respectively. Accordingly, the guide grooves 108 are provided in positions corresponding to the rails 72.

A slit 110 (see FIGS. 7 and 9) is formed in the center of the upper inserting portion 90 in its width direction over its whole longitudinal region. The upper inserting portion 90 is provided with a rear guide 140 (see FIG. 7 and FIG. 9). The rear guide 140 abuts on the trailing end of a recording sheet placed on the sheet feed tray 29 to regulate the position of the trailing end. A lower portion of the rear guide 140 is inserted into the slit 110. Thereby, the rear guide 140 is slidably supported along the slit 110. Accordingly, the rear guide 140 can slide between a front end 83 and the rear end 112. When the rear guide 140 are slid toward trailing ends of recording sheets, the trailing ends of the recording sheets abuts on the guide surface of the rear guide 140. Thereby, the trailing ends of the recording sheets are aligned with one another.

The portion of the bottoms 93 of the extension tray excluding the upper inserting portion 90 is the lower inserting portion 91 (see FIGS. 8 and 10). That is, the lower inserting portion 91 is provided outside both ends of the upper inserting portion 90 in its width direction. As shown in FIGS. 7 to 10, the lower inserting portion 91 is inserted so as to be hidden toward the back of the tray body 54. Slits 111 are formed at a boundary between the upper inserting portion 90 and the lower inserting portion 91 (see FIGS. 7 and 9). The slits 111 extend in the same direction as the extension direction of the slit 110, and are formed in almost the same shape as the slit 110. The upper inserting portion 90 and the lower inserting portion 91 are separated in the width direction of the extension tray 59 by the slits 111. Thereby, when the extension tray 59 is attached to the tray body 54, it is possible to insert the upper inserting portion 90 so as to be exposed to the surface of the bottom 73 of the tray body 54, and to insert the lower inserting portion 91 so as to be hidden toward the back of the bottom 73.

Since the tray body 54 and the extension tray 59 are configured in this way, the extension tray 59 can slide in the first direction 36 and second direction 37 with respect to the tray body 54. As the extension tray 59 is pulled out in the second direction 37 from a state (see FIGS. 9 and 10) where it is accommodated in the tray body 54, the sheet placing surface of the sheet feed tray 29 is extended. On the contrary, as the extension tray 59 is pushed in the first direction 36 with respect to the tray body 54 from a state (for example, FIGS. 6 to 8) where the extension tray is pulled out of the tray body 54, the sheet placing surface of the sheet feed tray 29 is retracted.

Figure 11:
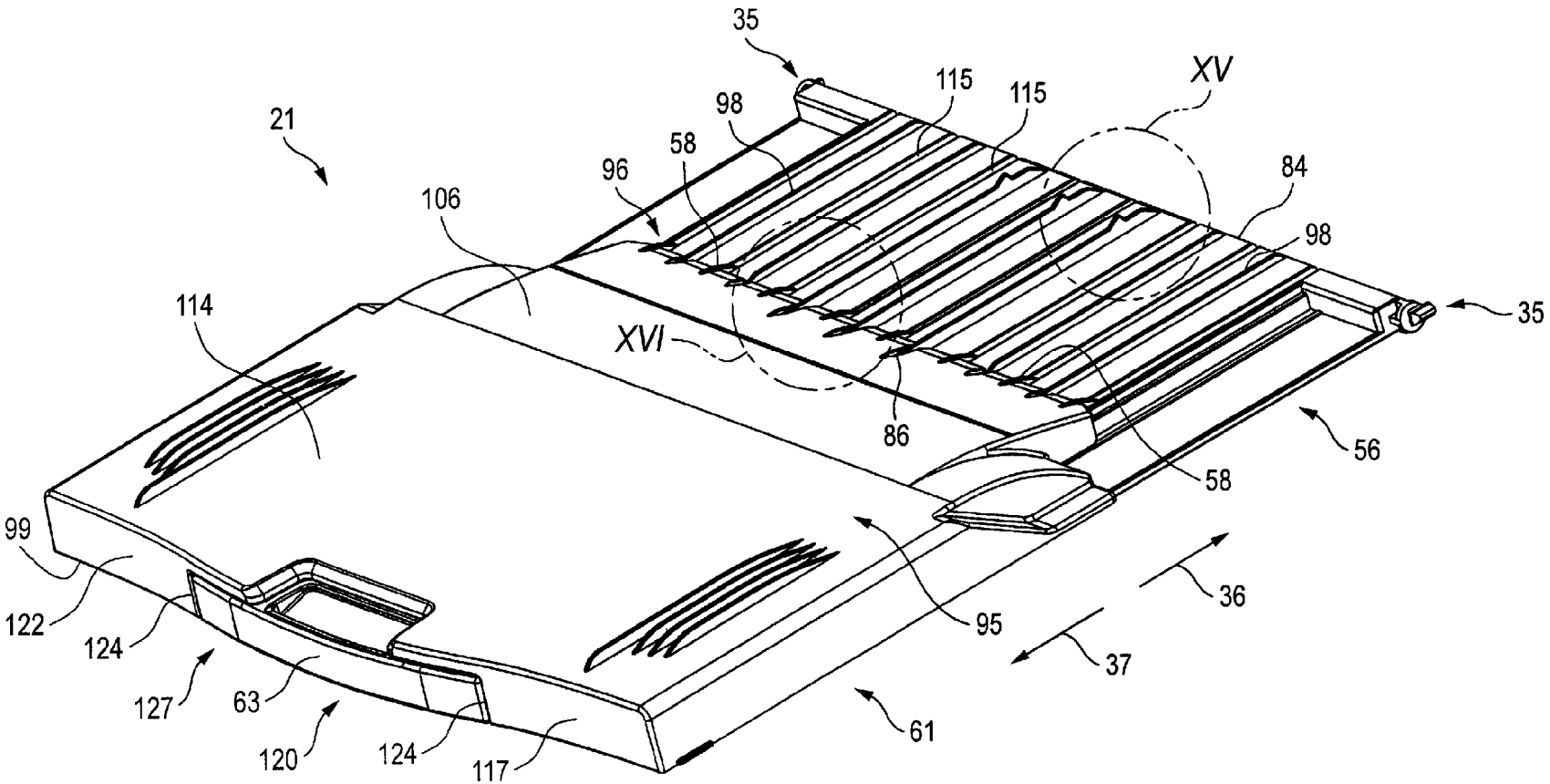
FIG. 11 is a perspective view showing the surface side of a sheet discharge tray, and shows a state where an extension tray is pulled out in the second direction with respect to a tray body.
Figure 12:
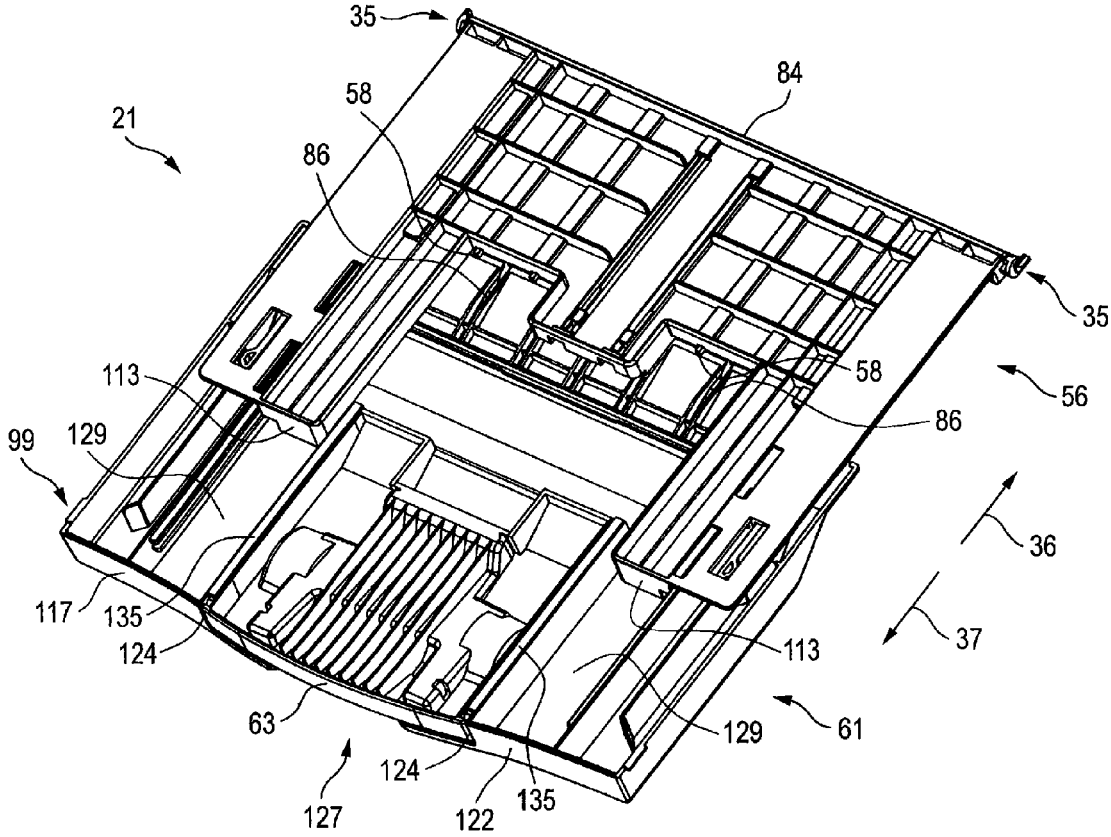
FIG. 12 is a perspective view showing the back side of the sheet discharge tray in the state shown in FIG. 11.
Figure 13:
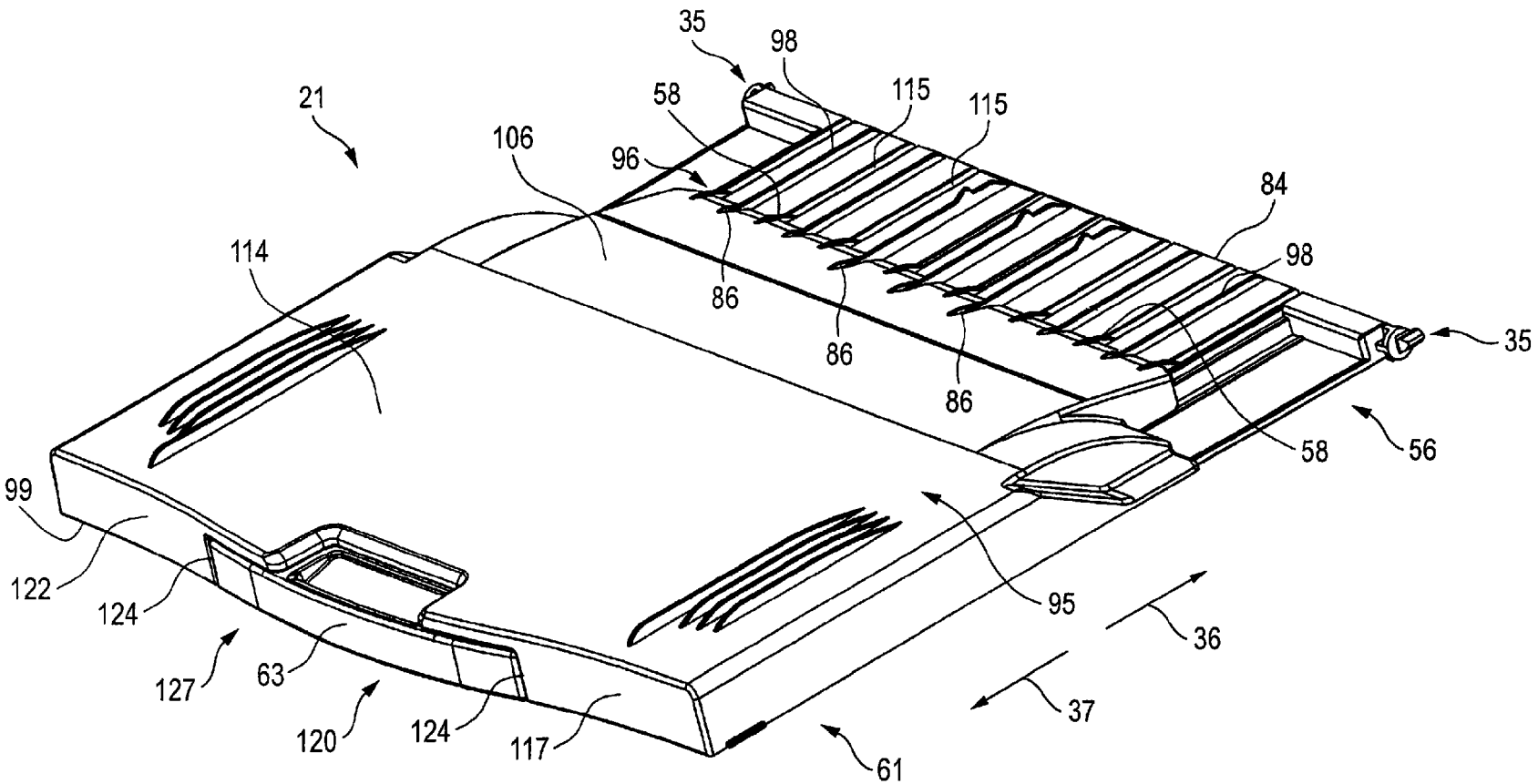
FIG. 13 is a perspective view showing the surface side of the sheet discharge tray, and shows a state where the extension tray is pushed in the first direction with respect to the tray body.
Figure 14:
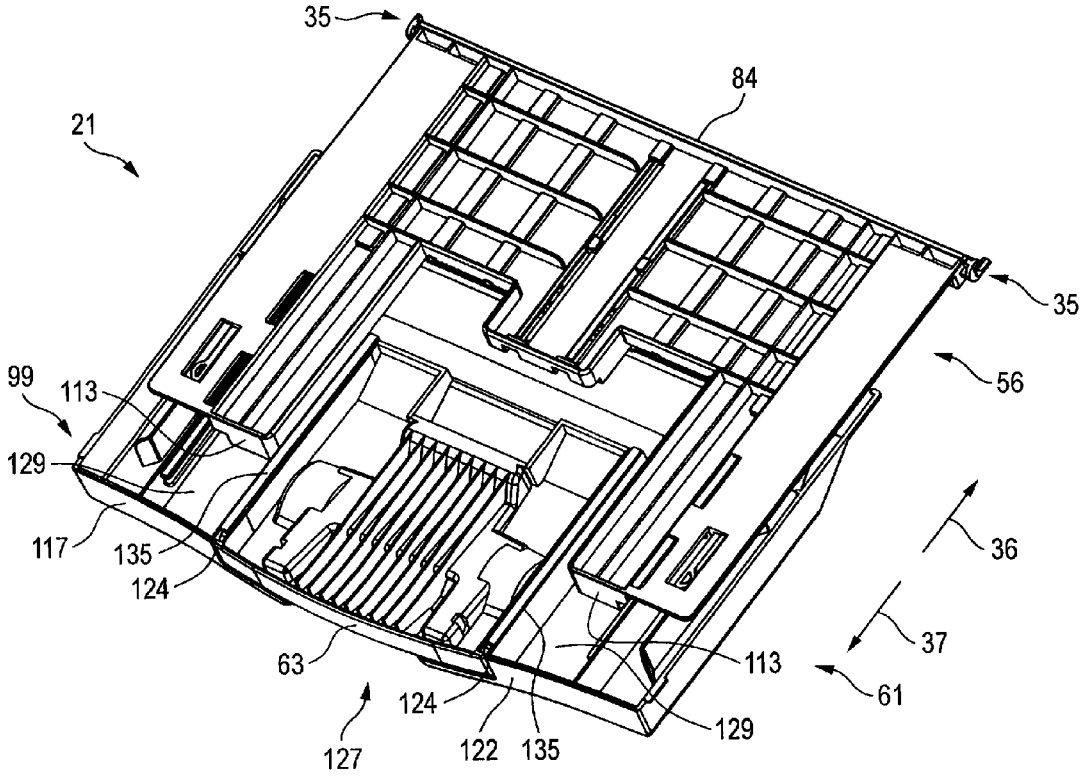
FIG. 14 is a perspective view showing the back side of the sheet discharge tray in the state shown in FIG. 13.

FIG. 11 is a perspective view showing the surface side of the sheet discharge tray 21, and shows a state where the extension tray 61 is pulled out in the second direction 37 with respect to the tray body 56. FIG. 12 is a perspective view showing the back side of the sheet discharge tray 21 in the state shown in FIG. 11. FIG. 13 is a perspective view showing the surface side of the sheet discharge tray 21, and shows a state where the extension tray 61 is pushed in the first direction 36 with respect to the tray body 56. FIG. 14 is a perspective view showing the back side of the sheet discharge tray 21 in the state shown in FIG. 13. FIGS. 11 to 14 show a state where the sheet discharge tray 21 is detached from the sheet feed tray 29.

The width of the tray body 56 and the extension tray 61 is set to be shorter than the distance between the side end guides 78. For this reason, as the tray body 56 is supported by the tray body 54, the sheet discharge tray 21 is disposed inside the sheet feed tray 29 in its width direction.

The tray body 56 is formed substantially in a concave shape in plan view (see FIGS. 12 and 14). As shown in FIGS. 11 to 14, rotating shafts 35 are provided in the tray body 56. The rotating shafts 35 are respectively provided at both ends of a front end 84 of the tray body 56 in its width direction (horizontal direction 74 in FIG. 6). As the rotating shafts 35 are inserted into the bearing holes 66 (see FIG. 7, etc.), respectively, the sheet discharge tray 21 is supported so as to be rotatable upward around an axis extending in the width direction of the sheet feed tray 29.

Figure 15:
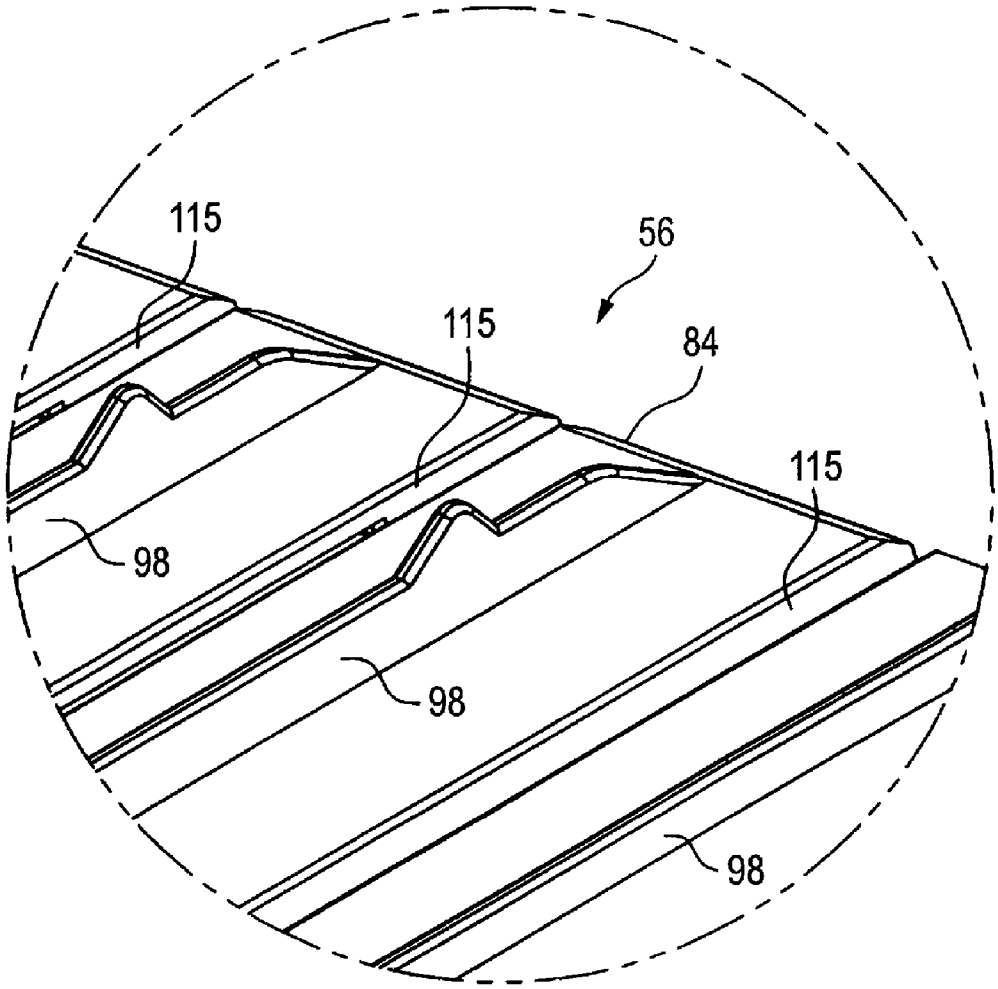
FIG. 15 is an enlarged view of a portion XV in FIG. 11.
Figure 16:
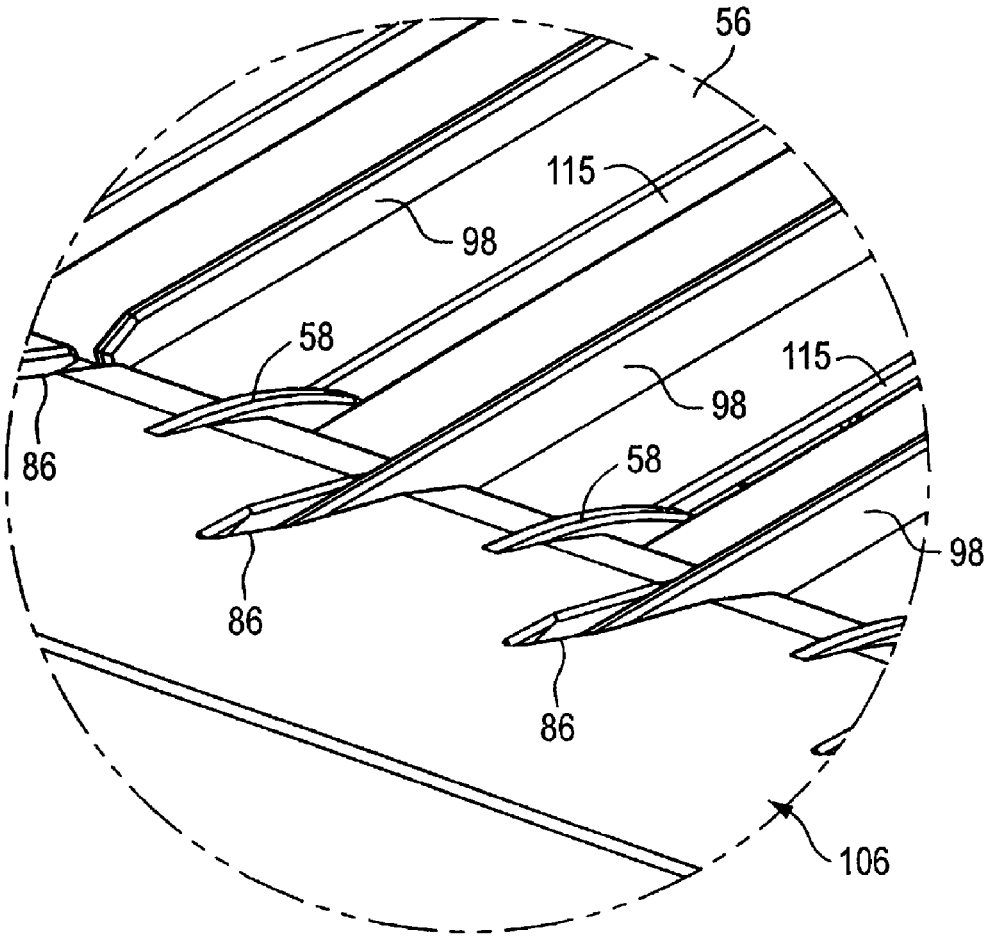
FIG. 16 is an enlarged view of a portion XVI in FIG. 11.

FIG. 15 is an enlarged view of a portion XV in FIG. 11. FIG. 16 is an enlarged view of a portion XVI in FIG. 11.

As shown in FIGS. 15 and 16, the top surface of the tray body 56 has guide grooves 115 with a U-shaped cross-section. The guide grooves 115 are formed so that the surface of the tray body 56 may be recessed toward the back thereof. The guide grooves 115 are provided over the whole region of the tray body 56 so as to extend in the first direction 36 and the second direction 37. As the protruding pieces 58 (see FIG. 12) of the extension tray 61 are inserted into the guide grooves 115, respectively, the sliding direction of the extension tray 61 is regulated to the first direction 36 and the second direction 37.

As shown in FIGS. 15 and 16, the top surface of the tray body 56 is provided with rails 98. The rails 98 are arranged alternately with the guide grooves 115 in the width direction of the tray body 56. The rails 98 are erected vertically from the surface of the tray body 56. The rails 98 are provided over the whole region of the tray body 56 so as to extend in the first direction 36 and the second direction 37. By inserting the rails 98 into guide grooves 86 (see FIG. 12) of the extension tray 61, the sliding direction of the extension tray 61 is regulated to the first direction 36 and the second direction 37.

As shown in FIGS. 11 to 14, the extension tray 61 is formed in a rectangular shape that is long in the width direction thereof. The extension tray 61 includes a flat portion 114 whose top surface is formed flat, and an inclined portion 106 that is inclined downward toward the first direction 36 with respect to the flat portion 114.

The flat portion 114 has an opening 120 (see FIGS. 11 and 23) provided at the rear end 122. The rear end 122 is the end of the extension tray 61 on the side of the opening 16 (see FIGS. 1 and 2). The opening 120 is provided from the center of a rear end surface 117 in its width direction to a top surface 95, at the rear end 122. As shown in FIGS. 12 and 14, an accommodating portion 127 that accommodates a sub-tray is provided at the back of the flat portion 114. The accommodating portion 127 has side walls 124 and supporting pieces 135 that extends in the first direction 36 and the second direction 37. The supporting pieces 135 protrude from lower ends of the side walls 124 to the center of the flat portion 114 in its width direction.

The sub-tray 63 is formed in a rectangular shape in which a length in the width direction (horizontal direction 74) and a length in the depth direction (first direction 36 and second direction 37) are approximately equal to each other. The sub-tray 63 is accommodated in the accommodating portion 127, and is supported from below by the supporting pieces 135. The sub-tray 63 is provided so as to be slidable in the second direction 37 with respect to the extension tray 61 from the state shown in FIG. 12. Although not shown, the sub-tray 63 protrudes from the rear end surface 117 by being pulled out in the second direction 37 from the extension tray 61. Thereby, a sheet placing surface in the extension tray 61 is extended toward the second direction 37.

As shown in FIG. 12 and FIG. 14, the back of the flat portion 114 is formed with recessed portions 129. The recessed portions 129 are formed in a rectangular shape that is long in the lateral direction of the tray body 114. Ends of the recessed portions 129 on the side of the second direction 37 are positioned at the rear end 122, and ends of the recessed portions on the side of the first direction 36 are opened. Convex portions 113 (see FIGS. 12 and 14) provided in the tray body 56 are accommodated in the recessed portions 129, respectively. Thereby, the extension tray 61 is supported from below by the tray body 56.

As shown in FIG. 12, the protruding pieces 58 inserted into the guide grooves 115 (see FIGS. 11 and 13) of the tray body 56 are provided at the back of a front end 96 (see FIG. 11 and FIG. 13) of the inclined portion 106. The protruding pieces 58 are formed so as to protrude downward from the back of the front end 96. The protruding pieces 58 are formed at the position to have the shape so that the protruding pieces 58 can be inserted into the guide grooves 115, respectively.

As shown in FIG. 12, the guide grooves 86 with an inverted U-shaped cross-section are formed on the side of the front end 96 in the back of the inclined portion 106. The rails 98 (see FIGS. 11 and 13) of the tray body 56 are inserted into the guide grooves 86, respectively. Accordingly, the guide grooves 86 are provided in positions corresponding to the rails 98. The protruding pieces 58 of the extension tray 61 are respectively inserted into the guide grooves 115 of the tray body 56, and the rails 98 of the tray body 56 are respectively inserted into the guide grooves 86 of the extension tray 61. This regulates the sliding direction of the extension tray 61 to the first direction 36 and the second direction 37.

Since the tray body 56 and the extension tray 61 are configured in this way, the extension tray 61 can slide in the first direction 36 and second direction 37 with respect to the tray body 56. That is, the rear end 122 in the extension tray 61 is configured so as to be slidable in the first direction 36 and second direction 37. As the extension tray 61 is pulled out toward the second direction 37 from a state (see FIGS. 13 and 14) where it is pushed into the tray body 56, the sheet placing surface of the sheet discharge tray 21 is extended. On the contrary, as the extension tray 61 is pushed in the first direction 36 with respect to the tray body 56 from a state (see FIGS. 11 and 12) where the extension tray is pulled out of the tray body 56, the sheet placing surface of the sheet feed tray 21 is retracted.

The rotating shafts 35 are supported by the bearing holes 66, which allows the tray body 56 to be rotatable up and down around an axis extending in the horizontal direction 74 (see FIG. 6). Since the extension tray 61 is provided in the tray body 56, the rear end 122 of the extension tray 61 is rotatable toward the sheet feed tray 29 around an axis extending in the horizontal direction 74, in a state of not being supported by the rear end 112.

For example, when start of reading of a document is instructed in the composite device 10, an image of the document is read by the scanning unit 12. The print unit 20 executes printing processing on the basis of the image of the document. This printing processing is performed as follows. That is, the driving force of the LF motor 85 (see FIG. 5) is selectively transmitted to the sheet feed roller 25, the conveying roller 67, and the sheet discharge roller 68. Thereby, a recording sheet accommodated in the sheet feed tray is conveyed along the conveying path 23. An image is recorded on the recording sheet by the image recording unit 24 during conveyance thereof, and then the recorded sheet is discharged to the space 40 (see FIG. 2) toward the opening 16.

Figure 17A:
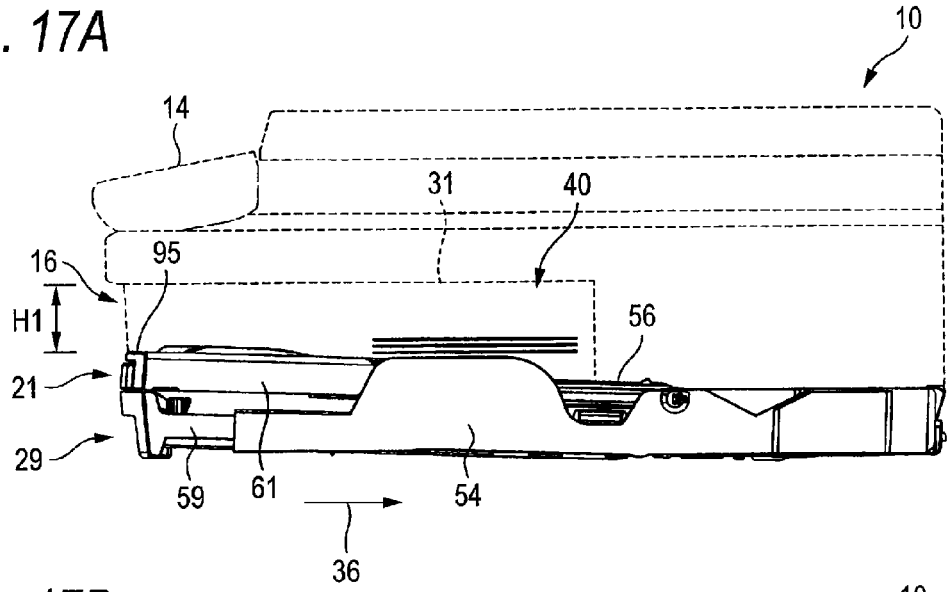
FIGS. 17A and 17B are side views of the sheet feed cassette, and specifically.
Figure 17B:
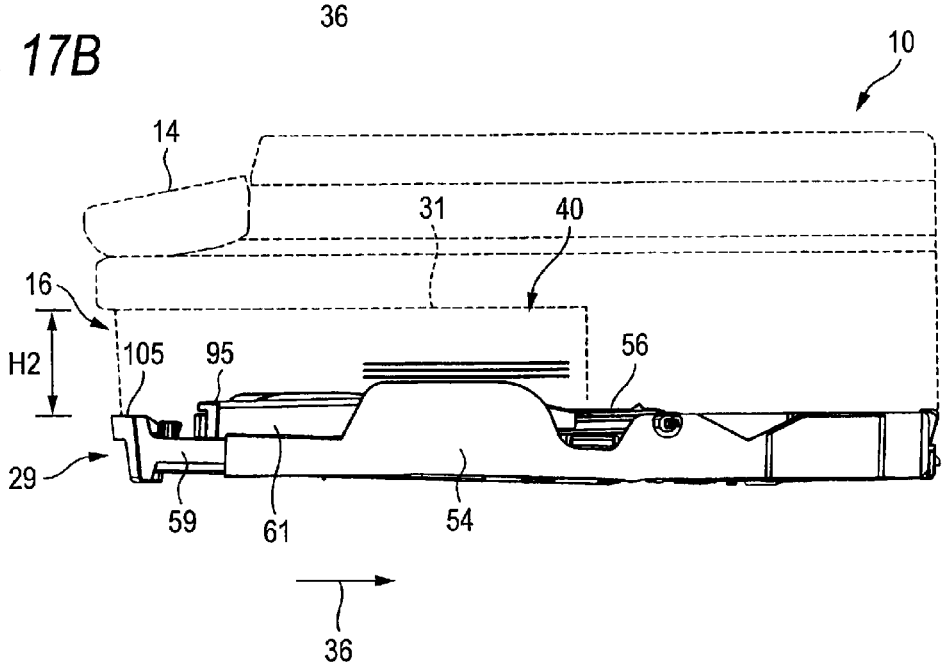

FIGS. 17A and 17B are side views of the sheet feed cassette 52, and specifically, FIG. 17A shows a state where the sheet discharge tray 21 takes a first posture, and FIG. 17B shows a state where the sheet discharge tray 21 takes a second posture. FIG. 18 is a perspective view showing the sheet feed cassette 52 in which the posture of the sheet discharge tray 21 is changed to the second posture. FIGS. 19A to 19D are schematic diagrams showing a state where the posture of the sheet discharge tray 21 is changed from the first posture to the second posture as the extension tray 61 is pushed in the first direction 36.

Since the tray body 56 and the extension tray 61 are configured as mentioned above, the posture of the sheet discharge tray 21 can be changed between the first posture and the second posture. The first posture is a state where the top surface 95 in the rear end 122 of the sheet discharge tray 21 is supported substantially horizontally (for example, see FIGS. 2, 6, 17A, and FIG. 19A). In the present embodiment, in the first posture, the extension tray 61 of the sheet discharge tray 21 is disposed above the top surface 105 (see FIG. 7) of the sheet feed tray 29. The sheet discharge tray 21 is maintained in the first posture as the rear end 122 is supported by the rear end 112. In detail, the sheet discharge tray 21 is maintained in the first posture as the rear end 122 is placed on the top surface 105 (see FIG. 7) of the rear end 112. In other words, the sheet discharge tray 21 is maintained in the first posture as a bottom surface 99 (for example, see FIG. 11) of the rear end 122 abuts on the top surface 105. That is, the first posture is a state where the movement of the rear end 122 toward the sheet feed tray 29 is regulated.

Figure 19A:
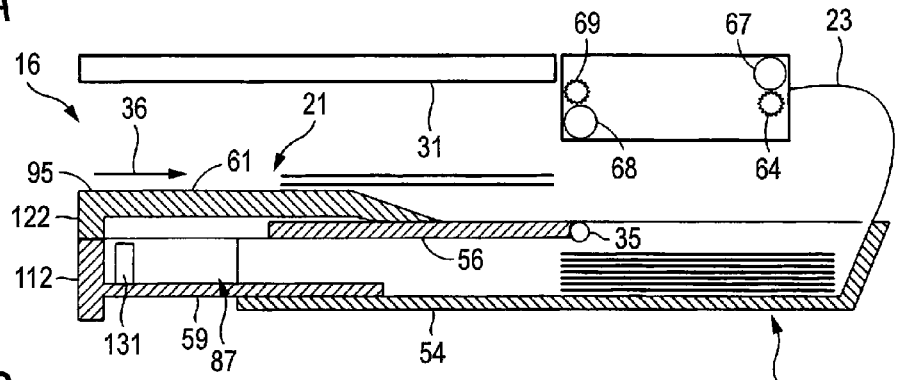
FIGS. 19A to 19D are schematic diagrams showing a state where the posture of the sheet discharge tray is changed from the first posture to the second posture as the extension tray 61 is pushed in the first direction.
Figure 19B:
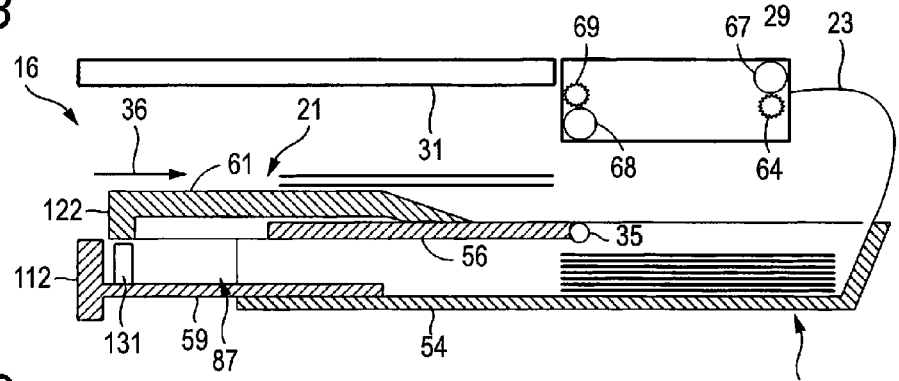
Figure 19C:
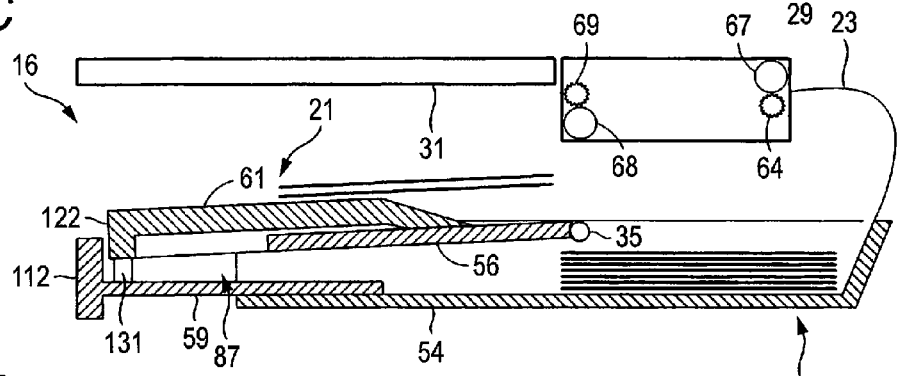
Figure 19D:
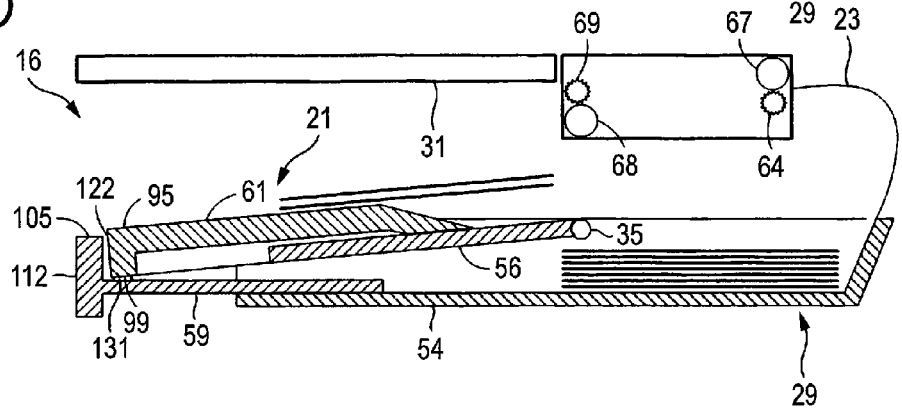

The second posture is a state where the top surface is moved toward the sheet feed tray 21 from the above-mentioned first posture (for example, see FIGS. 17B 18, and 19D). In the present embodiment, in the second posture, the bottom surface 99 of the rear end 122 is disposed below the top surface 105. The second posture will be described later in detail.

A recording sheet can be discharged onto the sheet discharge tray 21 in a state where the sheet discharge tray 21 is maintained in the first posture. For example, as shown in FIG. 6, in the first posture, the upper portion of the sheet feed tray 29 is covered with the sheet discharge tray 21. For this reason, dust, such as paper powder adhering to recording sheets accommodated in the sheet discharge tray 21 is prevented from entering the sheet feed tray 29.

In the composite device 10 according to the present embodiment, a recording sheet on which an image is recorded is discharged to the space 40 toward the opening 16 from the rear side (the right in each of FIGS. 17A to 17C) of the print unit 20. For this reason, in a case where a recording sheet (hereinafter referred to as a "small-size sheet") of a small size, such as postcards, is used for printing processing, the small-size sheet is placed on a position apart from the opening 16 on the sheet discharge tray 21 (see FIGS. 17A and 19A). In this case, as a user pushes in the extension tray 61 with respect to the opening 16, take-out of the small-size sheet from the sheet discharge tray 21 becomes easy.

As shown in FIGS. 17 to. 19, the extension tray 61 can be pushed in with respect to the opening 16. Since the tray body 56 is supported by the tray body 54, the extension tray 61 is slid in the first direction 36 with respect to the tray body 56 (see FIGS. 19A and 19B). As the rear end 122 is slid further toward the first direction 36 than the rear end 112 (i.e., as the extension tray 61 is slid in the first direction 36 so that the rear end 122 is positioned downstream the rear end 112 with respect to the first direction 36), the supporting of the rear end 122 by the rear end 112 is released. In a state where a small-size sheet is accommodated in the sheet feed tray 29, a space 87 (see FIG. 19) where the small-size sheet is not disposed is created on the side of the opening 16 in the sheet feed tray 29. Since the extension tray 61 is provided in the tray body 56, the extension tray is rotatable toward the sheet feed tray 29 around an axis extending in the horizontal direction 74 (see FIG. 6). As the supporting of the rear end 122 by the rear end 112 is released, the tray body 56 becomes rotatable toward the sheet feed tray 29, and the extension tray 61 rotates to the space 87 (see FIGS. 19B to 19D). As a result, the sheet discharge tray 21 takes the second posture in which the top surface 95 of the rear end 122 moves toward the sheet feed tray 29, and the bottom surface 99 thereof is disposed below the top surface 105 of the rear end 112 (see FIGS. 17B, 18, and 19D). As the extension tray 61 is relatively moved in the first direction 36 with respect to the extension tray 59 of the sheet feed tray 29 in this way, the posture of the sheet discharge tray 21 can be changed from the first posture to the second posture.

As the posture of the sheet discharge tray 21 is changed from the first posture to the second posture in the above-mentioned way, the space above the sheet discharge tray 21 in the opening 16 is extended downward. In other words, a space for allowing a user to put his/her hand thereinto in order to take out recording sheets discharged to the sheet discharge tray 21 is extended downward. As shown in FIGS. 17A and 17B, as the posture of the sheet discharge tray 21 is changed to the second posture, the height of a space in the opening 16 is changed from H1 (the height at a state where the sheet discharge tray 21 takes the first posture) to H2s. For this reason, a user is enabled to put his/her hand further into the deep side than the opening 16. As a result, even if a recording sheet discharged onto the sheet discharge tray 21 is a small-size sheet, the user can easily take out the recording sheet from the sheet discharge tray 21. Accordingly, a user does not suffer the disadvantage that it becomes difficult to take out recording sheets from the sheet discharge tray 21, and the composite device 10 in which the scanning unit 12 and the print unit 20 are provided at two upper and lower stages can be made thin by making the height (height of a cover 31) of the opening 16 low. The same is true in a case where the image recording apparatus according to this embodiment is a single-function printer.

(First Modification of the First Embodiment)

A coil spring 131 (an example of an urging member (see FIG. 19A)) may be provided in the extension tray 59. The coil spring 131 resiliently urges the sheet discharge tray 21 so as to change the posture of the sheet discharge tray from the second posture to the first posture. The coil spring 131 is provided outside the sheet placing surface at the end of the bottom 93 (see FIG. 7) on the side of the second direction 37. The coil spring 131 is not shown in FIG. 7, etc.

The extension tray 61 can be pushed down to the space 87 of the sheet feed tray 29 in order for a user to take out a small-size sheet from the sheet discharge tray 21 (see FIG. 19A to 19D). That is, the posture of the sheet discharge tray 21 is changed from the first posture to the second posture by an external force applied thereto. The coil spring 131 is contracted with descent of the extension tray 61, and accumulates a spring force that pushes up the sheet discharge tray 21. As a use releases his/her hand from the extension tray 61 to remove an external force, the extension tray 61 ascends by the spring force that is accumulated by the coil spring 131. As the external force is removed in this way, the sheet discharge tray 21 is returned to the first posture.

The installation spring of the coil spring is not limited to the bottom 93. The coil spring may be provided outside the sheet placing surface in the sheet discharge tray 21 so that its one end may be fixed to the cover 31 (see FIG. 2) of the print unit 20 and its other end may be fixed to the top surface 95 of the extension tray 61. Thereby, the sheet discharge tray 21 is maintained in the first posture in a state where the extension tray 61 is hung from the cover 31 by the coil spring. The coil spring is elongated when a user pushes down the extension tray 61. Thereby, the coil spring accumulates a spring force that pulls up the sheet discharge tray 21. As a user releases his/her hand from the extension tray 61, the coil spring is contracted, and the sheet discharge tray 21 is returned to the first posture by the spring force that is accumulated by the coil spring.

Further, torsion coil springs may be respectively provided in the shafts 35 (see FIG. 6) as the urging member. As a user pushes down the extension tray 61, the torsion coil springs are twisted to accumulate a spring force that rotate the sheet discharge tray 21 upward. As the user releases his/her hand from the extension tray 61, the sheet discharge tray 21 is returned to the first posture by the spring force that is accumulated by the torsion coil springs.

(Second Modification of the First Embodiment)

The posture of the sheet discharge tray 21 may be changed from the first posture to the second posture when a user pulls out the extension tray 61 toward the second direction 37.

FIGS. 20A to 20D are schematic diagrams showing a state where the posture of the sheet discharge tray 21 is changed from the first posture to the second posture as the extension tray 61 is pulled out in the second direction 37. In the following description based on FIGS. 20A to 20D, the width of the rear end 112 is assumed to be smaller than the width of the extension tray 61, and the space where the rear end 112 can be accommodated at the back (see FIG. 7) of the extension tray 61 is assumed to be provided.

In a state (for example, see FIGS. 1 and 6) where the sheet discharge tray 21 is maintained in the first posture, the extension tray 61 is pulled out with respect to the opening 16. Since the tray body 56 is supported by the tray body 54, the extension tray 61 is slid in the second direction 37 with respect to the tray body 56 (see FIGS. 20A to 20C). As the rear end 122 is slid further toward the second direction 37 than the rear end 112 (i.e., as the extension tray 61 is slid in the second direction 37 so that the rear end 122 is positioned downstream the rear end 112 with respect to the second direction 37), the supporting of the rear end 122 by the rear end 112 is released. As the supporting of the rear end 122 by the rear end 112 is released, the tray body 56 becomes rotatable toward the sheet feed tray 29, and the extension tray 61 rotates to the outside of the sheet feed tray 29 in the second direction 37 by the gravity that acts on the sheet discharge tray 21 (see FIGS. 20C and 20D). As a result, the sheet discharge tray 21 takes the second posture in which the top surface 95 of the rear end 122 moves toward the sheet feed tray 29, and the bottom surface 99 thereof is disposed below the top surface 105 of the rear end 112 (see FIG. 20D).

Figure 20A:
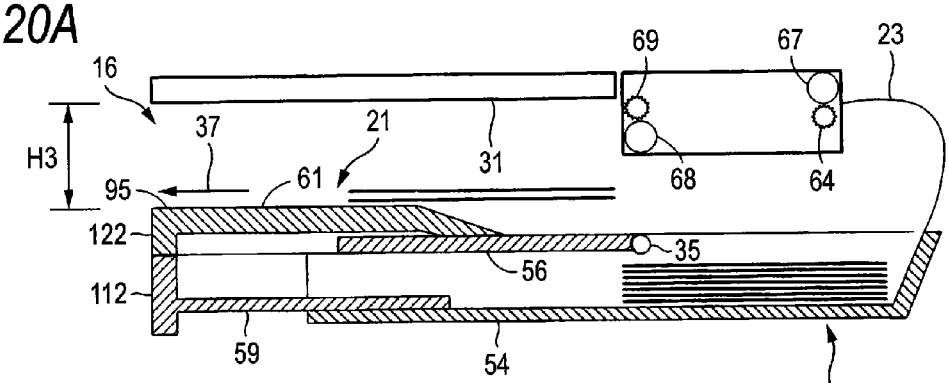
FIGS. 20A to 20D are schematic diagrams showing a state where the posture of the sheet discharge tray is changed from the first posture to the second posture as the extension tray is pulled out in the second direction.
Figure 20B:
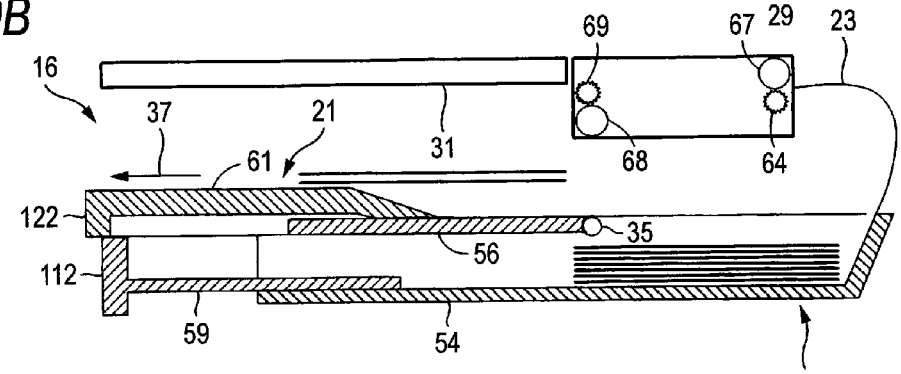
Figure 20C:
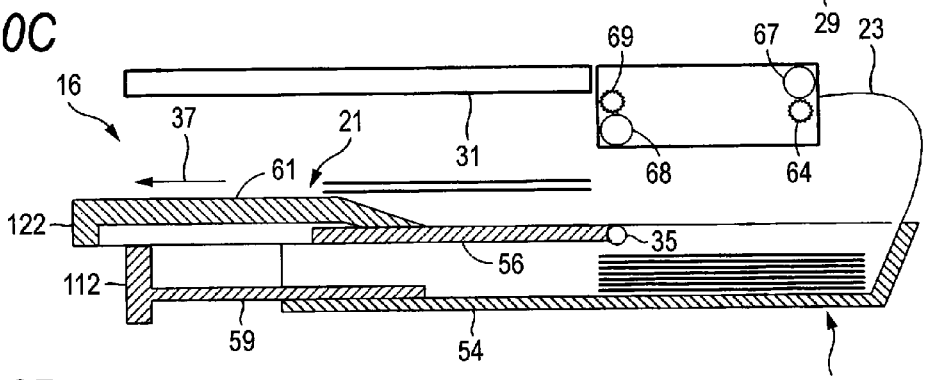
Figure 20D:
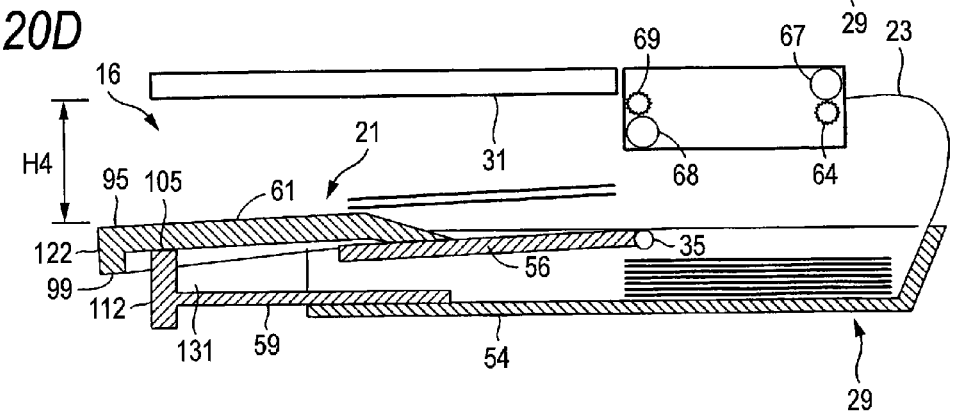

As the extension tray 61 is relatively moved in the first direction 36 with respect to the tray body 56 in this way, the posture of the sheet discharge tray 21 can be changed from the first posture to the second posture. As the posture of the sheet discharge tray 21 is changed from the first posture to the second posture, the space above the sheet discharge tray 21 in the opening 16 is extended downward. As shown in FIGS. 20A and 20D, as the posture of the sheet discharge tray 21 is changed to the second posture, the height of a space in the opening 16 is changed from H3 (the height at a state where the sheet discharge tray 21 takes the first posture) to H4. Thereby, a user can easily take out a small-size sheet from the sheet discharge tray 21.

(Third Modification of the First Embodiment)

The posture of the sheet discharge tray 21 may be changed from the first posture to the second posture as a user pulls out the extension tray 59 toward the second direction 37.

Figure 21A:
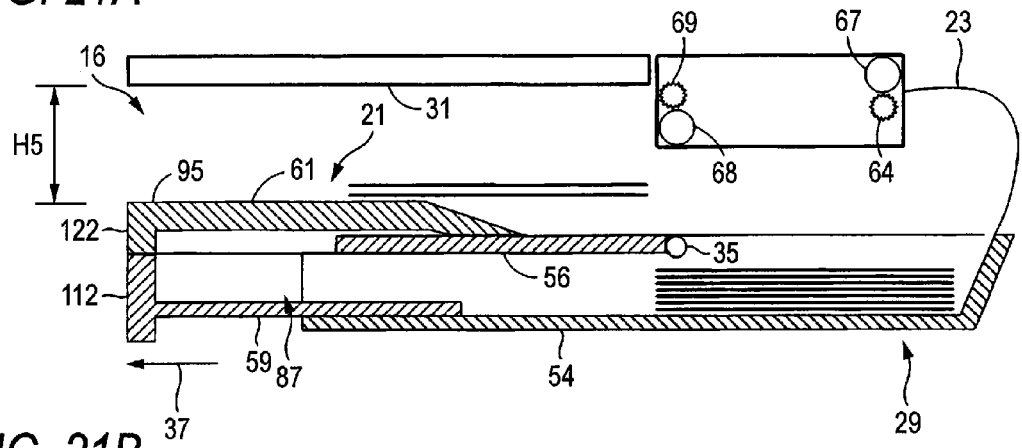
FIGS. 21A to 21C are schematic diagrams showing a state where the posture of the sheet discharge tray is changed from the first posture to the second posture as the extension tray is pulled out in the second direction.
Figure 21B:
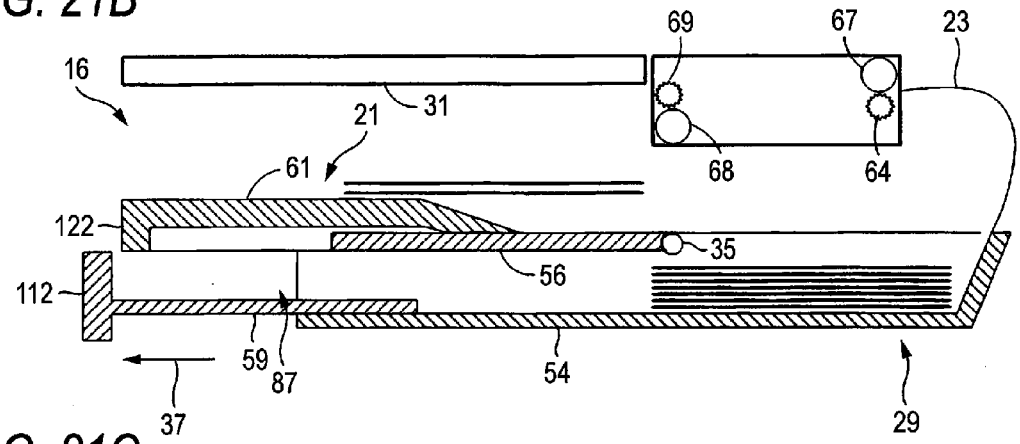
Figure 21C:
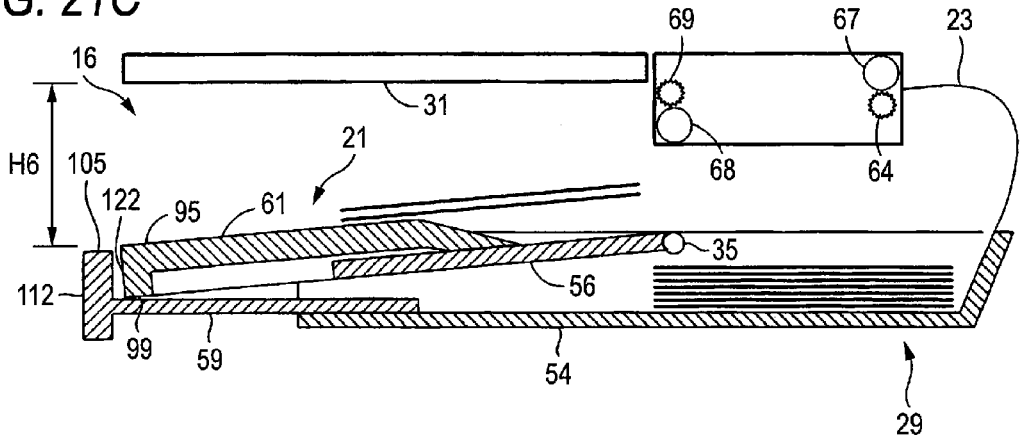

FIGS. 21A to 21C are schematic diagrams showing a state where the posture of the sheet discharge tray 21 is changed from the first posture to the second posture as the extension tray 59 is pulled out in the second direction 37.

In a state (for example, see FIGS. 1 and 6) where the sheet discharge tray 21 is maintained in the first posture, the extension tray 59 is pulled out with respect to the opening 16. Thereby, the extension tray 59 is slid in the second direction 37 with respect to the tray body 54 (see FIGS. 21A and 21B). As the rear end 112 is slid further toward the second direction 37 than the rear end 122 (i.e., as the extension tray 39 is slid in the second direction 37 so that the rear end 112 is positioned downstream the rear end 122 with respect to the second direction 37), the supporting of the rear end 122 by the rear end 122 is released (see FIG. 21B). As the supporting of the rear end 122 by the rear end 112 is released, the tray body 56 becomes rotatable toward the sheet feed tray 29, and the extension tray 61 rotates to the space 87 (see FIG. 21) in the sheet feed tray 29 (see FIGS. 21B and 21C). As a result, the sheet discharge tray 21 takes the second posture in which the top surface 95 of the rear end 122 moves toward the sheet feed tray 29, and the bottom surface 99 thereof is disposed below the top surface 105 of the rear end 112 (see FIG. 21C).

As the extension tray 59 is relatively moved in the second direction 37 with respect to the tray body 54 in this way, the posture of the sheet discharge tray 21 can be changed from the first posture to the second posture. The space above the sheet discharge tray 21 in the opening 16 is extended downward by this posture change. As shown in FIGS. 21A and 21C, as the posture of the sheet discharge tray 21 is changed to the second posture, the height of a space in the opening 16 is changed from H5 (the height at a state where the sheet discharge tray 21 takes the first posture) to H6. This allows a user to easily take out a small-size sheet from the sheet discharge tray 21.

(Fourth Modification of the First Embodiment)

The posture of the sheet discharge tray 21 may be changed from the first posture to the second posture as a user pushes in the extension tray 59 toward the first direction 36.

Figure 22A:
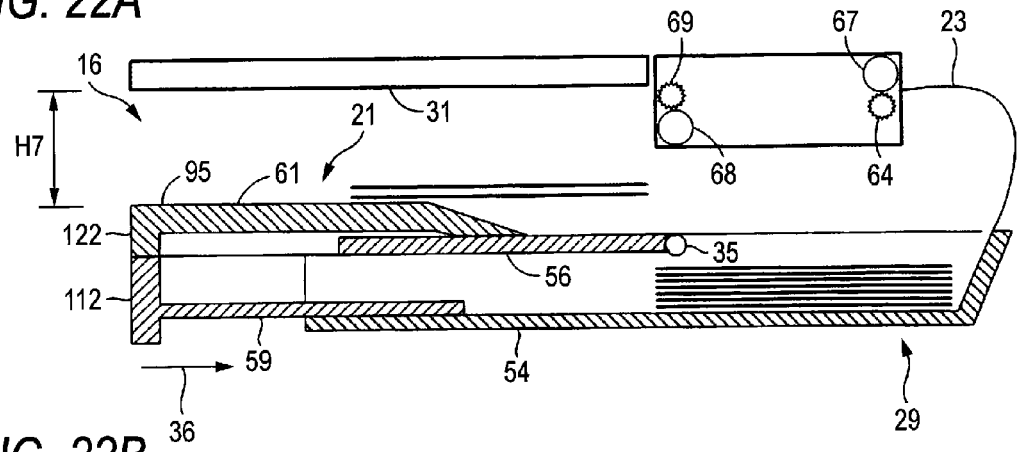
FIGS. 22A to 22C are schematic diagrams showing a state where the posture of the sheet discharge tray is changed from the first posture to the second posture as the extension tray is pushed in the first direction.
Figure 22B:
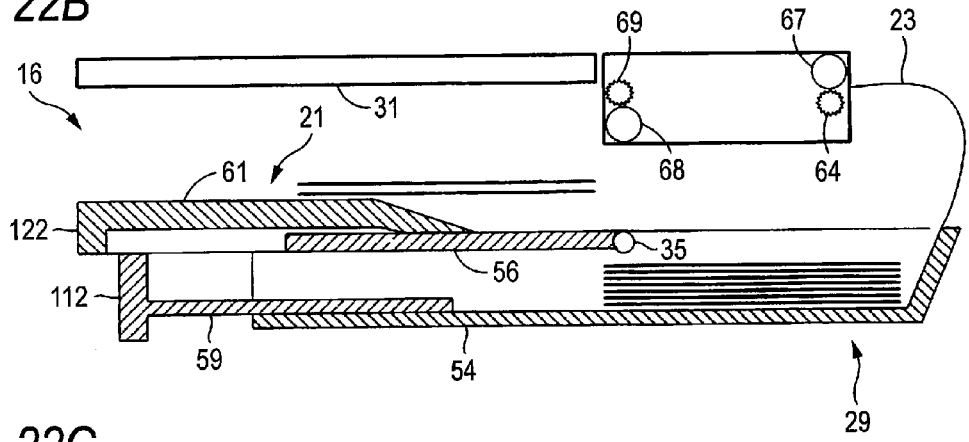
Figure 22C:
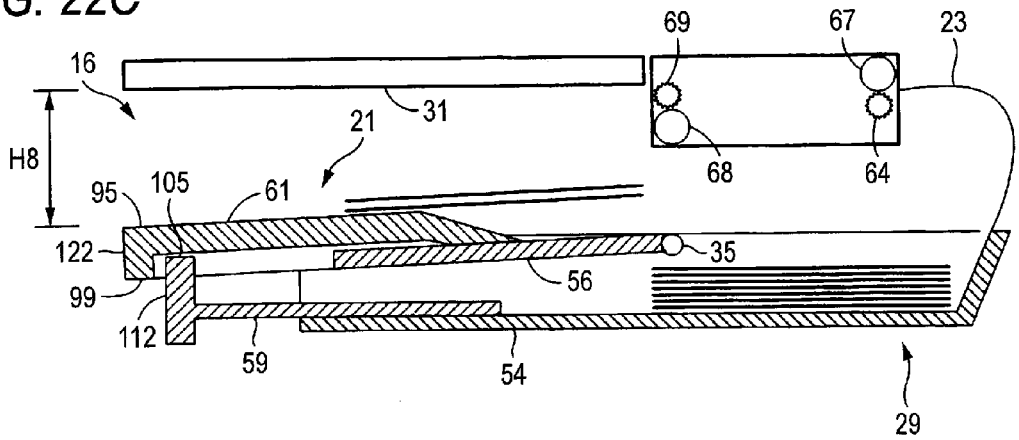

FIGS. 22A to 22C are schematic diagrams showing a state where the posture of the sheet discharge tray 21 is changed from the first posture to the second posture as the extension tray 59 is pushed in the first direction 36. In the following description based on FIGS. 22A to 22D, the width of the rear end 112 is assumed to be smaller than the width of the extension tray 61, and the shape where the rear end 112 can be accommodated at the back (see FIG. 7) of the extension tray 61 is assumed to be provided.

In a state (for example, see FIGS. 1 and 6) where the sheet discharge tray 21 is maintained in the first posture, the extension tray 59 is pushed in with respect to the opening 16. Since the small-size sheet is accommodated in the sheet feed tray 29, the push-in of the extension tray 59 is allowed. By the push-in of the extension tray 59, the extension tray 59 is slid in the first direction 36 with respect to the tray body 54 (see FIGS. 22A and 22B). As the rear end 112 is slid further toward the first direction 36 than the rear end 122 (i.e., as the extension tray 59 is slid in the first direction 36 so that the rear end 112 is positioned downstream the rear end 122 with respect to the first direction 36), the supporting of the rear end 122 by the rear end 122 is released. As the supporting of the rear end 122 by the rear end 112 is released, the tray body 56 becomes rotatable toward the sheet feed tray 29, and the extension tray 61 rotates to the outside of the sheet feed tray 29 in the second direction 37 (the left in each of FIGS. 22A to 22C) by the gravity that acts on the sheet discharge tray 21 (see FIGS. 22C and 22D). As a result, the sheet discharge tray 21 takes the second posture in which the top surface 95 of the rear end 122 moves toward the sheet feed tray 29, and the bottom surface 99 thereof is disposed below the top surface 105 of the rear end 112 (see FIG. 22C).

As the extension tray 59 is relatively moved in the first direction 36 with respect to the tray body 54 in this way, the posture of the sheet discharge tray 21 can be changed from the first posture to the second posture. The space above the sheet discharge tray 21 in the opening 16 is extended downward by this posture change. As shown in FIGS. 22A and 22C, as the posture of the sheet discharge tray 21 is changed to the second posture, the height of a space in the opening 16 is changed from H7 (the height at a state where the sheet discharge tray 21 takes the first posture) to H8. This allows a user to easily take out a small-size sheet from the sheet discharge tray 21.

(Second Embodiment)

Hereinafter, a second embodiment of the invention will be described. The composite device 10 according to the second embodiment has the same configuration as the first embodiment except that the configuration of the sheet discharge tray 21 is different partially. For this reason, description of configurations other than the sheet discharge tray 21 is omitted.

Figure 23:
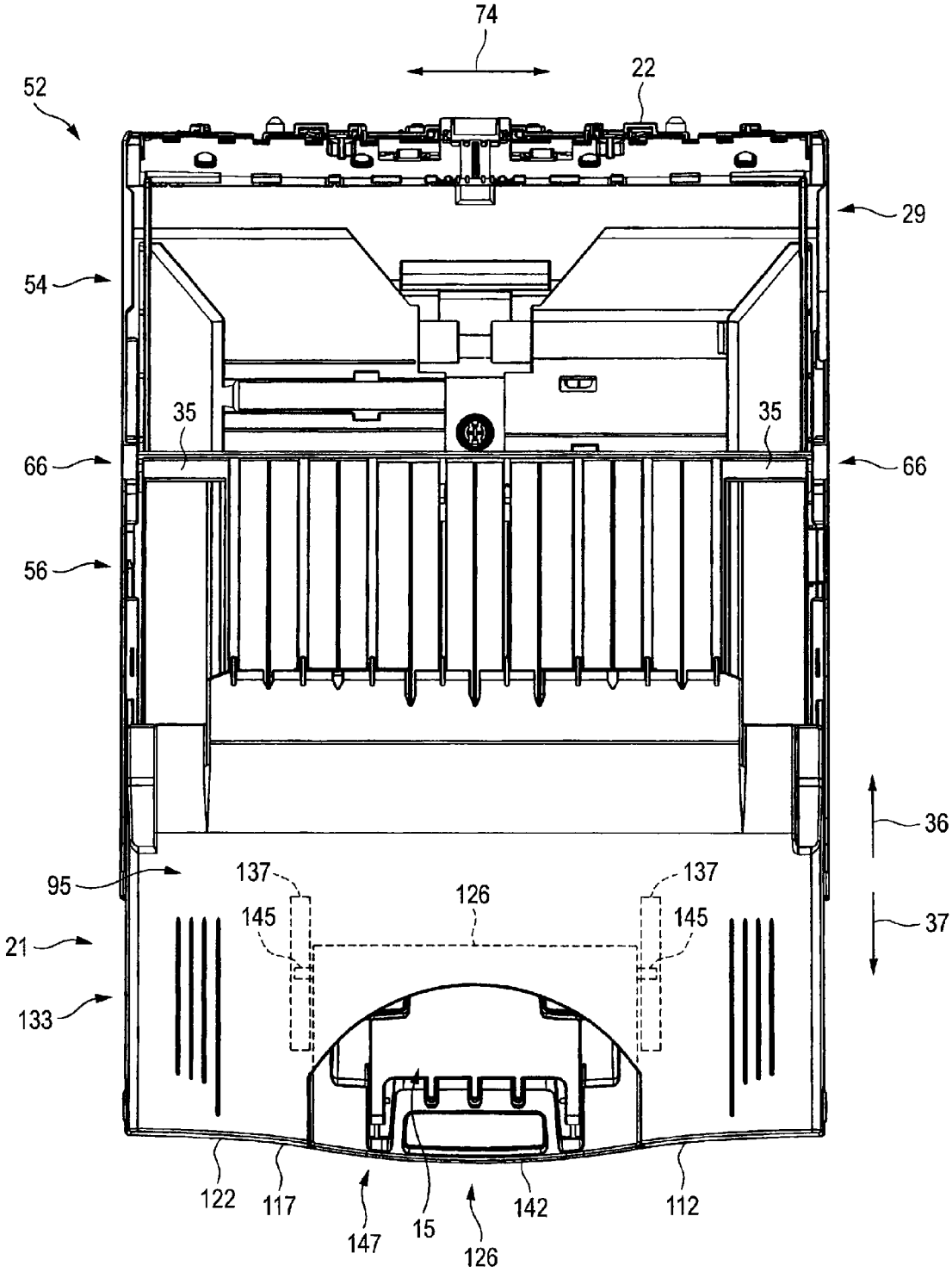
FIG. 23 is a plan view of the sheet feed cassette in a second embodiment of the invention.

FIG. 23 is a plan view of the sheet feed cassette 52 in a second embodiment of the invention.

In the present embodiment, the sheet discharge tray 21 has the tray body 56 (a portion of the second tray body), an extension tray 133 (a portion of the second tray body), and a sub-tray 126.

As for the extension tray 133, an opening 147 (an example of a cutout portion) is formed by cutting out the portion of the extension tray on the side of the opening 16 (lower side in FIG. 23) toward the first direction 36 (deep side of the print unit 20). The opening 147 is formed ranging from the rear end surface 117 to the top surface 95, similarly to the opening 120 (see FIG. 11). The opening 147 is formed by cutting out the rear end surface 117 and the top surface 95 in a larger range than the opening 120 (see FIGS. 6 and 23). The opening 147 is formed according to the size of a user's hand so that the user can put his/her hand into the space 87 through the opening 147.

The sub-trays 126 has almost the same shape as the sub-tray 63 (see FIGS. 6 and 12), and is formed so as to be larger than the sub-tray 63 in conformity with the opening 147. As the sub-tray 126 is disposed in the opening 147 of the extension tray 133, the opening 147 is closed. Rotating shafts 145 that protrude to the outside of the sub-tray 126 in its width direction are provided at the end of the sub-tray 126 on the side of the first direction 36.

As shown in FIG. 23, guide grooves 137 are provided on both sides of an accommodating portion, which accommodates the sub-tray 126, in its width direction, at the back of the extension tray 133. The guide grooves 137 support the rotating shafts 145 of the sub-tray 126, and have a U-shaped cross-section. The guide grooves 137 are formed so as to extend in the first direction 36 and the second direction 37 in positions corresponding to the rotating shafts 145 of the sub-tray 126. As the rotating shafts 145 are supported by the guide grooves 137, the sub-tray 126 is provided in the extension tray 133 so as to be slidable in the first direction 36 and second direction 37 and so as to be rotatable toward the sheet feed tray 29.

FIGS. 24A to 24D are schematic diagrams showing a state where the posture of the sheet discharge tray 21 is changed from the first posture to the second posture as the sub-tray 126 is pushed in the first direction 36.

Figure 24A:
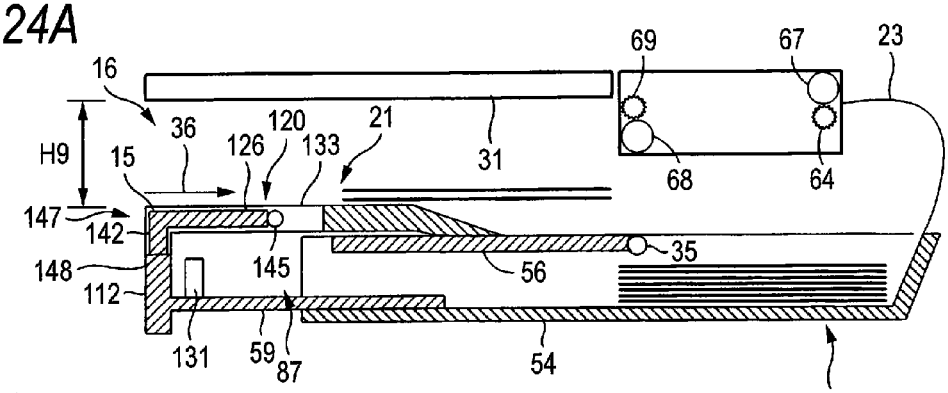
FIGS. 24A to 24D are schematic diagrams showing a state where the posture of the sheet discharge tray is changed from the first posture to the second posture as the sub-tray 126 is pushed in the first direction.
Figure 24B:
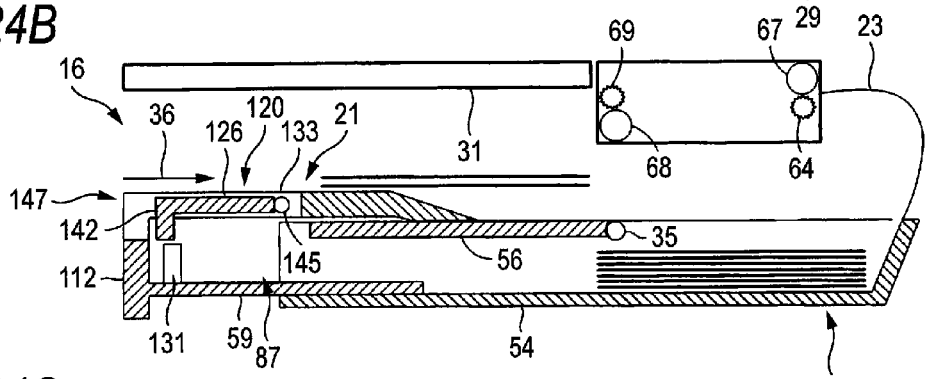
Figure 24C:
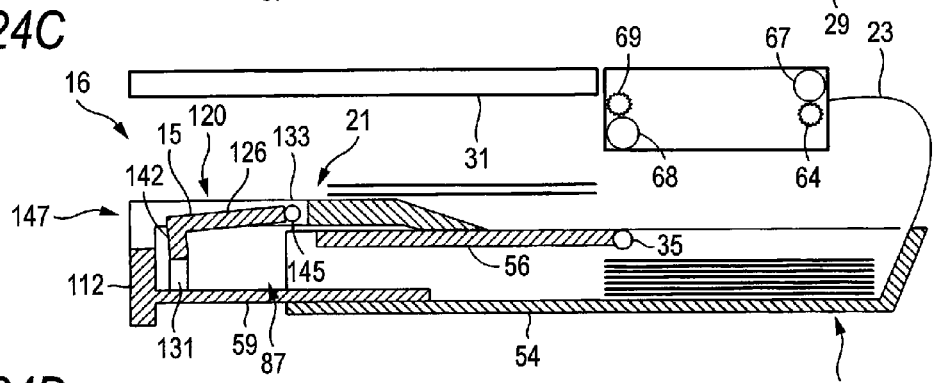

Here, the sheet discharge tray 21 is maintained in the first posture as the rear end 122 (see FIG. 7) of the extension tray 133 and a rear end 142 of the sub-tray 126 are supported by the rear end 112 (see FIGS. 23 and 24A). The sheet discharge tray 21 is maintained in the first posture as a bottom surface 148 of the rear end 142 abuts on the top surface 105. In this first posture, a top surface 15 of the sub-tray 126 is supported substantially horizontally (see FIG. 24A). The sub-tray 126 is pushed in from this state by a user. Thereby, the sub-tray 126 is slid in the first direction 36 with respect to the extension tray 133 (see FIGS. 24A and 24B). As the rear end 142 is slid further toward the first direction 36 than the rear end 112 (i.e., as the sub-tray 126 is slid in the first direction 36 so that the rear end 142 is positioned downstream the rear end 112 with respect to the second direction 37), the supporting of the rear end 112 by the rear end 142 is released (see FIG. 24B). As the supporting of the rear end 142 by the rear end 112 is released, the sub-tray 126 becomes rotatable toward the sheet feed tray 29, and the sub-tray 126 rotates to the space 87 in the sheet feed tray 29 (see FIGS. 24B to 24D). As a result, the sheet discharge tray 21 takes the second posture in which the top surface 15 of the rear end 142 moves toward the sheet feed tray 29, and the bottom surface 148 thereof is disposed below the top surface 105 of the rear end 112 (see FIG. 24D).

Figure 24D:
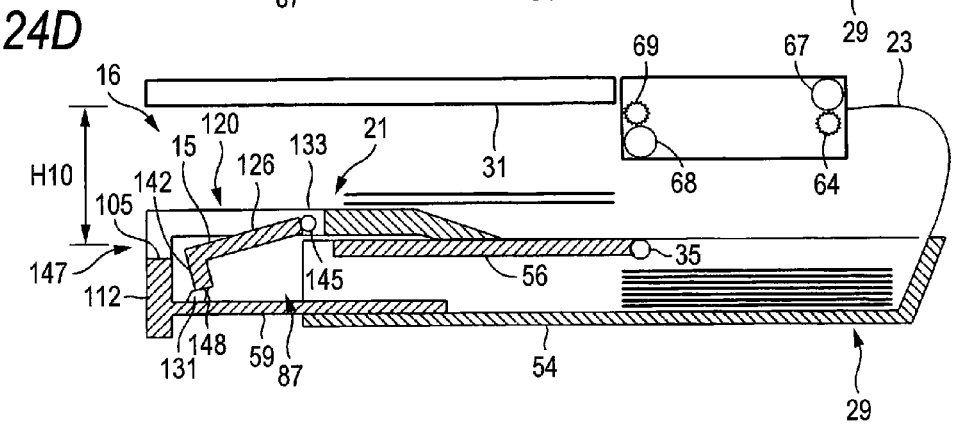

As the sub-tray 126 is relatively moved in the first direction 36 with respect to the extension tray 133 in this way, the posture of the sheet discharge tray 21 can be changed from the first posture to the second posture. The space above the sheet discharge tray 21 in the opening 16 is extended to below the opening 147 by this posture change. As shown in FIGS. 24A and 24D, as the posture of the sheet discharge tray 21 is changed to the second posture, the height of a space in the opening 16 is changed from H9 (the height at a state where the sheet discharge tray 21 takes the first posture) to H10. Thereby, a space for allowing a user to put his/her hand thereinto in order to take out recording sheets from the sheet discharge tray 21 is extended downward, so that the user can easily take out the small-size sheets from the sheet discharge tray 21.

Although the aspect in which the tray body 56 and the extension tray 133 are configured as separate members is described in the present embodiment, the tray body and extension tray may be formed integrally to form the second tray body.

In the present embodiment, center registration is adopted in the reference position of a recording sheet in the sheet feed tray 29. Thus, the recording sheet is discharged onto the sheet discharge tray 21 with the central position of the sheet discharge tray 21 in its width direction as a reference. In the case of the side registration that an end of a recording sheet in its width direction is made to coincide with an end of the sheet feed tray 29 in its width direction, the recording sheet is discharged onto the sheet discharge tray 21 with an end of the sheet discharge tray 21 in its width direction as a reference. In this case, it is preferable to change the position of the opening 147 to the end of the extension tray 133 in its width direction according to the reference position of the recording sheet discharged onto the sheet discharge tray 21.

In the first and second embodiments of the invention, the aspect in which the posture of the sheet discharge tray 21 is changed from the first posture to the second posture as the extension tray 61 or sub-tray 126 is relatively displaced in the first direction 36 or second direction 37 has been described. However, the sheet discharge tray 21 may be configured to be capable of changing in posture from the first posture to the second posture without relative movement of its constituent members.

(Third Embodiment)

Hereinafter, a third embodiment of the invention will be described. The composite device 10 according to the third embodiment has the same configuration as the first embodiment except that the configuration of the sheet discharge tray 21 is different partially. For this reason, description of configurations other than the sheet discharge tray 21 is omitted.

Figure 25A:
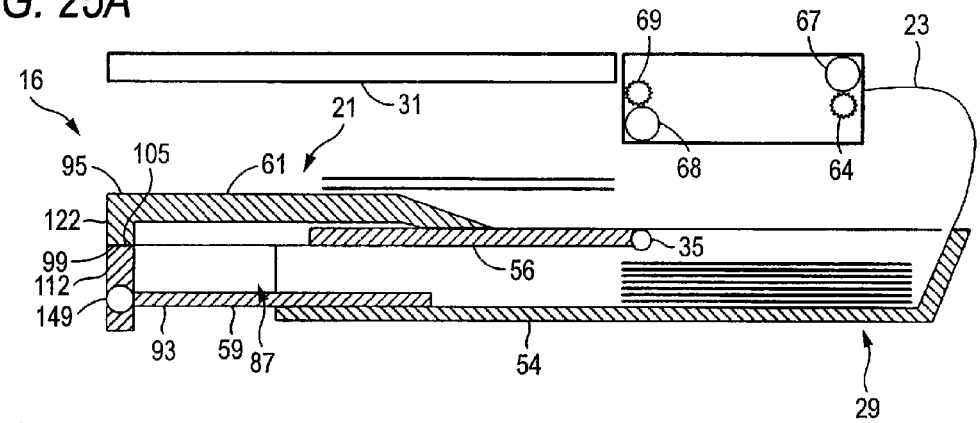
FIGS. 25A to 25C are schematic diagrams showing a state where the posture of the sheet discharge tray is changed from the first posture to the second posture as a rear end 112 is rotated with respect to a bottom.
Figure 25B:
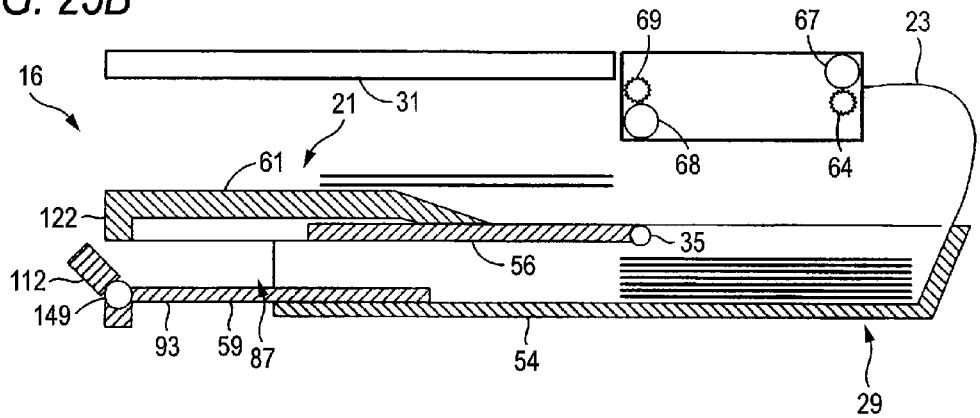
Figure 25C:
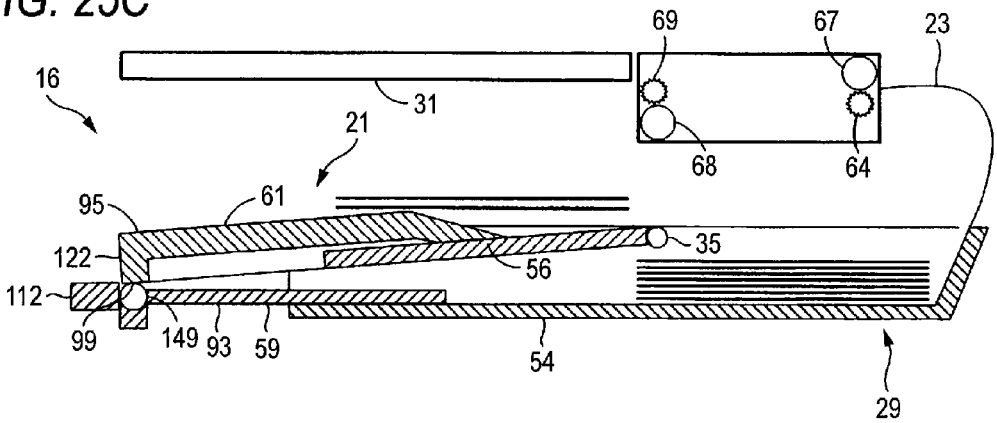

FIGS. 25A to 25C are schematic diagrams showing a state where the posture of the sheet discharge tray 21 is changed from the first posture to the second posture as the rear end 112 is rotated with respect to the bottom 93.

As shown in FIG. 25, the rear end 112 of the extension tray 59 may be configured so as to be rotatable outward via a hinge 149. In a state (see FIG. 25A) where the sheet discharge tray 21 is maintained in the first posture, the rear end 112 is rotated toward the opening 16 (the left in each of FIGS. 25A to 25C). As the rear end 112 is rotated, the supporting of the rear end 122 by the rear end 112 is released (see FIG. 25B). As the supporting of the rear end 122 by the rear end 112 is released, the tray body 56 becomes rotatable toward the sheet feed tray 29, and the rear end 122 rotates onto the sheet feed tray 29 by the gravity that acts on the sheet discharge tray 21 (see FIGS. 25B and 25C). As a result, the sheet discharge tray 21 takes the second posture in which the top surface 95 of the rear end 122 moves toward the sheet feed tray 29, and the bottom surface 99 thereof is disposed below the top surface 105 (see FIG. 25A) of the rear end 112 (see FIGS. 25A and 25C). As the posture of the sheet discharge tray 21 is changed from the first posture to the second posture in this way, the space above the sheet discharge tray 21 in the opening 16 is extended downward.

Although the aspect in which the sheet discharge tray 21 is provided in the sheet feed tray 29 as a lid of the sheet feed tray 29 has been described in the above embodiment, the sheet discharge tray 21 may be provided in the print unit 20 (for example, the cover 31) instead of the sheet feed tray 29.

Further, although the aspect in which the sheet discharge tray 21 is rotated toward the sheet feed tray 29, and the posture thereof is changed from the first posture to the second posture has been described in the above embodiment, the sheet discharge tray 21 may be configured so as to descend toward the sheet feed tray 29, with its horizontal posture maintained. In other words, the sheet discharge tray 21 may be configured so that, for example, the extension tray 61 and the tray body 59 can be integrally moved toward the sheet feed tray 29. That is, the posture change of the sheet discharge tray 21 from the first posture to the second posture is not limited to the rotation of the sheet discharge tray 21, and may be the sliding of the sheet discharge tray 21 toward the sheet feed tray 29.

Further, although the aspect in which the tray body 56 is rotated toward the sheet feed tray 29, and thereby, the posture of the sheet discharge tray 21 is changed from the first posture to the second posture has been described in the above embodiment, the tray body 56 and the extension tray 61 may be provided separately, and the extension tray 61 may be configured so as to descend toward the sheet feed tray 29, with its horizontal posture maintained.

(Fourth Embodiment)

The configuration and operation of a composite device 200 according to a fourth embodiment of an image recording apparatus will be described.

<Schematic Configuration of Composite Device 200>

Figure 26:
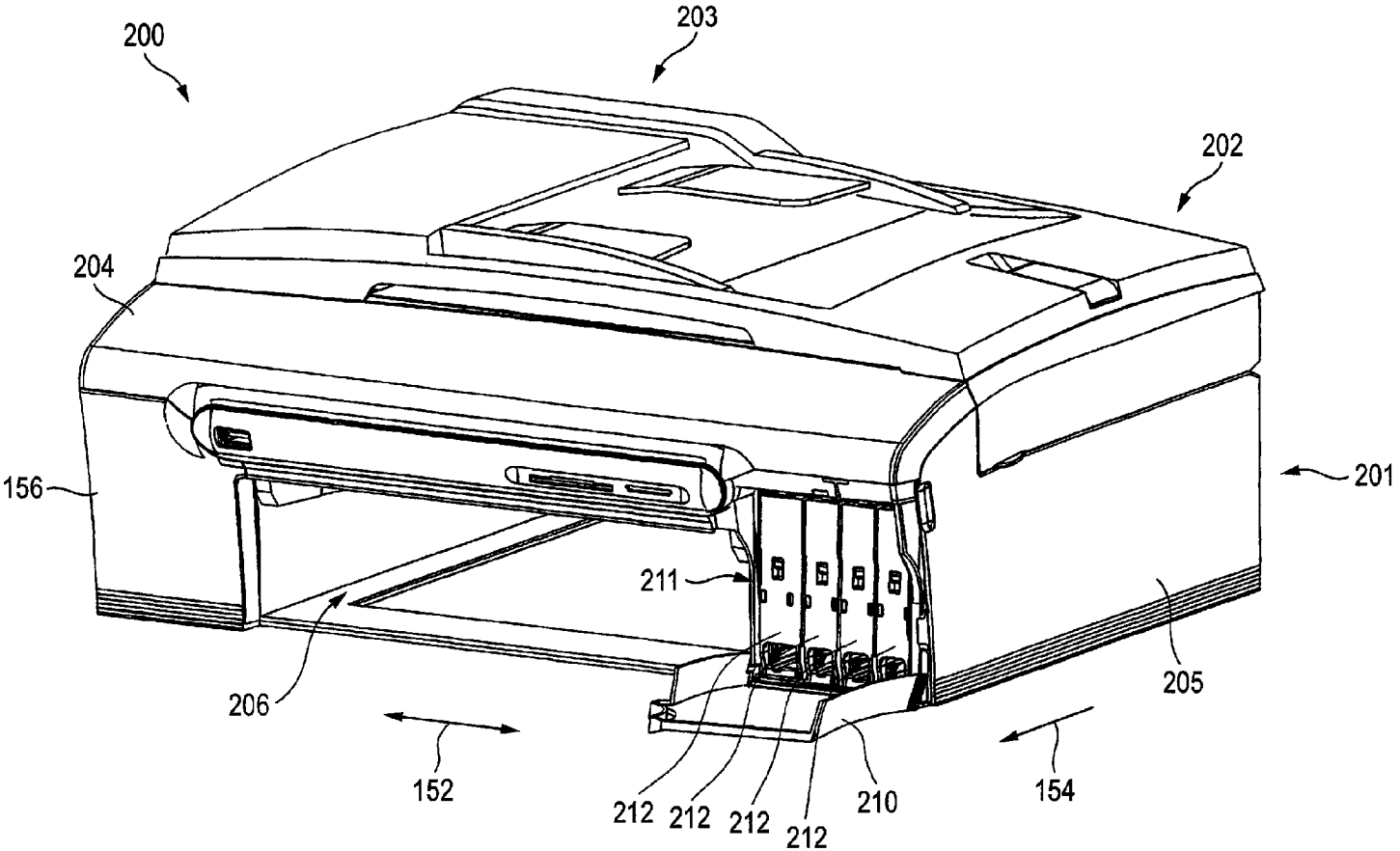
FIG. 26 is an appearance perspective view of a composite device according to fourth embodiment of the invention.
Figure 27:
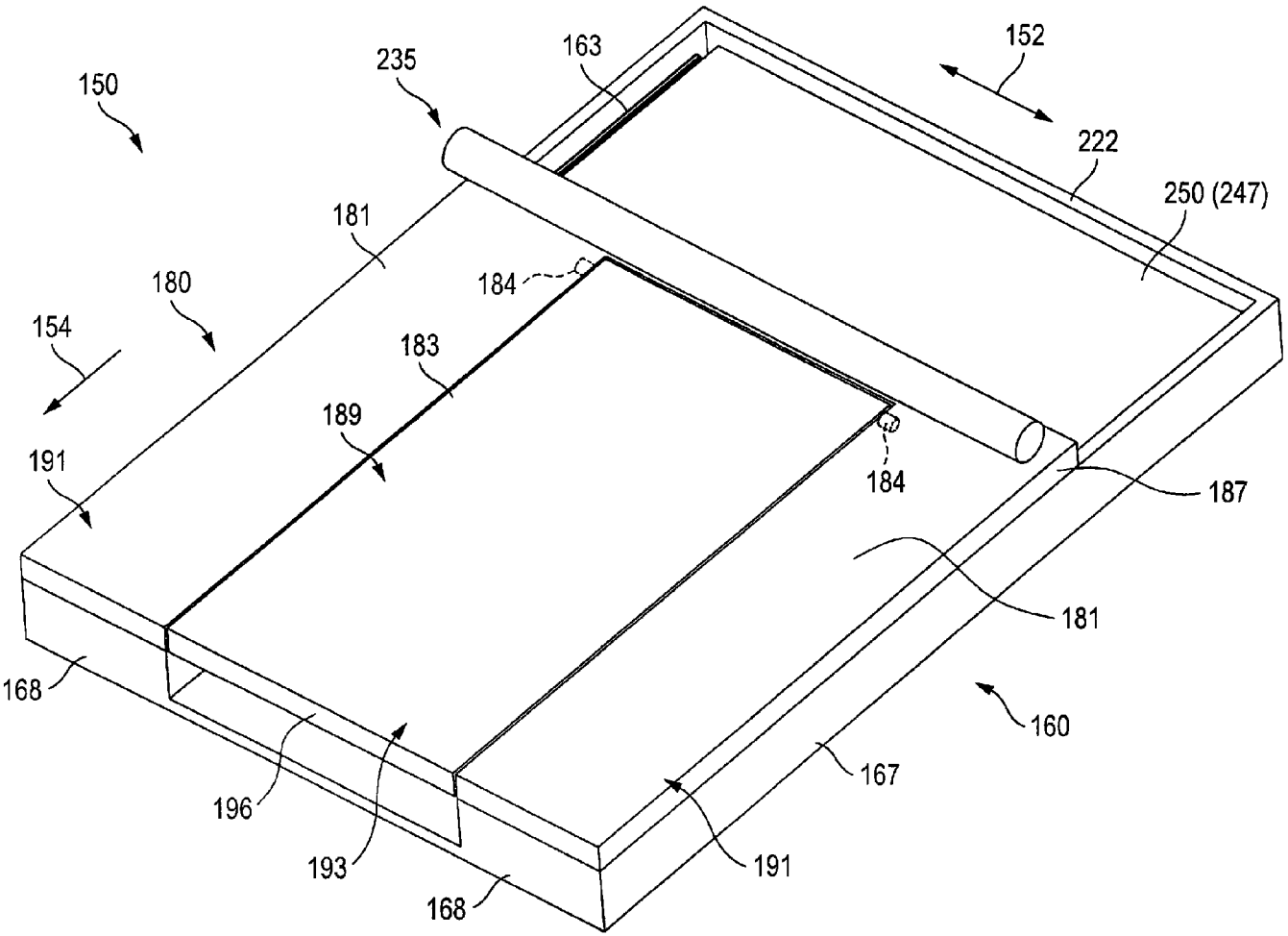
FIG. 27 is a schematic perspective view showing the external configuration of a sheet feed cassette, and shows a state where large-size sheets are accommodated in a sheet feed tray as a recording sheets.

FIG. 26 is an appearance perspective view of the composite device 200 according to the fourth embodiment. FIG. 27 is a schematic perspective view showing the external configuration of a sheet feed cassette 150, and shows a state where large-size sheets 250 are accommodated in a sheet feed tray 160 as a recording sheet 247.

As shown in FIG. 26, the composite device 200 is a multi function device (MFD) including a print unit 201 and a scanning unit 202, and has a printer function, a scanner function, a copying function, and a facsimile function. The image recording apparatus according to the invention is exemplified as the print unit 201 of the composite device 200. Accordingly, functions other than the print function are arbitrary.

The composite device 200 is connected with, mainly, an external information apparatus (not shown), such as a computer. The composite device 200 can receive print data including image data, document data, etc. transmitted from the external information apparatus. The composite device 200 can record an image on a recording sheet 247 (an example of a recording medium (see to FIG. 28)) on the basis of the print data. Further, the composite device 200 can record an image on a recording sheet 247 on the basis of the image data of a document read by the scanning unit 202. Further, the composite device 200 is connectable with a digital camera etc. to record an image on a recording sheet 247 on the basis of image data output from a digital camera, etc. Further, the composite device 200 allows various storage media, such as a memory card, to be loaded therein so that an image can be recorded on a recording sheet 247 on the basis of the image data stored in the storage media.

As shown in FIG. 26, the composite device 200 is formed in the shape of a wide, thin, and substantially rectangular parallelepiped that is larger in horizontal width and depth than height. The print unit 201 has an opening 206 at a front 156 of the main body 205. The opening 206 allows a user to take out a recording sheet 247 on which an image has been recorded which is discharged into the opening 206 within the body. The sheet feed cassette 150 (see FIG. 27) that accommodates the recording sheet 247 is disposed within the opening 206. The sheet feed cassette 150 is inserted into or pulled out of the print unit 201 through the opening 206. The sheet feed cassette 150 is omitted in FIG. 26.

A door 210 (see FIG. 26) is provided in a lower right portion of the front of the main body 205 so as to be openable and closable. A cartridge mounting portion 211 is provided inside the door 210. When the door 210 is opened as shown in FIG. 26, the cartridge mounting portion 211 is exposed to the front 156 of the main body 205. This allows ink cartridges 212 to be inserted into or pulled out of the cartridge mounting portion 211. The ink cartridges 212 are connected with a recording head 219 (see FIG. 28) via an ink tube when mounted to the cartridge mounting portion 211. The recording head 219 ejects ink supplied from the ink cartridges 212 to record an image on a recording sheet 247.

The scanning unit 202 is provided at upper portion of the composite device 200. The scanning unit 202 has a flat bed scanner (FBS), and an automatic document feeder (ADF). As shown in FIG. 26, a document cover 203 is provided as a top plate of the composite device 200 so as to be openable and closable. The ADF is provided in the document cover 203. Although not shown, a platen glass and an image sensor are provided below the document cover 203. In the scanning unit 202, an image of a document placed on the platen glass or a document conveyed by the ADF is read by the image sensor.

The upper portion of the front of the composite device 200 is provided with the operation panel 204. The operation panel 204 includes a liquid crystal display that displays various kinds of information, input keys that allow a user to input information, etc. A liquid crystal display, input keys, etc. are omitted in FIG. 26. The composite device 200 operates on the basis of operation inputs from the operation panel 204, or information transmitted from an external information apparatus.

<Sheet Feed Cassette 150>

As shown in FIG. 27, the sheet feed cassette 150 has a sheet feed tray 160 (an example of a first tray), and a sheet discharge tray 180 (an example of a second tray). As for the sheet feed cassette 150, the sheet feed tray 160 and the sheet discharge tray 180 are disposed at two upper and lower stages with the sheet discharge tray 180 placed above the sheet feed tray 160. The sheet discharge tray 180 is provided integrally with the sheet feed tray 160 as a lid of the sheet feed tray 160. As the sheet feed cassette 150 is inserted into the print unit 201 through the opening 206, the sheet feed tray 160 and the sheet discharge tray 180 are disposed within the opening 206 of the main body 205.

The sheet feed tray 160 accommodates recording sheets 247 to be used for recording of an image. Recording sheets 247 of various sizes defined in Japanese Industrial Standard are accommodated in the sheet feed tray 160. The various sizes include A4 size, B5 size, A5 size, postcard size, etc. An image is recorded on the recording sheet 247 by the recording unit 224 (see FIG. 28) while the recording sheet 247 is conveyed along the conveying path 223 (see FIG. 28) from the sheet feed tray 160, and then the recording sheet 247 is discharged into the print unit 201 within the body. The sheet discharge tray 180 accommodates the recording sheet 247 on which the image has been recorded.

Figure 30:
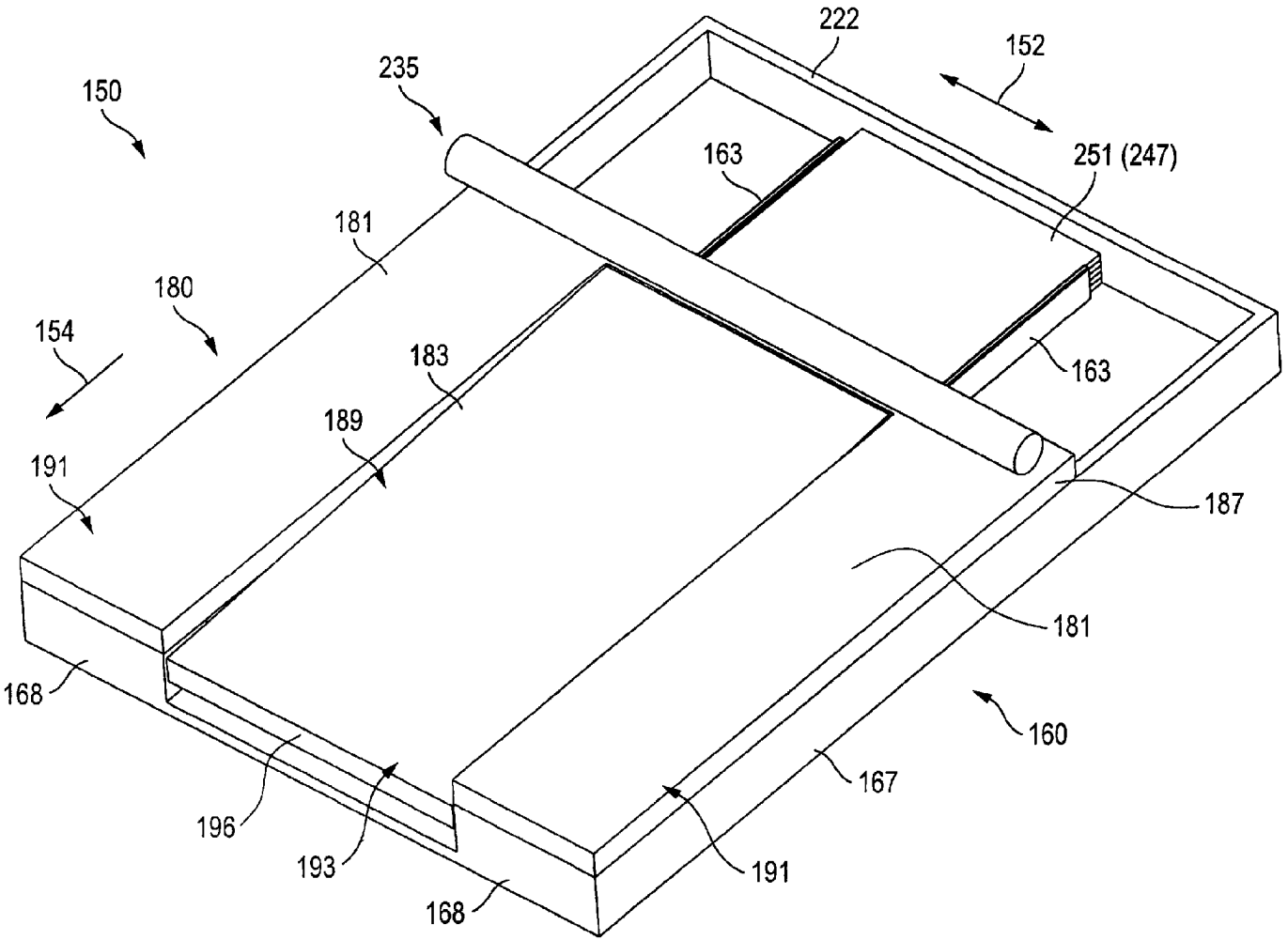
FIG. 30 is a schematic perspective view showing the external configuration of the sheet feed cassette, and shows a state where small-size sheets are accommodated in the sheet feed tray as the recording sheets.

In the present embodiment, at least two types of recording sheets 247 with different sizes are accommodated in the sheet feed tray 160. The two types of recording sheets 247 are a large-size sheet 250 (an example of a first-size recording medium (see FIG. 27)), and a small-size sheet 251 (an example of a second-size recording medium (see FIG. 30)). The small-size sheet 251 is a recording sheet having a smaller size than the large-size sheet 250. The large-size sheet 250 includes, for example, an A4-size recording sheet 247. The small-size sheet 251 includes, for example, a postcard-size recording sheet 247. The sheet feed cassette 150 that accommodate A4-size, i.e., large-size sheets 250 is shown in FIG. 27. The sheet feed cassette 150 that accommodate postcard-size recording sheets 247 is shown in FIG. 30. The size of the large-size sheet 250 and the size of the small-size sheet 251 are not limited thereto. That is, for example, the large-size sheet 250 may be a B5-size sheet, and the small-size sheet 251 may be an A5-size sheet as long as the size of the large-size sheet 250 is larger than the size of the small-size sheet 251. In short, if the size of the large-size sheet 250 is larger than the size of the small-size sheet 251, the size of the large-size sheet 250 and the size of the small-size sheet 251 are arbitrary.

Figure 28:
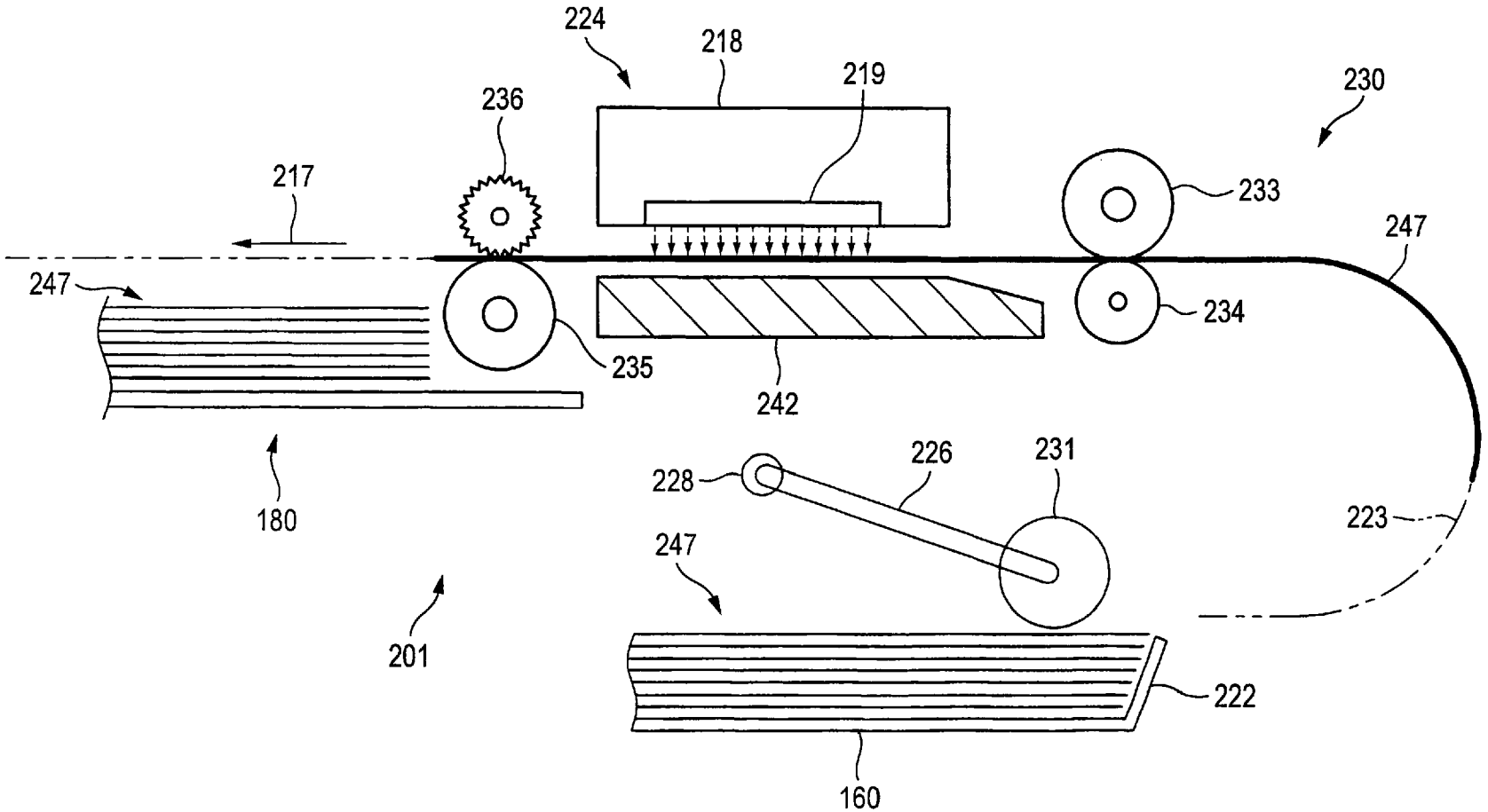
FIG. 28 is a schematic diagram showing the internal structure of a print unit.

FIG. 28 is a schematic diagram showing the internal structure of the print unit 201. A portion of the sheet feed tray 160 and a portion of the sheet discharge tray 180 are omitted in FIG. 28.

The sheet feed tray 160 is disposed at the bottom of the print unit 201 (see FIG. 34). Recording sheets 247 accommodated in the sheet feed tray 160 are fed into the print unit 201. An inclined plate 222 is provided on the deep side (the right in FIG. 28) of the sheet feed tray 160 (see FIGS. 27 and 28). As shown in FIG. 28, the inclined plate 222 inclines so as to fall toward the rear side of the apparatus (the right in FIG. 28). The inclined plate 222 separates a recording sheet 247 from the sheet feed tray 160 to guide the separated sheet upward. A conveying path 223 is provided above the inclined plate 222. The conveying path 223 is a path along which the recording sheet 247 is conveyed, and a portion thereof is formed so as to be curved. Specifically, after the conveying path 223 goes upward from the inclined plate 222, the conveying path is curved toward the front 156 (the left in FIG. 28) of the composite device 200, extends toward the front 156, and leads to the sheet discharge tray 180 through a recording unit 224. Although the inclined plate 222 is shown in an erected state for the purpose of simplification, actually, the inclined plate is inclined toward the rear side of the apparatus as mentioned above in other drawings excluding FIG. 28.

<Conveying Unit 230>

A conveying unit 230 (an example of the conveying unit) conveys a recording sheet 247 from the sheet feed tray 160 to discharge the sheet onto the sheet discharge tray 180. The conveying unit 230 has a sheet feed roller 231, a conveying roller 233, and a sheet discharge roller 235. The sheet feed roller 231 feeds the recording sheet 247 to the conveying path 223 from the sheet feed tray 160. The conveying roller 233 and the sheet discharge roller 235 convey the recording sheet 247 fed from the sheet feed tray 160 along the conveying path 223.

As shown in FIG. 28, the sheet feed roller 231 is provided above the sheet feed tray 160. The sheet feed roller 231 is provided closer to the upstream side (hereinafter simply referred to as the "upstream side") in a conveying direction 217 of a recording sheet 247 than the conveying path 223 that is formed so as to be curved. The sheet feed roller 231 is brought into pressure contact with a recording sheet 247 placed on the sheet feed tray 160 to feed the recording sheet 247 to the inclined plate 222. The sheet feed roller 231 is rotatably supported by the tip of an arm 226. The arm 226 is provided with a power transmission mechanism in which a plurality of gears mesh with one another. The sheet feed roller 231 is rotated by a driving force transmitted via the power transmission mechanism from an LF motor (not shown).

The arm 226 is moved up and down with a shaft 228 as the axis of rotation so that the portion thereof on the side of sheet feed roller 231 can be brought into contact with or separated from the sheet feed tray 160. The arm 226 is urged toward the sheet feed tray 160 by its own weight or a spring. Thereby, in a case where recording sheets 247 are accommodated in the sheet feed tray 160, the sheet feed roller 231 is brought into pressure contact with a recording sheet 247 in the uppermost position in the sheet feed tray 160. When the sheet feed cassette 150 is inserted or pulled out through the opening 206, the arm 226 is retreated upward.

The sheet feed roller 231 is rotates by a driving force transmitted from the LF motor in a state where the roller is brought into pressure contact with the surface of a recording sheet 247 on the sheet feed tray 160. Thereby, the uppermost recording sheet 247 is delivered to the inclined plate 222 by the frictional force between the surface of the sheet feed roller 231, and the recording sheet 247. The recording sheet 247 is abutted on the inclined plate 222 at its tip, and is guided upward, i.e., to the conveying path 223.

As shown in FIG. 28, the conveying roller 233 is provided on the upstream side of the recording unit 224 in the conveying path 223. A pinch roller 234 is provided in a position that faces the conveying roller 233 across the conveying path 223. The pinch roller 234 is urged to the conveying roller 233 so that it can be brought into pressure contact with the conveying roller. When a recording sheet 247 is fed to the conveying path 223 by the sheet feed roller 231, the sheet enter a space between the conveying roller 233 and the pinch roller 234. In that case, the pinch roller 234 retreats by the thickness of the recording sheet 247, and nips the recording sheet 247 along with the conveying roller 233. The conveying roller 233 is rotated by a driving force transmitted from the LF motor. The rotatory power of the conveying roller 233 is transmitted to the recording sheet 247, and the recording sheet 247 is conveyed onto a platen 242.

As shown in FIG. 28, the sheet discharge roller 235 is provided closer to the downstream side (hereinafter simply referred to as the "downstream side") in the conveying direction 217 of a recording sheet 247 than the recording unit 224 in the conveying path 223. A spur roller 236 is provided in a position that faces the sheet discharge roller 235 across the conveying path 223. The spur roller 236 is brought into pressure contact with the sheet discharge roller 235. An image is recorded on the recording sheet 247 by the recording unit 224 while the recording sheet 247 passes above the platen 242. When this recording sheet 247 enters between the sheet discharge roller 235 and the spur roller 236, the recording sheet 247 is nipped by the sheet discharge roller 235 and the spur roller 236. The driving force from the LF motor is also transmitted to the sheet discharge roller 235 in addition to the conveying roller 233. Thereby, the conveying roller 233 and the sheet discharge roller 235 are intermittently driven with predetermined linefeed width. The conveying roller 233 and the sheet discharge roller 235 are synchronized with each other in rotation. A recording sheet 247 on which an image is recorded is conveyed toward the opening 206 (refer FIG. 26) by the conveying roller 233, the pinch roller 234, and the sheet discharge roller 236, and is discharged onto the sheet discharge tray 180. Although not shown, the scanning unit 202 (see FIG. 26) is provided above the recording unit 224. A space 260 (see FIG. 34) is provided between the scanning unit 202 and the sheet discharge tray 180. A recording sheet 247 on which an image is recorded is discharged to the space 260 from the conveying path 223, and is accommodated within the sheet discharge tray 180.

<Recording Unit 224>

As shown in FIG. 28, the recording unit 224 is provided in the course of the conveying path 223. The recording unit 224 records an image on a recording sheet 247 during the conveyance of the recording sheet 247. Specifically, the recording unit 224 ejects ink to a recording sheet 247 conveyed above the platen 242 along the conveying path 223 by the conveying unit 230, to record an image on the recording sheet. This recording unit 224 has a carriage 218 and a recording head 219.

The carriage 218 is configured so as to be reciprocable in a direction (a direction vertical to the sheet surface in FIG. 28: hereinafter referred to as a "main scanning direction") substantially orthogonal to the conveying direction 217. The carriage 218 is reciprocated with predetermined timing by a well-known belt driving mechanism. The recording head 219 is carried on this carriage 218. For this reason, the recording head 219 can reciprocate in the main scanning direction together with the carriage 218.

Ink is supplied to the recording head 219 through an ink tube from an ink cartridge 212 (see FIG. 26). The recording head 219 selectively ejects ink toward the platen 242 as fine ink droplets. The recording sheet 247 is conveyed on the platen 242 by the conveying unit 230. The recording head 219 selectively ejects ink droplets while being scanned in the main scanning direction by the reciprocation of the carriage 218 during the conveyance thereof. Thereby, an image is recorded on the recording sheet 247 that passes above the platen 242.

Hereinafter, the configuration of the sheet feed tray 160 and the sheet discharge tray 180 will be described in detail.

Figure 32:
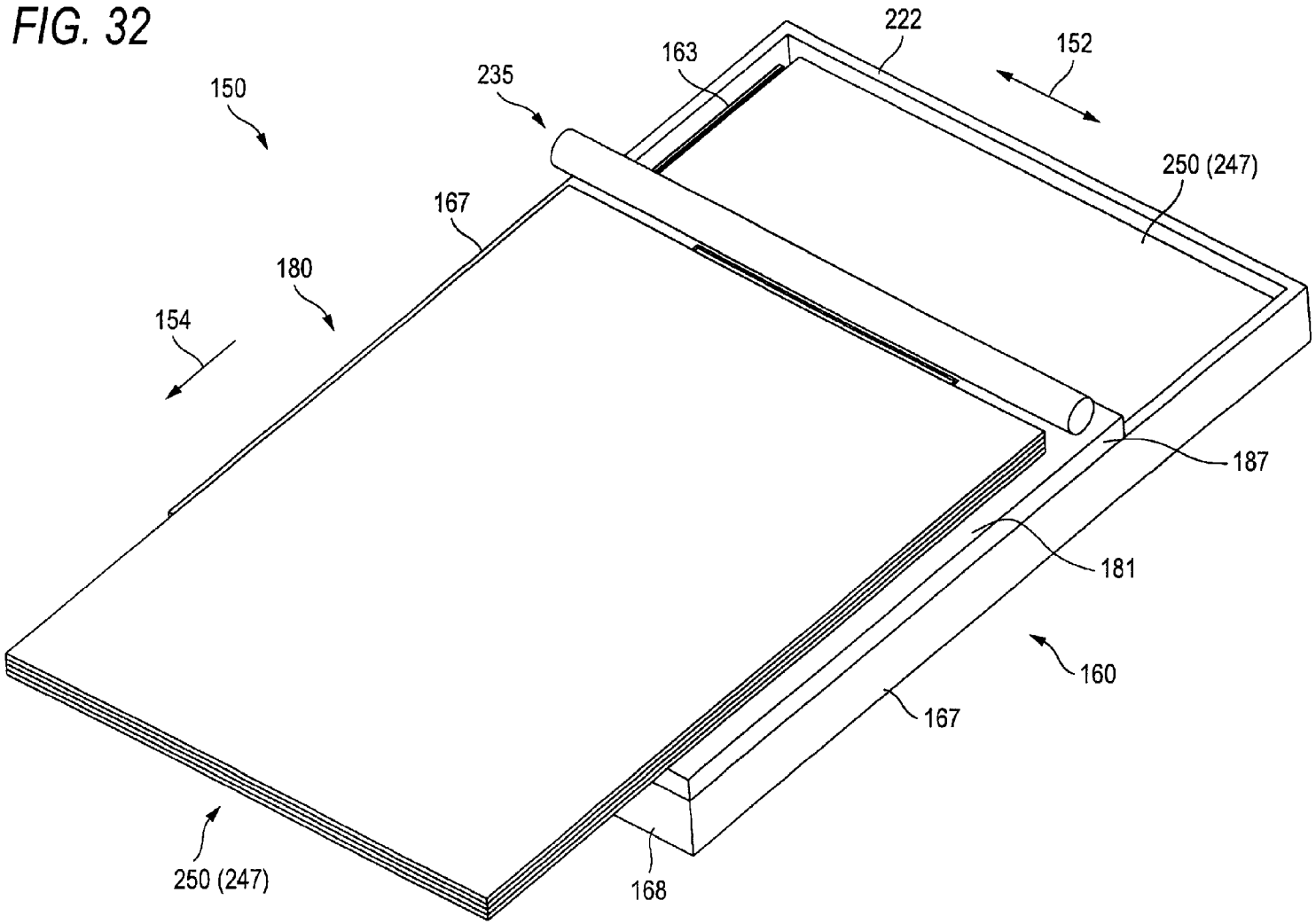
FIG. 32 is a schematic perspective view showing the sheet feed cassette in which the large-size sheets are discharged to the sheet discharge tray.
Figure 33:
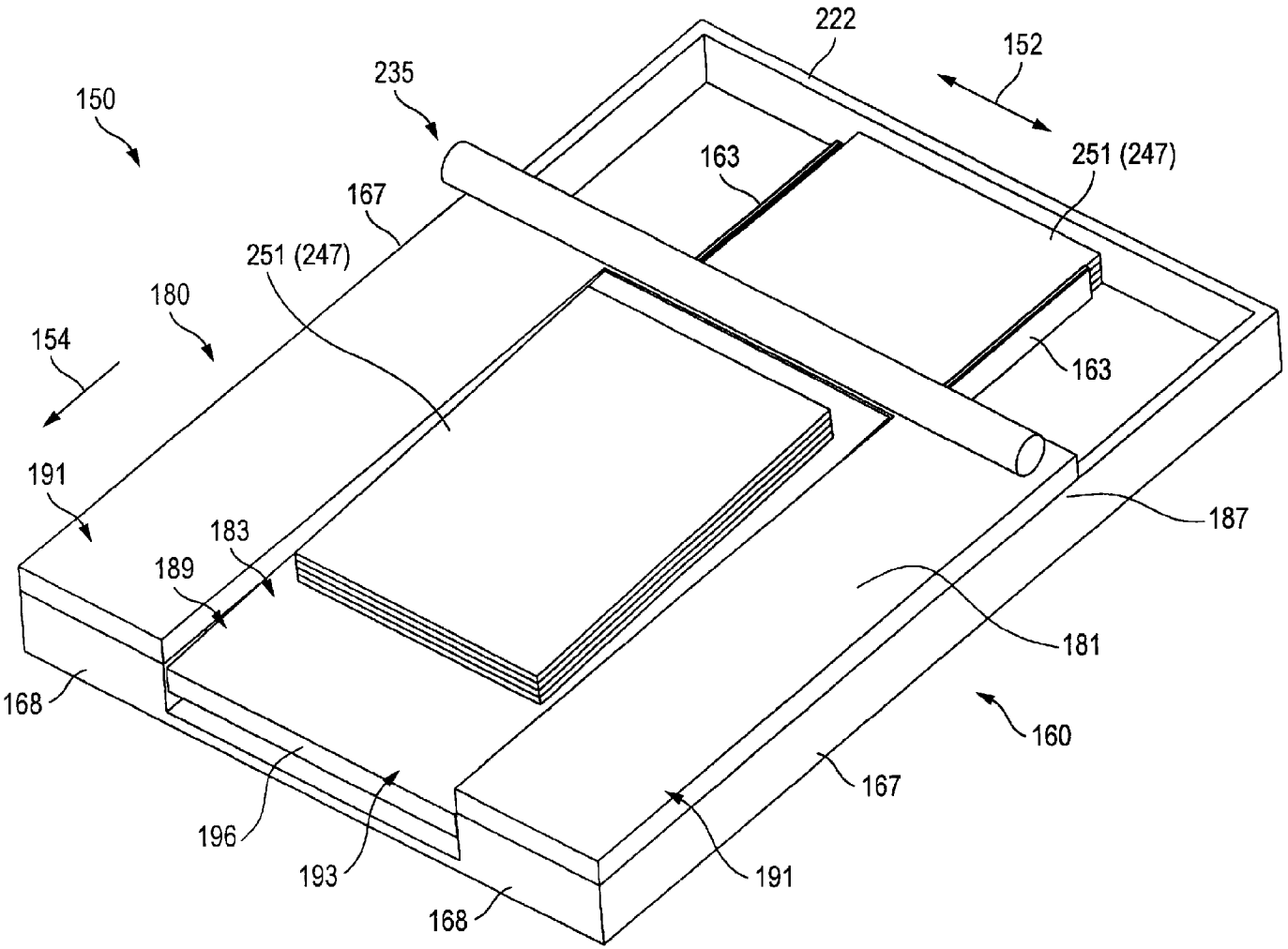
FIG. 33 is a schematic perspective view showing the sheet feed cassette in which the small-size sheets are discharged to the sheet discharge tray.

As shown in FIG. 27, the sheet feed cassette 150 includes the sheet feed tray 160 and the sheet discharge tray 180 when roughly classified. The sheet discharge tray 180 is rotatably supported above the sheet feed tray 160. The sheet discharge tray 180 is configured so as to be rotatable upward with a horizontal direction 152 (see FIG. 27) substantially orthogonal to the conveying direction 217 (see FIG. 28) of the recording sheet 247. The direction of an arrow 154 in FIG. 27 and the conveying direction 217 in FIG. 28 are same directions. As the sheet discharge tray 180 is toppled with respect to the sheet feed tray 160, the top surface of the sheet feed tray 160 is covered with the sheet discharge tray 180 (see FIG. 27). In this state, the sheet discharge tray 180 holds a recording sheet 247 on which an image is recorded, and functions as a lid of the sheet feed tray 160 (FIGS. 32 and 33). As a result, entering of dust to the sheet feed tray 160 is prevented. Further, as the sheet discharge tray 180 is erected with respect to the sheet feed tray 160, the top surface of the sheet feed tray 160 is opened, thereby allowing replenishment of recording sheets 247 to the sheet feed tray 160. An upper portion of the sheet feed tray 160 on its deep side is opened so that the sheet feed roller 231 and the arm 226 that are shown in FIG. 28 may be disposed.

Figure 29:
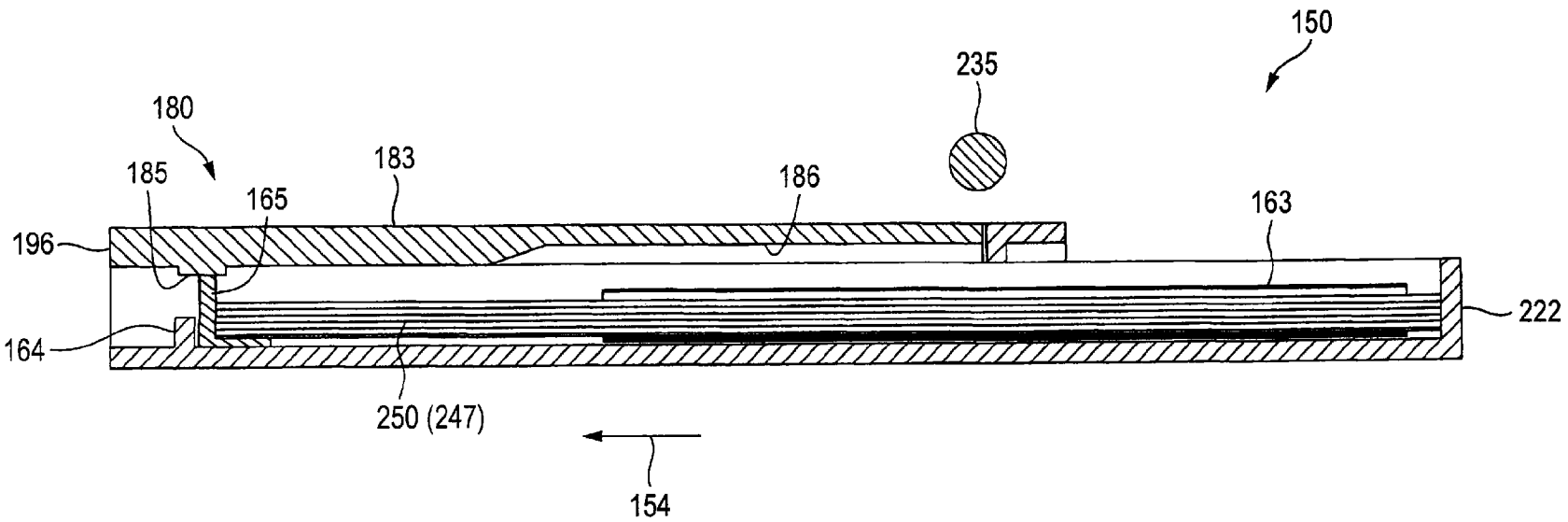
FIG. 29 is a longitudinal cross-sectional view showing the internal structure of the sheet feed cassette, and shows a state where large-size sheets are accommodated in the sheet feed tray as the recording sheets.
Figure 31:
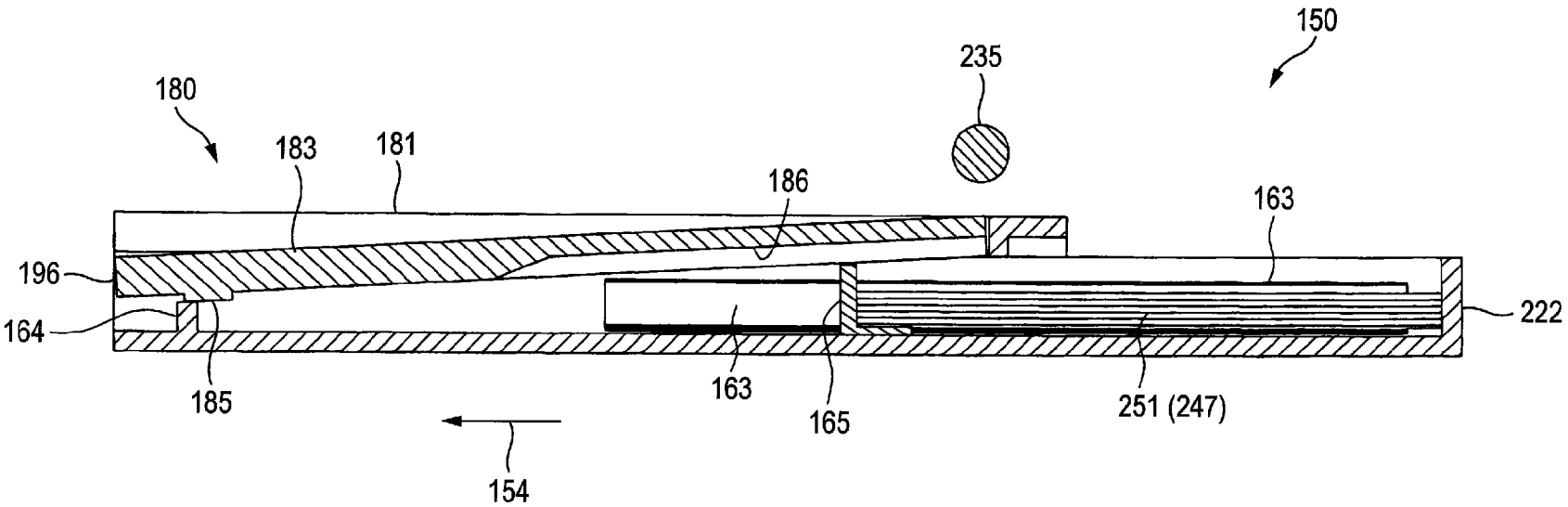
FIG. 31 is a longitudinal cross-sectional view showing the internal structure of the sheet feed cassette, and shows a state where the small-size sheets are accommodated in the sheet feed tray as the recording sheets.

FIG. 29 is a longitudinal cross-sectional view showing the internal structure of the sheet feed cassette 150, and shows a state where large-size sheets 250 are accommodated in the sheet feed tray 160 as the recording sheets 247. FIG. 30 is a schematic perspective view showing the external configuration of the sheet feed cassette 150, and shows a state where small-size sheets 251 are accommodated in the sheet feed tray 160 as the recording sheets 247. FIG. 31 is a longitudinal cross-sectional view showing the internal structure of the sheet feed cassette 150, and shows a state where the small-size sheets 251 are accommodated in the sheet feed tray 160 as the recording sheets 247.

<Sheet Feed Tray 160>

The sheet feed tray 160 is formed in a rectangular shape that has the horizontal direction 152 as a lateral direction. The inclined plate 222 is provided at the tip of the sheet feed tray 160. The inclined plate 222 includes a plate-like member that is long in the width direction (horizontal direction 152) of the sheet feed tray 160. The inclined plate 222 is tilted to the rear side of the apparatus (the right in FIGS. 29 and 31). Accordingly, when the leading end of a recording sheet 247 (a large-size sheet 250 or small-size sheet 251) abuts on the inclined plate 222, the leading end is guided obliquely upward along an internal surface of the inclined plate 222. That is, the internal surface of the inclined plate 222 functions as a guide surface that guides a recording sheet 247 to the conveying path 223.

As shown in FIGS. 27 and 30, the sheet feed tray 160 is provided with side walls 167 and front walls 168 which form wall surfaces of the sheet feed tray 160. The side walls 167 are respectively provided on both sides of the sheet feed tray 160 in its width direction. The front walls 168 are provided at the end of the sheet feed tray 160 on the side of the opening 206 (direction indicated by the arrow 154). The side walls 167 and the front walls 168 are erected vertically upward from the bottom of the sheet feed tray 160. For this reason, as the tray body 181 of the sheet discharge tray 180 is toppled with respect to the sheet feet tray 160, the tray body is supported by the side walls 167 and the front walls 168. Any wall surfaces are not provided between the two front walls 168 of the sheet feed tray 160 so that a sub-tray 183 described later may rotate toward the sheet feed tray 160 (see FIG. 27 and FIGS. 29 to 31).

As shown in FIGS. 29 and 31, a convex portion 164 is provided on the side of the opening 206 (left in the drawings) in the sheet feed tray 160. The convex portion 164 is erected vertically upward from the bottom of the sheet feed tray 160. The convex portion 164 supports the sub-tray 183 moved toward the sheet feed tray 160 (see FIG. 31). For this reason, the convex portion 164 is provided in a position corresponding to a convex portion 185 provided at the back of the sub-tray 183. The convex portion 164 supports the sub-tray 183 rotated toward the sheet feed tray 160. The convex portion 164 is set that that the height thereof may become lower than the front walls 168. Thereby, a rear end 196 of the sub-tray 183 is supported by the convex portion 164 in a state where it is sufficiently rotated toward the sheet feed tray 160.

<Side Guides 163>

The sheet feed tray 160 are provided with side guides 163. The side guides 163 are plate-like members and extend in the direction shown by the arrow 154 as a longitudinal direction. Each of the side guides 163 has a substantially L-shape in cross section along the longitudinal direction. As shown in FIG. 29, the length of the ends of the side guides 163 is set up so that the ends thereof on the side of the opening 206 (the left in FIG. 29) may not be located closer to the opening 206 than the end of a recessed portion 186. For this reason, when the sub-tray 183 rotates toward the sheet feed tray 160, the side guides 163 do not interfere with the sub-tray 183. The side guides 163 regulate that recording sheets 247 accommodated in the sheet feed tray 160 move in the horizontal direction 152. In other words, the side guides 163 regulate the position of the recording sheets 247, which are accommodated in the sheet feed tray 160, in their width direction. The side guides 163 are provided so as to be slidable in the width direction (horizontal direction 152) of the sheet feed tray 160. The side guides 163 are slid according to the size of the recording sheets 247 so as to abut on both sides of the recording sheets 247 in their width direction. Thereby, the position of the recording sheets 247, which are placed on the sheet feed tray 160, in their width direction coincides substantially with a predetermined reference position (the center of the sheet feed tray 160 in its width direction in the present embodiment). As such, regulating recording sheets 247 so that the central position of the recording sheets 247 in their width direction may be made to coincide with the reference position is generally referred to as the "center registration." FIG. 27 shows a state where the side guides 163 have been moved to the outside of the sheet feed tray 160 in its width direction. FIG. 30 shows a state where the side guides 163 have been moved to the inside of the sheet feed tray 160 in its width direction.

Although not shown, the side guides 163 are provided with rack gears extending toward the center in the width direction. The rack gears mesh with a pinion gear buried in the center of the sheet feed tray 160 in its width direction. When any one of the two side guides 163 slides in the horizontal direction 152, the other guide slides in an interlocking manner in a direction opposite to the sliding direction of the one side guide. Accordingly, in a case where the width of recording sheets 247 placed on the sheet feed tray 160 is shorter than the distance between the side guides 163, the two side guides 163 are moved simultaneously by making one of the side guides 163 slide. Thereby, the central position of the recording sheets 247 in their width direction coincides substantially with the above reference position. That is, even in a case where the recording sheets 247 accommodated in the sheet feed tray 160 are large-size sheets 250 or small-size sheets 251, the central position of the recording sheets 247 in their width direction coincide substantially with the above reference position.

<Rear Guide 165>

As shown in FIGS. 29 and 31, the sheet feed tray 160 is provided with a rear guide 165 (an example of a first regulating member) serving as a positioning member of the fourth embodiment. The rear guide 165 is a plate-like member and extends in the horizontal direction 152 as a longitudinal direction. The rear guide 165 has a substantially L-shape in cross section along the longitudinal direction (in the direction indicated by the arrow 154). The rear guide 165 regulates that recording sheets 247 accommodated in the sheet feed tray 160 moves toward the opening 206 (direction indicated by the arrow 154). In other words, the rear guide 165 abuts on trailing ends of the recording sheets 247 accommodated in the sheet feed tray 160 to regulate the positions of the trailing ends. Although not shown in the drawings, the bottom surface of the sheet feed tray 160 is provided with a slit that extend in the longitudinal direction (the right-and-left direction in FIGS. 29 and 31) of the sheet feed tray 160. The rear guide 165 is inserted into the slit, and is thereby configured so as to be slidable along the slit. The height of the rear guide 165 is set so that that the upper end thereof may be located closer to the sheet discharge tray 180 than (above) the convex portion 164. Thereby, in a state (state shown in FIG. 29) where the rear guide 165 is disposed in a first position, the rear guide 165 abuts on the convex portion 185 of the sub-tray 183 to support the sub-tray 183.

When the rear guide 165 is slid toward the trailing ends of the recording sheets 247, the trailing ends of the recording sheets 247 abut on the guide surface of the rear guide 165. Thereby, the trailing ends of the recording sheets 247 are aligned with one another. As shown in FIGS. 29 and 31, the recording sheets 247 are accommodated in the sheet feed tray 160 so that their trailing ends may abut on the rear guide 165. Thereby, the leading ends of the recording sheets 247 are positioned in a predetermined position within the sheet feed tray 160 irrespective of the size of the recording sheets 247.

<First Position and Second Position>

The rear guide 165 is configured so as to be movable between a first position and a second position. As shown in FIG. 29, the first position is a position where the large-size sheets 250 are positioned with respect to the sheet feed tray 160. As the trailing ends of the large-size sheets 250 are regulated by the rear guide 165 disposed in the first position, the sheets are positioned so that their leading ends may abut on the inclined plate 222. As shown in FIG. 31, the second position is a position where the small-size sheets 251 are positioned with respect to the sheet feed tray 160. As the trailing ends of the small-size sheets 251 are regulated by the rear guide 165 disposed in the second position, the sheets are positioned so that their leading ends may abut on the inclined plate 222. The rear guide 165 is slid according to the size of the recording sheets 247 accommodated in the sheet feed tray 160, and is disposed in the first position or second position. Thereby, the recording sheets 247 are positioned in a position where their leading ends abut on the inclined plate 222 irrespective of the size of the recording sheets.

<Sheet Discharge Tray 180>

As shown in FIG. 27 and FIGS. 29 to 31, the sheet discharge tray 180 has the tray body 181, and the sub-tray 183 (an example of the sub-tray) disposed in the cutout portion 189 of the tray body 181 (an example of the first tray body).

<Tray Body 181>

The tray body 181 is formed substantially in a concave shape in plan view as the portion thereof on the side of the opening 206 (direction indicated by the arrow 154) is cut out (see FIGS. 27 and 30). Although not shown in the drawings, the tray body 181 is provided with shafts. The shafts are respectively provided at both ends of a front end 187 of the tray body 181 in its width direction (horizontal direction 152). As the shafts are respectively inserted into bearing holes provided in the side walls 167 of the sheet feed tray 160, the sheet discharge tray 181 is supported so as to be rotatable upward around an axis extending in the width direction of the sheet feed tray 160. The width of the tray body 181 is set to be approximately equal to the distance between the side walls 167. For this reason, in a state the tray body 181 is toppled with respect to the sheet feed tray 160, the tray body 181 is stably supported by the side walls 167.

<Sub-Tray 183>

The sub-tray 183 has almost the same shape as the cutout portion 189 in plan view, and is formed so as to be slightly smaller than the cutout portion 189. The sub-tray 183 is set so that the width thereof in the horizontal direction 152 may become larger than the width of the small-size sheets 251 (see FIG. 33). The sub-tray 183 is disposed in the cutout portion 189 of the tray body 181 (see FIG. 27). Shafts 184 that protrude to the outside of the sub-tray 183 in its width direction are provided at the ends of the sub-tray 183 in the horizontal direction 152 (see FIG. 27). Although not shown in the drawings, bearing holes that rotatably support the shafts 184 are provided in positions corresponding to the shafts 184 in the tray body 181. As the shafts 184 are supported by the bearing holes, the sub-tray 183 is provided in the tray body 181 so as to be rotatable toward the sheet feed tray 160. The shafts 184 are omitted in FIG. 30.

As shown in FIGS. 29 and 31, the recessed portion 186 is provided at the back of the sub-tray 183. The recessed portion 186 is formed so that the front end (the right in FIGS. 29 and 31) of the sub-tray 183 may be recessed toward the top surface of the sub-tray 183. Thereby, in a state where the sub-tray 183 has been rotated toward the sheet feed tray 160, a portion of the rear guide 165 disposed in the second position is accommodated in the recessed portion 186 (see FIG. 31). The convex portion 185 is provided at the back of the sub-tray 183. The recessed portion 185 is formed so that the front end (the left in FIGS. 29 and 31) of the sub-tray 183 may be recessed toward the top surface of the sub-tray 160. The convex portion 185 is provided in a position corresponding to the convex portion 164 provided on the sheet feed tray 160.

By the above configuration, the sheet discharge tray 180 is configured so that the posture of the sub-tray 183 can be changed between the first posture and the second posture. The first posture is a state where a top surface 193 in the rear end 196 (corresponding to the second end portion on the side of the opening) of the sub-tray 183 is supported at a predetermined height (see FIG. 27). In this first posture, the top surface 193 of the rear end 196 has almost the same height as a top surface 191 of the tray body 181. That is, the top surface 193 and the top surface 191 form the same flat surface. The second posture is a state where the top surface 193 in the rear end 196 of the sub-tray 183 has been moved toward the sheet feed tray 160 with respect to the first posture (see FIG. 30).

<First Posture>

In a case where the large-size sheets 250 are accommodated in the sheet feed tray 160, the rear guide 165 is disposed in the first position (see FIG. 29). In this state, as shown in FIG. 29, the convex portion 185 of the sub-tray 183 abuts on the top surface of the rear guide 165, and the sub-tray 183 is supported by the rear guide 165. This regulates the rotation of the rear end 196 of the sub-tray 183 toward the sheet feed tray 160, thereby maintaining the sub-tray in the first posture. In the state where the rear guide 165 is disposed in the first position in this way, the posture change of the sub-tray 183 from the first posture to the second posture is regulated.

<Second Posture>

In a case where the small-size sheets 251 are accommodated in the sheet feed tray 160, the rear guide 165 disposed in the first position is slidingly moved to the second position (see FIGS. 29 and 31). Supporting of the sub-tray 183 by the rear guide 165 is released with the movement of the rear guide 165. Only the shafts 184 of the sub-tray 183 are rotatably supported by the tray body 181. Further, the recessed portion 186 where the rear guide 165 disposed in the second position can be accommodated is provided at the back of the sub-tray 183. For this reason, the sub-tray 183 is rotated toward the sheet feed tray 160 by the weight of the sub-tray 183. As the sub-tray 183 is rotated toward the sheet feed tray 160, as shown in FIG. 31, the convex portion 185 abuts on the convex portion 164. As a result, the sub-tray 183 takes the second posture in which it is supported by the convex portion 164 of the sheet feed tray 160. As the rear guide 165 is disposed in the second position in this way, the posture of the sub-tray 183 of the sheet discharge tray 180 is changed from the first posture to the second posture by the weight of the sub-tray 183. With this posture change, the top surface 193 is moved toward the sheet feed tray 160 compared with when the sub-tray 183 is maintained in the first posture (FIGS. 27 and 30).

<Operational Effects of Present Embodiment>

Figure 34A:
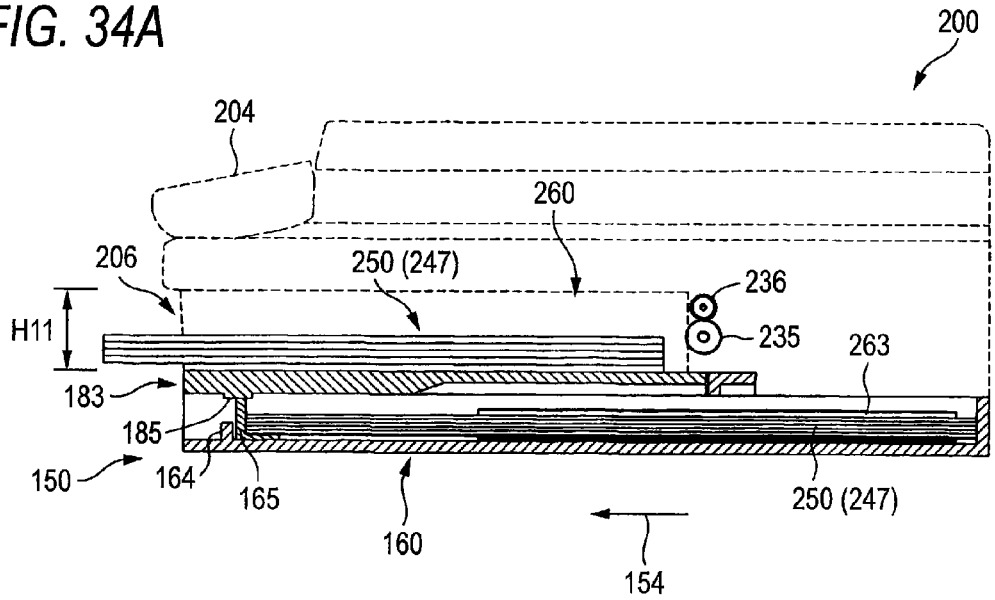
FIGS. 34A and 34B are longitudinal cross-sectional views of the sheet feed cassette, and specifically.
Figure 34B:
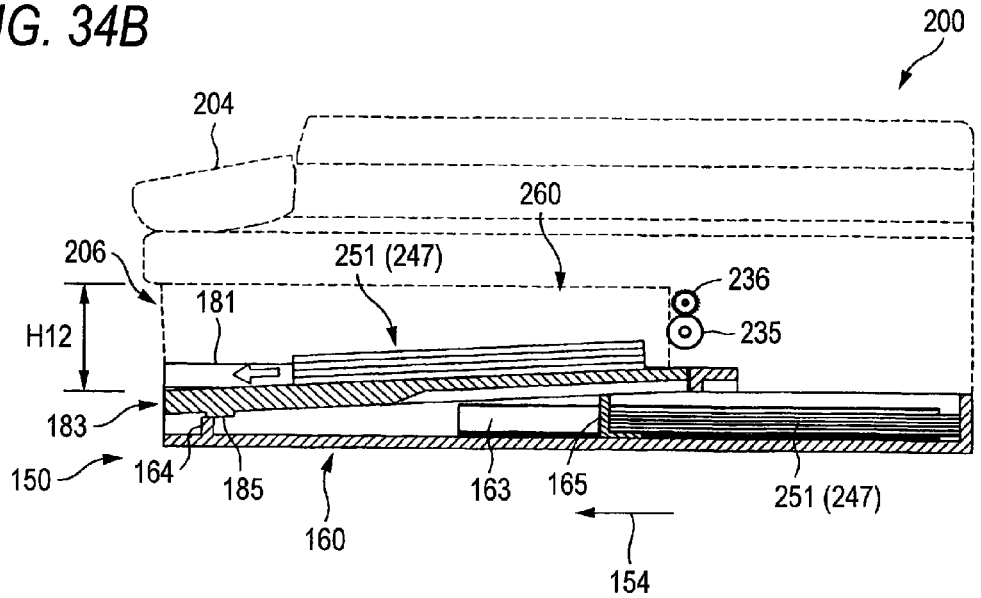

FIG. 32 is a schematic perspective view showing the sheet feed cassette 150 in which the large-size sheets 250 are discharged to the sheet discharge tray 180. FIG. 33 is a schematic perspective view showing the sheet feed cassette 150 in which the small-size sheets 251 are discharged to the sheet discharge tray 180. FIGS. 34A and 9B are longitudinal cross-sectional views of the sheet feed cassette 150, and specifically, FIG. 34A shows a state where the sub-tray 183 is maintained in the first posture, and FIG. 34B shows a state where the sub-tray 183 is maintained in the second posture.

For example, when start of reading of a document is instructed in the composite device 200, an image of the document is read by the scanning unit 202. The print unit 201 executes printing processing on the basis of the image of the document. This printing processing is performed as follows. That is, the driving force of the LF motor is selectively transmitted to the sheet feed roller 231, the conveying roller 233, and the sheet discharge roller 235 that are shown in FIG. 28. Thereby, a recording sheet 247 accommodated in the sheet feed tray 160 is conveyed along the conveying path 223. An image is recorded on the recording sheet 247 by the image recording unit 224 during conveyance of the recording sheet 247, and then the recording sheet 247 is discharged to the space 260 (see FIG. 34) toward the opening 206.

As shown in FIGS. 32 and 34A, in a case where the large-size sheets 250 are discharged to the sheet discharge tray 180 as the recording sheets 247, the recording sheets 250 are accommodated in the sheet discharge tray 180 in a state where their portions are exposed to the outside of the opening 206. Accordingly, a user can easily take out the large-size sheets 250 accommodated in the sheet discharge tray 180 from the sheet discharge tray 180.

In a state where the rear guide 165 is disposed in the first position, the rotation of the rear end 196 of the sub-tray 183 is regulated by the rear guide 165, and the sub-tray 183 is maintained in the first posture. As the rear guide 165 is disposed in the second position, the sub-tray 183 becomes rotatable toward the sheet feed tray 160. In a case where the small-size sheets 251 are discharged to the sheet discharge tray 180 as the recording sheets 247, as shown in FIGS. 33 and 34B, the recording sheets 251 are discharged to the deep side of the opening 206. As the rear guide 165 is disposed in the second position, the sheet discharge tray 180 is rotated into the sheet feed tray 160. Thereby, the space above the sheet discharge tray 180 is extended downward of the cutout portion 189. In other words, a space for allowing a user to put his/her hand thereinto in order to take out the small-size sheets 251 discharged to the sheet discharge tray 180 is extended downward.

As shown in FIGS. 34A and 34B, as the posture of the sub-tray 183 is changed to the second posture, the height of a space in the opening 206 is changed from H11 (the height at a state where the sub-tray 183 takes the first posture) to H12. For this reason, a user is enabled to put his/her hand further into the deep side than the opening 206. As a result, even if the recording sheets 247 discharged onto the sheet discharge tray 180 are small-size sheets 251, the user can easily take out the small-size sheets 251 from the sheet discharge tray 180. Accordingly, a user does not suffer the disadvantage that it becomes difficult to take out recording sheets 247 from the sheet discharge tray 180, and an apparatus in which a scanner and a printer are provided at two upper and lower stages can be made thin by making the height of the opening 206 low. The same effect is exhibited even in a case where the composite device 200 is a single-function printer having only a print function.

In a case where small-size sheets 251 are used as the recording sheet 247, the small-size sheets 251 are discharged to the sheet discharge tray 180 in a state where the sub-tray 183 is rotated toward the sheet feed tray 160. The width of the sub-tray 183 in the horizontal direction 152 (direction vertical to the sheet surface of FIG. 34) is larger than the width of the small-size sheets 251. Further, since the small-size sheets 251 accommodated in the sheet feed tray 160 are center-registered by the side guides 163, small-size sheets 251 on which an image are recorded are discharged to the center of the sheet discharge tray 180 in the horizontal direction 152. For this reason, both sides of the small-size sheets 251 are not supported by the tray body 181, but are supported by only the sub-tray 183. Thereby, the discharged small-size sheets 251 are slid toward the opening 206 along the inclined sub-tray 183. As a result, take-out of the small-size sheets 251 becomes easier.

Further, in the state where the rear guide 165 is disposed in the second position in this way (see FIG. 31), the sub-tray 183 is maintained in the second posture by its own weight. That is, in a case where the small-size sheets 251 are accommodated in the sheet feed tray 160, the rear end 196 of the sub-tray 183 is always moved toward the sheet feed tray 160. This improves the visibility into the opening 206 from the outside of the main body 205, compared with the case where the large-size sheets 250 are discharged. As a result, a user can easily confirm that the small-size sheets 251 discharged to the deep side within the opening 206 are accommodated in the sheet discharge tray 180, without looking into the inside of the opening 206. Further, the sub-tray 183 does not take a posture that does not correspond to the size of the recording sheet 247. That is, in a state where the large-size sheets 250 are accommodated in the sheet feed tray 160, the sub-tray 183 is maintained in the first posture by the rear guide 165 disposed in the first position. Further, in a state where the small-size sheets 251 are accommodated in the sheet feed tray 160, the sub-tray 183 is maintained in the second posture since the rear guide 165 is disposed in the second position. For this reason, a user can determine the size of the recording sheet 247 from the posture of the sub-tray 183.

The sub-tray 183 may include a spring (an example of a resilient member) so that the posture of the sub-tray 183 may be changed from the second posture to the first posture. For example, the shafts 184 of the sub-tray 183 are provided with torsion coil springs, respectively. In this case, since the sub-tray 183 is maintained in the first posture by the resilient force of the torsion coil springs, the posture of the sub-tray is changed from the first posture to the second posture by an external force applied thereto. Since the sub-tray 183 is resiliently urged from the second posture to the first posture, the sub-tray 183 is returned to the first posture as the external force is released. For this reason, only in a case where the sub-tray 183 is pushed down by a user, the sub-tray 183 takes the second posture. In the other states, the top surface of the sheet feed tray 160 is blocked up to prevent dust from entering the sheet feed tray 160.

(Fifth Embodiment)

Hereinafter, a fifth embodiment of the invention will be described. The composite device 200 according to the fifth embodiment has the same configuration as the fourth embodiment except that the configuration of the sheet feed cassette 150 is different partially. For this reason, description of configurations other than the sheet feed cassette 150 is omitted. The rear guide 165 functions as the positioning member in the fourth embodiment, whereas side guides 263 function as a positioning member in the fifth embodiment.

Figure 35:
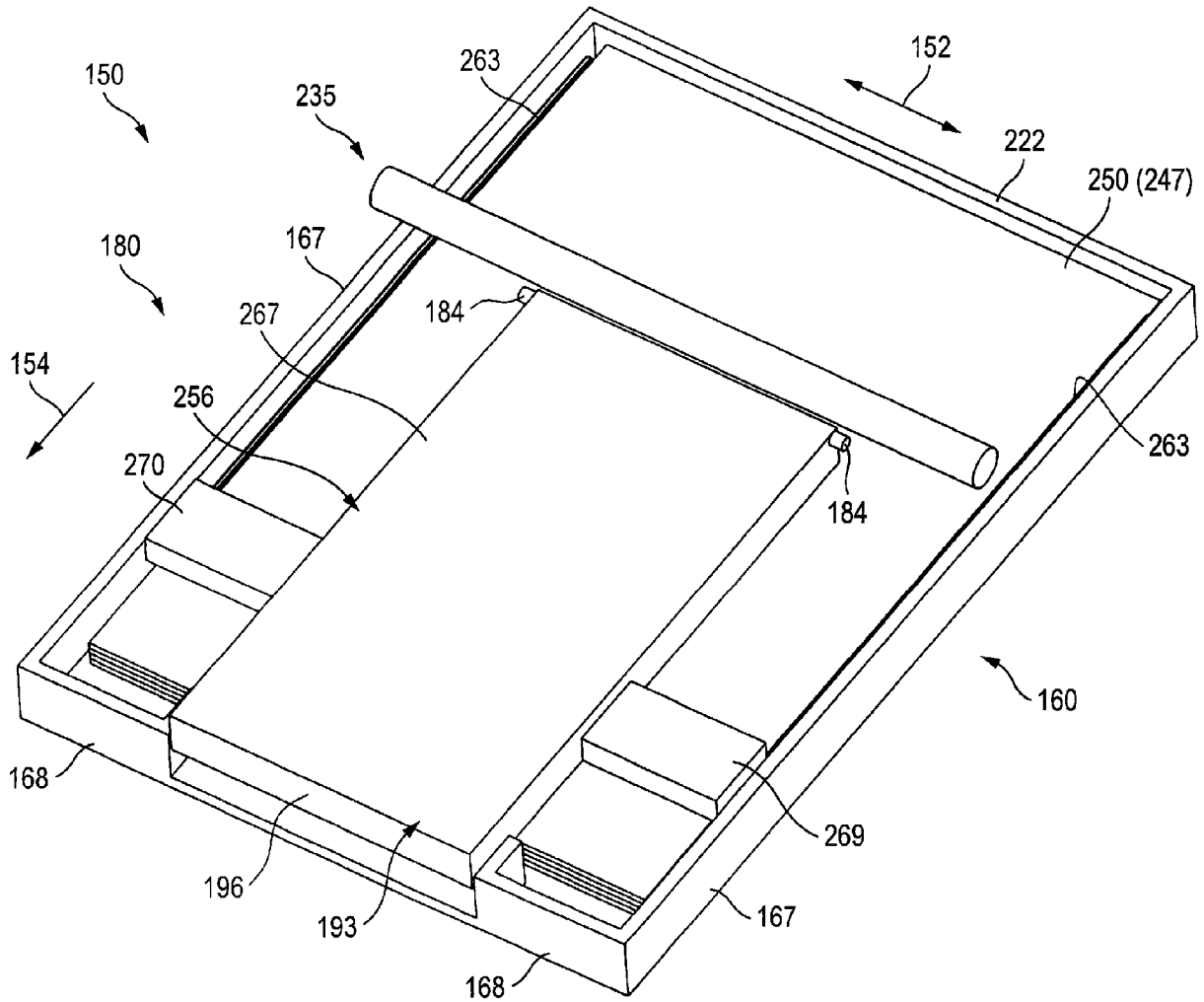
FIG. 35 is a schematic perspective view showing the external configuration of the sheet feed cassette, and shows a state where the sub-tray is maintained in the first posture.
Figure 36:
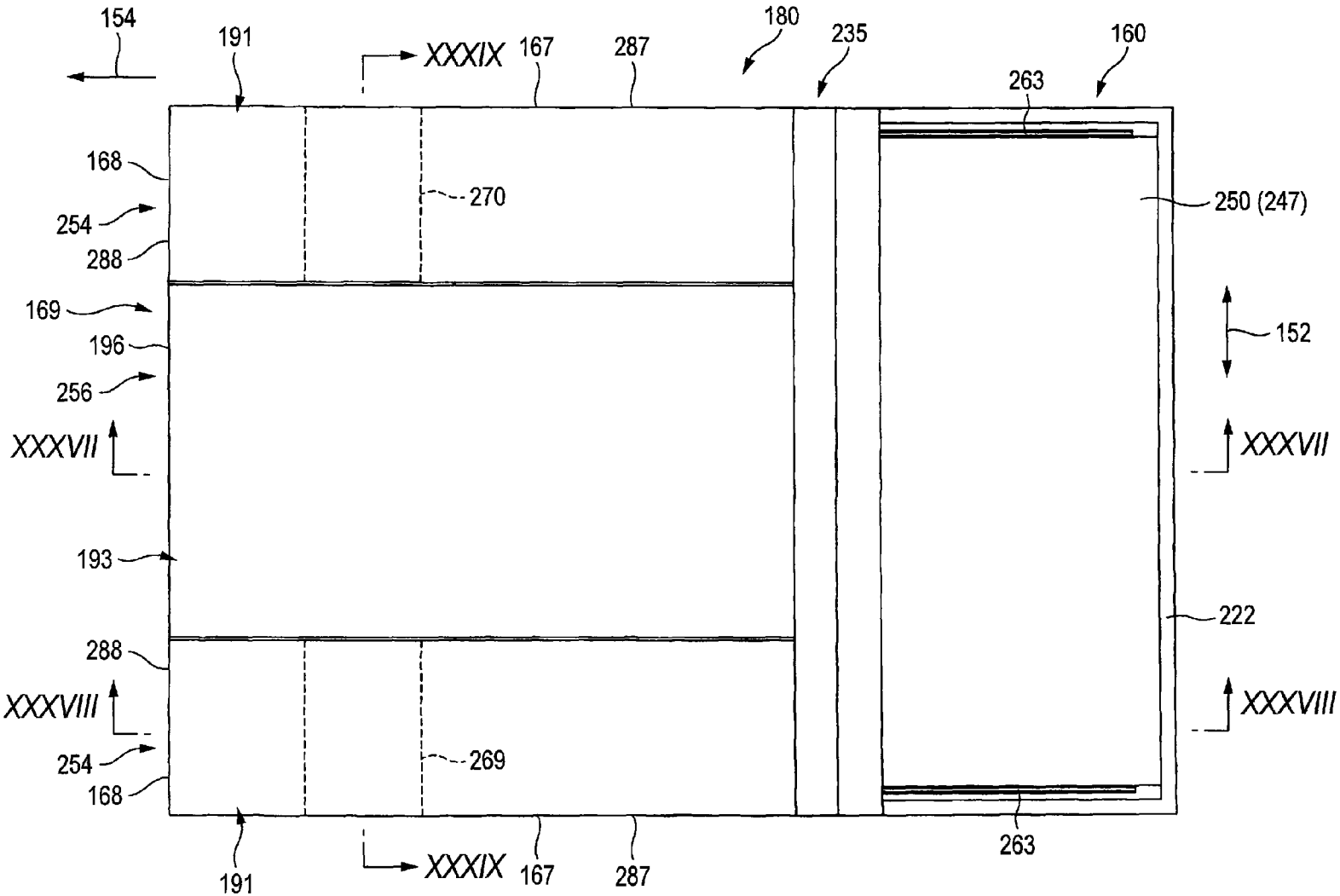
FIG. 36 is a schematic plan view of the sheet feed cassette.
Figure 37:
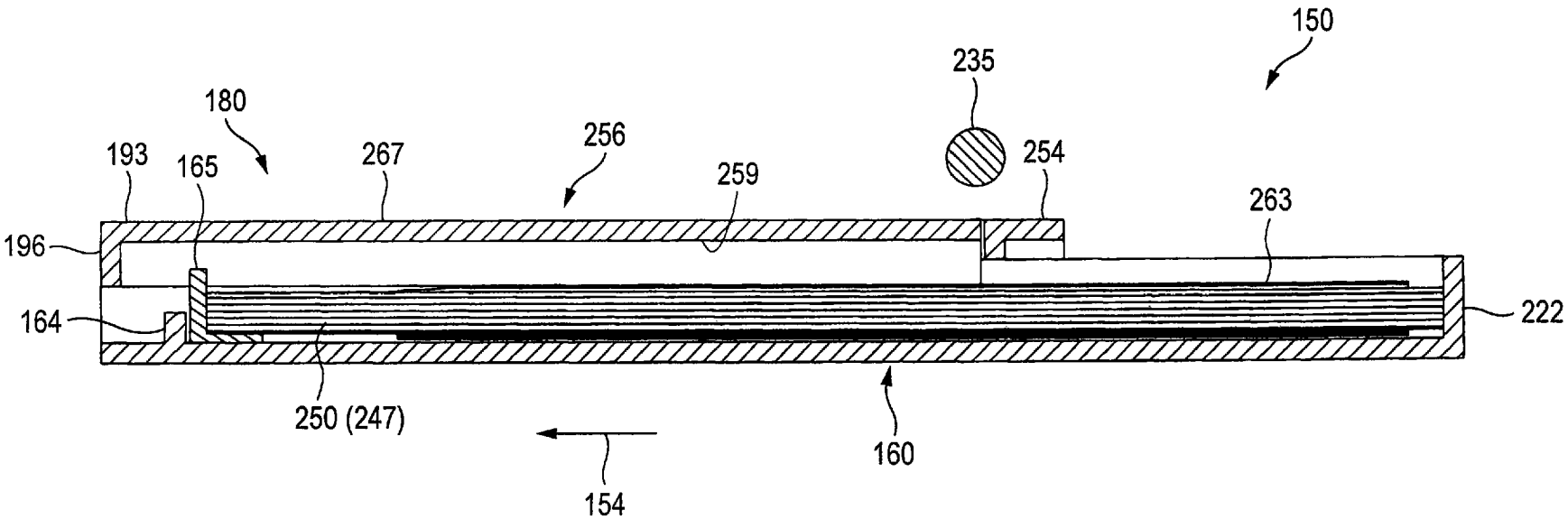
FIG. 37 is a cross-sectional view taken along the line XXXVII-XXXVII of the sheet feed cassette in FIG. 36, and shows a state where the sub-tray is maintained in the first posture.
Figure 38:
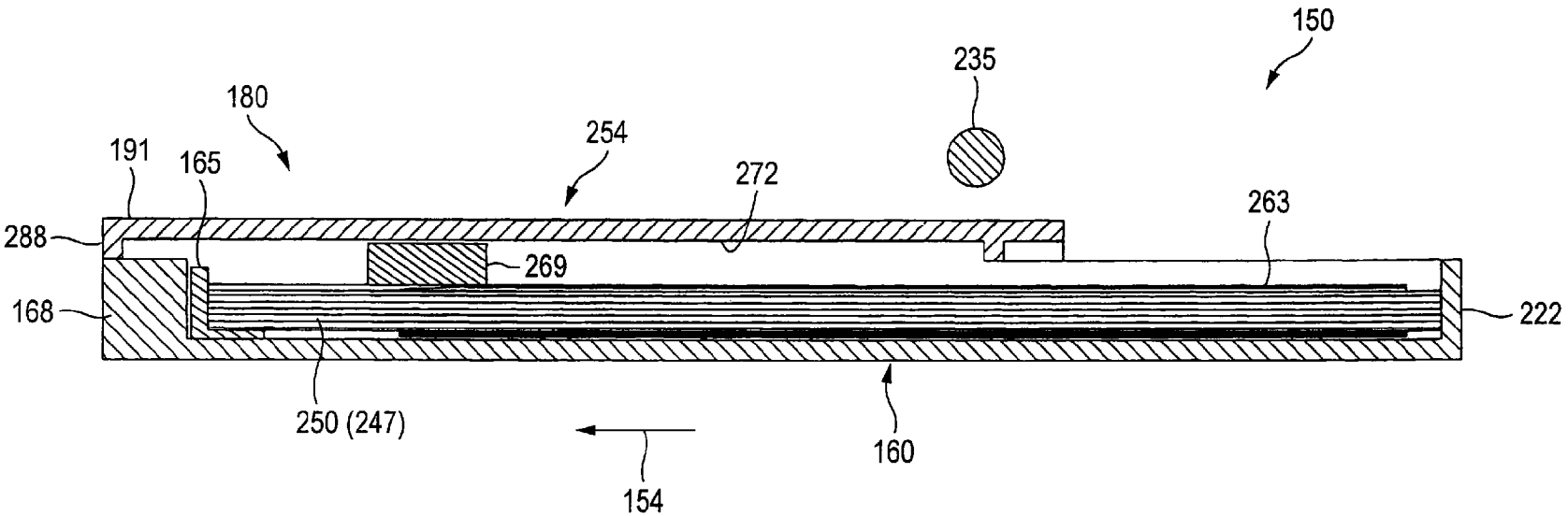
FIG. 38 is a cross-sectional view taken along the line XXXVIII-XXXVIII of the sheet feed cassette in FIG. 36, and shows a state where the sub-tray is maintained in the first posture.
Figure 39:
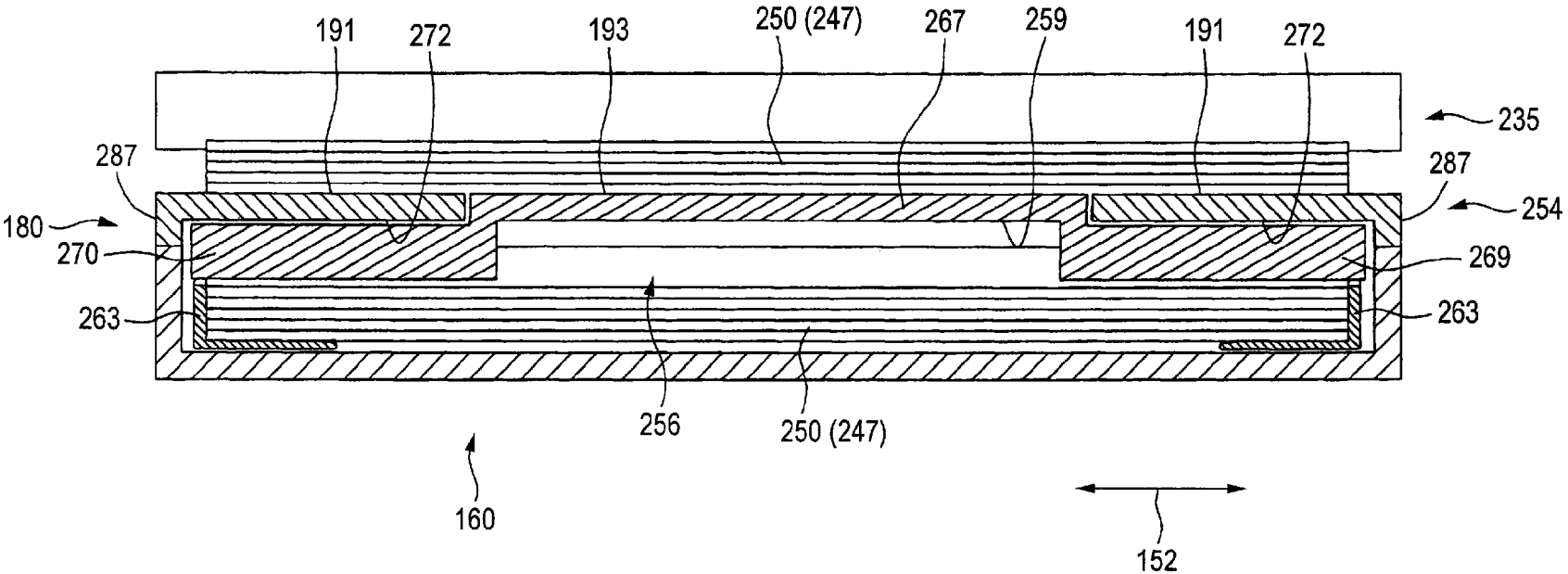
FIG. 39 is a cross-sectional view taken along the line XXXIX-XXXIX of the sheet feed cassette in FIG. 36, and shows a state where the sub-tray is maintained in the first posture.
Figure 40:
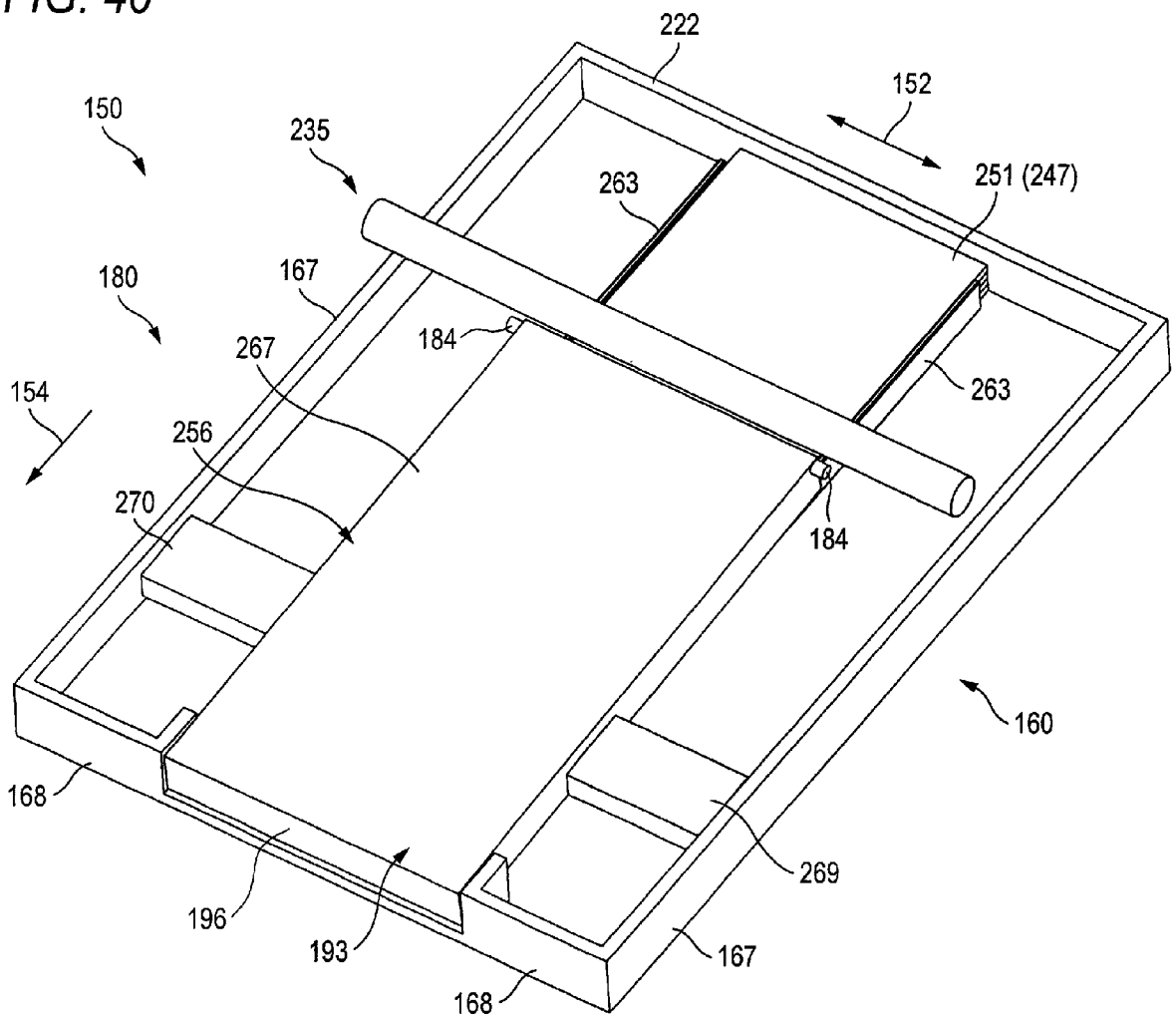
FIG. 40 is a schematic perspective view showing the external configuration of the sheet feed cassette, and shows a state where the sub-tray is maintained in the second posture.
Figure 41:
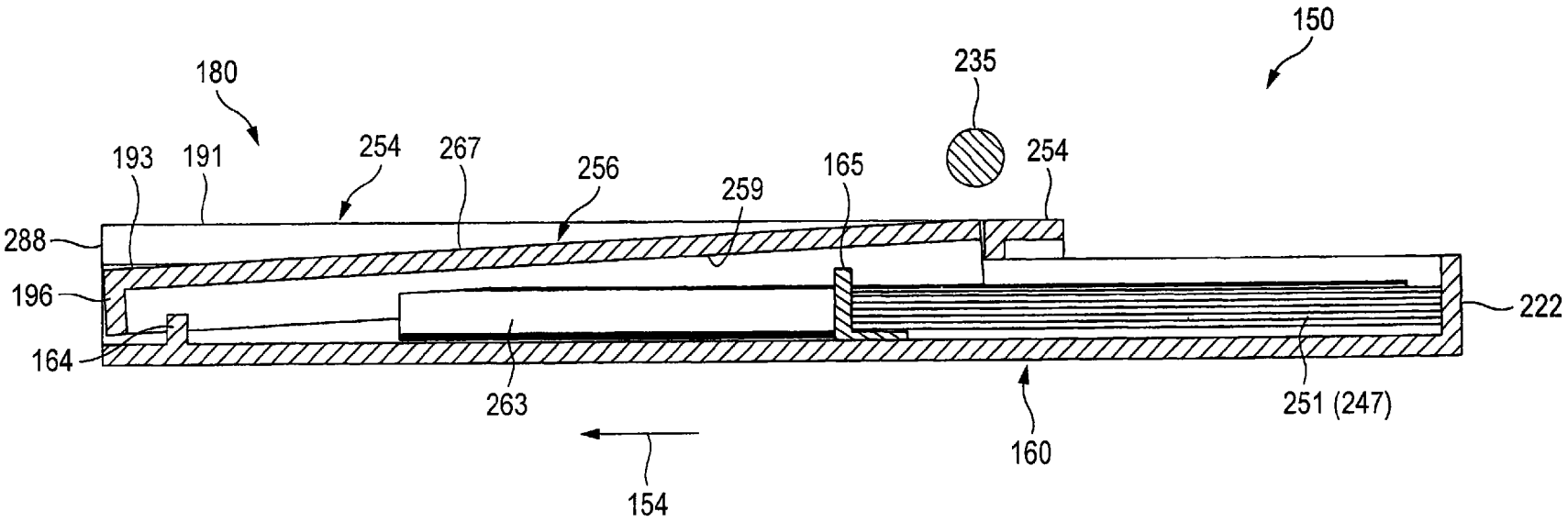
FIG. 41 is a cross-sectional view taken along the line XXXVII-XXXVII of the sheet feed cassette in FIG. 36, and shows a state where the sub-tray is maintained in the second posture.
Figure 42:
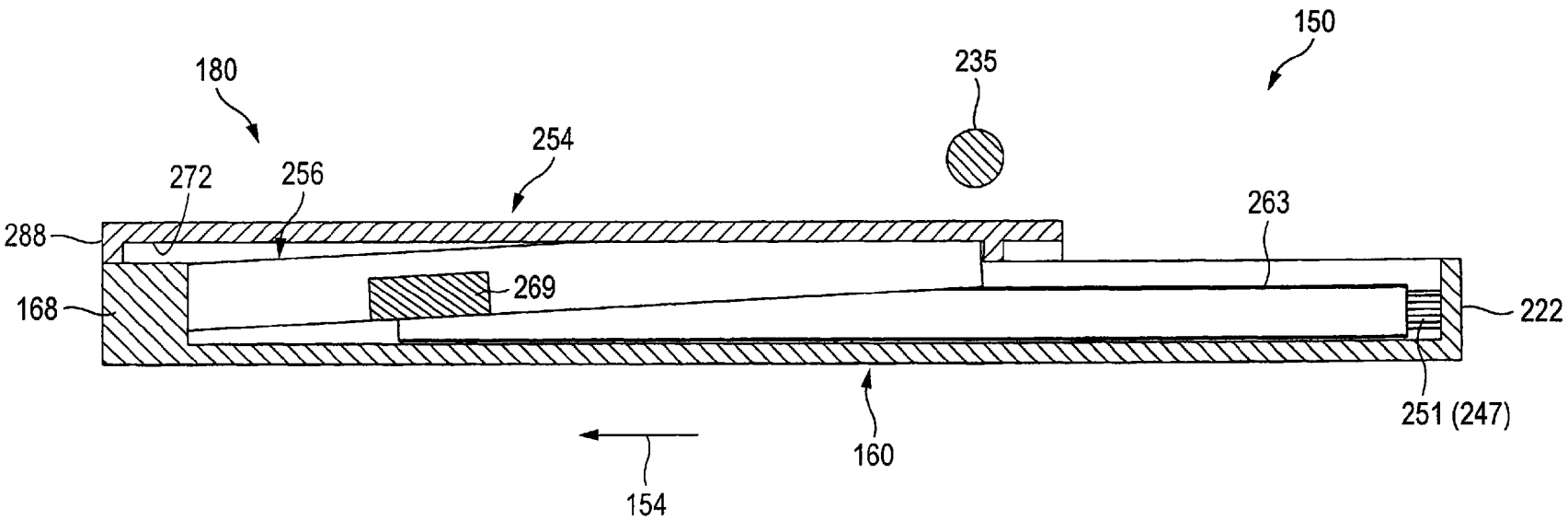
FIG. 42 is a cross-sectional view taken along the line XXXVIII-XXXVIII of the sheet feed cassette in FIG. 36, and shows a state where the sub-tray is maintained in the second posture.
Figure 43:
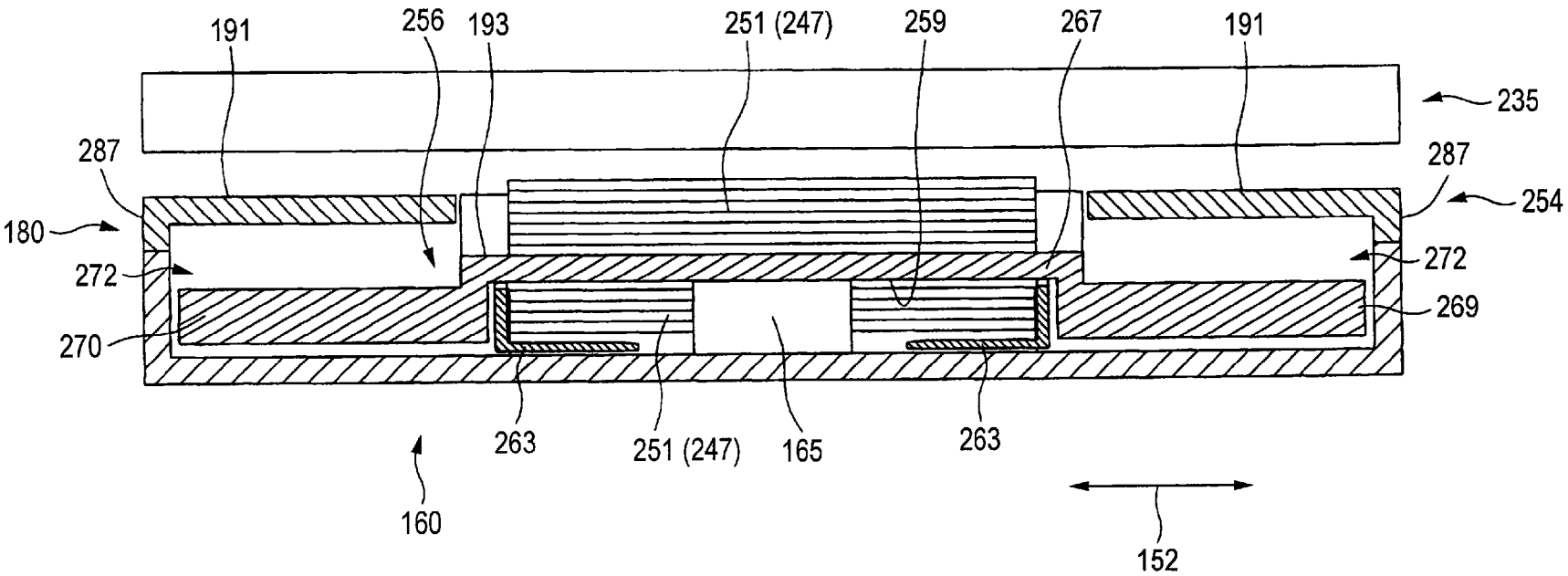
FIG. 43 is a cross-sectional view taken along the line XXXIX-XXXIX of the sheet feed cassette in FIG. 36, and shows a state where the sub-tray is maintained in the second posture.

FIG. 35 is a schematic perspective view showing the external configuration of the sheet feed cassette 150, and shows a state where the sub-tray 256 is maintained in the first posture. FIG. 36 is a schematic plan view of the sheet feed cassette 150. FIG. 37 is a cross-sectional view taken along the line XXXVII-XXXVII of the sheet feed cassette 150 in FIG. 36, and shows a state where the sub-tray 256 is maintained in the first posture. FIG. 38 is a cross-sectional view taken along the line XXXVIII-XXXVIII of the sheet feed cassette 150 in FIG. 36, and shows a state where the sub-tray 256 is maintained in the first posture. FIG. 39 is a cross-sectional view taken along the line XXXIX-XXXIX of the sheet feed cassette 150 in FIG. 36, and shows a state where the sub-tray 256 is maintained in the first posture. FIG. 40 is a schematic perspective view showing the external configuration of the sheet feed cassette 150, and shows a state where the sub-tray 256 is maintained in the second posture. FIG. 41 is a cross-sectional view taken along the line XXXVII-XXXVII of the sheet feed cassette 150 in FIG. 36, and shows a state where the sub-tray 256 is maintained in the second posture. FIG. 42 is a cross-sectional view taken along the line XXXVIII-XXXVIII of the sheet feed cassette 150 in FIG. 36, and shows a state where the sub-tray 256 is maintained in the second posture. FIG. 43 is a cross-sectional view taken along the line XXXIX-XXXIX of the sheet feed cassette 150 in FIG. 36, and shows a state where the sub-tray 256 is maintained in the second posture. In FIGS. 35 and 40, the tray body 254 (see FIGS. 36 and 39) is omitted.

<Side Guides 263>

The sheet feed tray 160 is provided with side guides 263 (an example of a second regulating member) serving as the positioning member in the fifth embodiment. The side guides 263 regulate that recording sheets 247 accommodated in the sheet feed tray 160 move in the horizontal direction 152, similarly to the side guides 163. In other words, the side guides 263 regulate the position of the recording sheets 247, which are accommodated in the sheet feed tray 160, in their width direction. The side guides 263 are provided so as to be slidable in the width direction (horizontal direction 152) of the sheet feed tray 160.

The side guides 263 are slid according to the size of the recording sheets 247 so as to abut on both sides of the recording sheets 247 in their width direction. Thereby, the position of the recording sheets 247, which are placed on the sheet feed tray 160, in their width direction coincides substantially with a predetermined reference position (the center of the sheet feed tray 160 in its width direction in the present embodiment). As shown in FIG. 37, the side guides 263 are longer toward the opening 206 (direction indicated by the arrow 152) than the side guides 163. Specifically, the side guides 263 extend to below arms 269 and 270 from the inclined plate 222 toward the opening 206 (see FIGS. 38 and 17). For this reason, the arms 269 and 270 described later are supported by the side guides 263 from below in a state where the side guides 263 are disposed in the first position (see FIG. 39). The side guides 263 support a sub-tray body 267 from below instead of the arms 269 and 270 in a state where they are disposed in the second position (see FIG. 43).

<Sub-Tray 256>

As shown in FIGS. 35, 36, and 40, the sub-tray 256 is configured such that the arms 269 and 270 extend from both side surfaces of the sub-tray body 267 in its width direction (horizontal direction 152).

As shown in FIGS. 37, 39, 41, and 43, the sub-tray body 267 has a recessed portion 259 formed at the back thereof. The recessed portion 259 is formed in a rectangular shape that is relatively long in the longitudinal direction (direction indicated by the arrow 154) of the sub-tray body 267. The recessed portion 256 is opened at the front end thereof. In a case where the small-size sheets 251 are accommodated in the sheet feed tray 160, the sub-tray 256 is configured such that the recessed portion 259 of the sub-tray body 267 is supported from below by the side guides 263 (see FIG. 43). As shown in FIGS. 37 and 41, the convex portion 185 (see FIG. 29) provided in the sub-tray 183 is not provided in the sub-tray body 267. For this reason, when the sub-tray 256 rotates toward the sheet feed tray 160, the sub-tray 256 do not abut on the rear guide 165. The arms 269 and 270 are formed in a substantially rectangular shape that is long in the width direction of the sub-tray body 267. The arms 269 and 270 are provided in the sub-tray body 267 so as to extend further to the outside in the horizontal direction 152 than the side guides 263 disposed in the first position. For this reason, the arms 269 and 270 are supported by the side guides 263 disposed in the first position (see FIG. 39).

<Tray Body 254>

As shown in FIG. 36, the tray body 254 has almost the same shape as the tray body 181 (see FIG. 27). As shown in FIGS. 38, 39, 42, and 43, the tray body 254 has a recessed portion 272 formed at the back thereof. The recessed portion 272 is formed in a rectangular shape that is relatively long in the longitudinal direction of the tray body 254. As shown in FIG. 36, FIG. 39, and FIG. 43, the tray body 254 is provided with side walls 287 that protrude downward of the tray body 254 from both sides of the tray body in its width direction (horizontal direction 152). As shown in FIG. 36, FIG. 38, and FIG. 42, the tray body 254 is provided with front walls 288 that protrude downward of the tray body 254 from the end of the tray body on the side of the opening 206 (direction indicated by the arrow 154). In a state where the tray body 254 is toppled with respect to the sheet feed tray 160, the side walls 287 are supported by the side walls 167 (see FIG. 35), and the front walls 288 are supported by the front walls 168. As for this tray body 254, the center (on the side of the cutout portion 169 (see FIG. 36)) of the tray body 254 is not provided with a wall surface. For this reason, as shown in FIG. 39, portions of the arms 269 and 270 are accommodated in the recessed portion 272 in a state (see FIGS. 35 and 37) where the sub-tray 256 is maintained in the first posture.

<First Position and Second Position>

The side guides 263 are configured so as to be movable between the first position (see FIGS. 35 and 14) and the second position (see FIGS. 40 and 43). As shown in FIGS. 35 and 39, the first position is a position where the large-size sheets 250 are positioned with respect to the sheet feed tray 160. Both sides of the large-size sheets 250 in their width direction are regulated by the side guides 263 that are disposed in the first position. Thereby, the position of the large-size sheets 250 in their width direction coincides substantially with a predetermined reference position (the center of the sheet feed tray 160 in its width direction in the present embodiment). As shown in FIGS. 40 and 43, the second position is a position where the large-size sheets 251 are positioned with respect to the sheet feed tray 160. Both sides of the small-size sheets 251 in their width direction are regulated by the side guides 263 that are disposed in the second position. Thereby, the position of the small-size sheets 251 in their width direction coincides substantially with the above reference position. The side guides 263 are disposed in the first position or second position according to the size of recording sheets 247 accommodated in the sheet feed tray 160. Thereby, the position of the recording sheets 247 in their width direction is determined in the center of the sheet feed tray 160 in its width direction irrespective of the size of the recording sheets.

The sheet discharge tray 180 in the present embodiment is configured so that the posture of the sub-tray 256 can be changed between the first posture and the second posture. The first posture is a state where the top surface 193 in the rear end 196 of the sub-tray 256 is supported at a predetermined height (see FIGS. 35, 37, and 39). In this first posture, as shown in FIG. 39, the top surface 193 of the rear end 196 has almost the same height as the top surface 191 of the tray body 254. That is, the top surface 193 and the top surface 191 form the same flat surface. The second posture is a state where the top surface 193 in the rear end 196 of the sub-tray 256 has been moved toward the sheet feed tray 160 with respect to the first posture (see FIGS. 40, 41 and 43).

<First Posture>

In a case where the large-size sheets 250 are accommodated in the sheet feed tray 160, the side guides 263 are disposed in the first position (see FIG. 35). In this state, as shown in FIG. 39, the arms 269 and 270 of the sub-tray 256 abut on the top surface of the side guides 263, and are supported by the side guides 263. This regulates the rotation of the rear end 196 of the sub-tray 256 toward the sheet feed tray 160, thereby maintaining the sub-tray in the first posture. Thus, in the state where the side guides 263 are disposed in the first position, the posture change from the first posture to the second posture of the sub-tray 256 is regulated.

<Second Posture>

In a case where the small-size sheets 251 are accommodated in the sheet feed tray 160, the side guides 263 disposed in the first position is slidingly moved to the second position from the first position (see FIGS. 35, 39, 40, and 43). Supporting of the arms 269 and 270 by the side guides 263 is released with the movement of the side guides 263. Only the shafts 184 of the sub-tray 256 are rotatably supported by the tray body 254. For this reason, the sub-tray 256 is rotated toward the sheet feed tray 160 by the weight thereof. As the sub-tray 256 is rotated toward the sheet feed tray 160, as shown in FIG. 43, the convex portion 259 of the sub-tray body 267 abuts on the top surfaces of the side guides 263. As a result, the sub-tray 256 takes the second posture in which it is supported by the side guides 263 of the sheet feed tray 160. As the side guides 263 are disposed in the second position in this way, the posture of the sub-tray 256 of the sheet discharge tray 180 is changed from the first posture to the second posture by the weight of the sub-tray 256.

<Operational Effects of Present Embodiment>

Figure 44A:
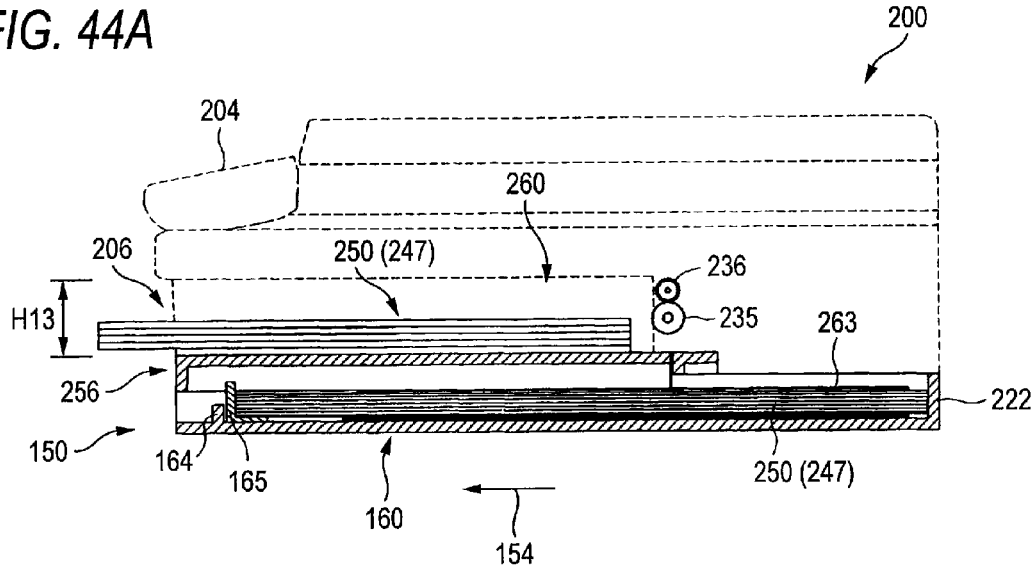
FIGS. 44A and 44B are longitudinal cross-sectional views of the sheet feed cassette, and specifically.
Figure 44B:
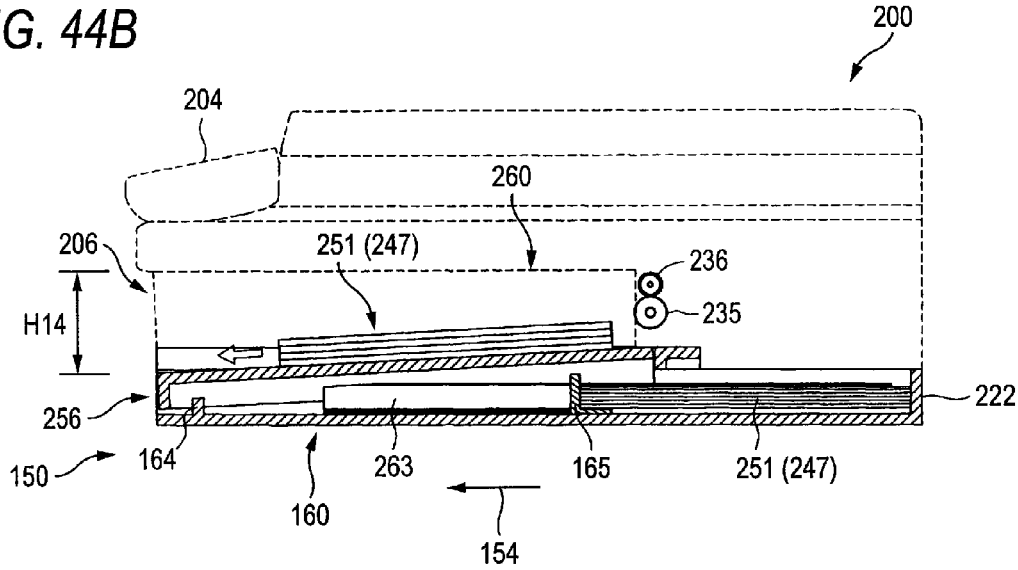

FIGS. 44A and 44B are longitudinal cross-sectional views of the sheet feed cassette 150, and specifically, FIG. 44A shows a state where the sub-tray 256 is maintained in the first posture, and FIG. 44B shows a state where the sub-tray 256 is maintained in the second posture.

As shown in FIGS. 44A and 44B, in a case where the large-size sheets 250 are discharged to the sheet discharge tray 180 as the recording sheets 247, the large-size sheets 250 are accommodated in the sheet discharge tray 180 in a state where their portions are exposed to the outside of the opening 206. Accordingly, a user can easily take out the large-size sheets 250 accommodated in the sheet discharge tray 180 from the sheet discharge tray 180.

In a state where the side guides 263 are disposed in the first position, the rotation of the rear end 196 of the sub-tray 256 is regulated by the side guides 263, and the sub-tray 256 is maintained in the first posture. As the side guides 263 is disposed in the second position, the sub-tray 256 becomes rotatable toward the sheet feed tray 160. As shown in FIG. 44B, in a case where the small-size sheets 251 are discharged to the sheet discharge tray 180 as the recording sheets 247, the small-size sheets 251 are discharged to the deep side of the opening 206. As the side guides 263 are disposed in the second position, the sheet discharge tray 180 is rotated into the sheet feed tray 160. Thereby, the space above the sheet discharge tray 180 is extended downward of the cutout portion 189. In other words, a space for allowing a user to put his/her hand thereinto in order to take out the small-size sheets 251 discharged to the sheet discharge tray 180 is extended downward.

As shown in FIGS. 44A and 44B, as the posture of the sub-tray 256 is changed to the second posture, the height of a space in the opening 206 is changed from H13 (the height at a state where the sub-tray 256 takes the first posture) to H14. For this reason, a user is enabled to put his/her hand further into the deep side than the opening 206. As a result, even if the recording sheets 247 discharged onto the sheet discharge tray 180 are small-size sheets 251, the user can easily take out the small-size sheets 251 from the sheet discharge tray 180.

Accordingly, a user does not suffer the disadvantage that it becomes difficult to take out recording sheets 247 from the sheet discharge tray 180, and an apparatus in which a scanner and a printer are provided at two upper and lower stages can be made thin by making the height of the opening 206 low. The same effect is exhibited even in a case where the composite device 200 is a single-function printer having only a print function.

Further, the small-size sheets 251 are discharged to the sheet discharge tray 180 in a state where the sub-tray 256 is rotated toward the sheet feed tray 160. The width of the sub-tray 256 is larger than the width of the small-size sheets 251. Further, since the small-size sheets 251 accommodated in the sheet feed tray 160 are center-registered by the side guides 263, small-size sheets 251 on which an image are recorded are discharged to almost the center of the sheet discharge tray 180 in the horizontal direction 152. For this reason, both sides of the small-size sheets 251 are not supported by the tray body 254, but are supported by only the sub-tray 256. For this reason, the discharged small-size sheets 251 are slid toward the opening 206 along the sub-tray 256. As a result, take-out of the small-size sheets 251 becomes easier.

Further, in the state where the side guides 263 are disposed in the second position, the sub-tray 256 is maintained in the second posture by its own weight. That is, in a case where the small-size sheets 251 are accommodated in the sheet feed tray 160, the rear end 196 of the sub-tray 256 is always moved toward the sheet feed tray 160. This improves the visibility into the opening 206 from the outside of the main body 205, compared with the case where the large-size sheets 250 are discharged. As a result, a user can easily confirm that the small-size sheets 251 discharged to the deep side within the opening 206 are accommodated in the sheet discharge tray 180, without looking into the inside of the opening 206. Further, the sub-tray 256 does not take a posture that does not correspond to the size of the recording sheet 247. That is, the sub-tray 256 is maintained in the first posture in a state where the large-size sheets 250 are accommodated in the sheet feed tray 160, and the sub-tray 256 is maintained in the second posture in a state where the small-size sheets 251 are accommodated in the sheet feed tray 160. For this reason, a user can determine the size of the recording sheet 247 from the posture of the sub-tray 256.

The sub-tray 256 may include a spring (an example of a resilient member) so that the posture of the sub-tray 256 may be changed from the second posture to the first posture. For example, the shafts 184 of the sub-tray 256 are provided with torsion coil springs, respectively. In this case, since the sub-tray 256 is maintained in the first posture by the resilient force of the torsion coil springs, the posture of the sub-tray is changed from the first posture to the second posture by an external force applied thereto. Since the sub-tray 256 is resiliently urged from the second posture to the first posture, the sub-tray 256 is returned to the first posture as the external force is released. For this reason, only in a case where the sub-tray 256 is pushed down by a user, the sub-tray 256 takes the second posture. In the other states, the top surface of the sheet feed tray 160 is blocked up to prevent dust from entering the sheet feed tray 160.

Further, although the aspect in which the sheet discharge tray 180 is partially rotated toward the sheet feed tray 160, and the posture thereof is changed from the first posture to the second posture has been described in the fourth and fifth embodiments, the sheet discharge tray 180 may be configured so as to descend toward the sheet feed tray 160, with its horizontal posture maintained. For example, the sheet discharge tray 180 described in the fourth embodiment may be configured so that the tray body 181 and the sub-tray 183 can be integrally moved toward the sheet feed tray 160. For example, the sheet discharge tray 180 described in the fifth embodiment may be configured so that the tray body 254 and the sub-tray body 256 can be integrally moved toward the sheet feed tray 160. That is, the posture change of the sheet discharge tray 180 from the first posture to the second posture in the invention is not limited to the rotation of the sheet discharge tray 180, and may be the sliding of the sheet discharge tray 180 toward the sheet feed tray 160.

Further, the width of the sub-tray 183, 256 in the horizontal direction 152 is smaller than the width of the small-size sheets 251. However, in a case where the width of the sub-tray 183, 256 in the horizontal direction 152 is made larger than the width of the small-size sheets 251 like the above-mentioned embodiment, the small-size sheets 251 slide toward the opening 206. As a result, take-out of the small-size sheets 251 from the sheet discharge tray 180 becomes easy. Accordingly, it is preferable that the width of the sub-tray 183, 256 in the horizontal direction 152 be larger than the width of the small-size sheets 251.

Further, the opening 206 for allowing the recording sheet 247 to be taken out of the sheet discharge tray 180 may be provided, for example, at the side of the main body 205. However, in order to facilitate take-out of the recording sheet 24, it is preferable that the opening 20 be provided at the front 156 of the main body 205 in which the operation panel 204 is provided.

What is claimed is:

1. An image recording apparatus comprising:

a main body including an opening;

a first tray disposed within the opening and configured to accommodate a recording medium;

a first conveying unit configured to convey the recording medium from the first tray;

a recording unit configured to record an image on the recording medium conveyed by the first conveying unit; and a second tray provided in the main body and disposed above the first tray in the opening, the second tray including a support surface configured to support the recording medium on which the image is formed by the recording unit;

a second conveying unit configured to convey, to the second tray, the recording medium on which the image is formed by the recording unit, wherein the second tray is configured to selectively take a first posture in which the second tray is disposed in the opening and a second posture in which the second tray is projected from the opening, the support surface of the second tray in the second posture being located closer to the first tray than the support surface of the second tray in the first posture, and wherein the second tray is configured to receive thereon the recording medium conveyed by the second conveying unit when the second tray is in the first and second posture.

2. The image recording apparatus according to claim 1, wherein the second tray includes a first member and a second member which is disposed between the first member and the second conveying unit in the second posture, and the first and second members of the second tray in the second posture are configured to form the support surface and receive thereon the recording medium conveyed by the second conveying unit.

3. The image recording apparatus according to claim 1, wherein the second conveying unit configured to convey the recording medium in a conveying direction, in the first posture, a downstream end portion of the second tray in the conveying direction does not project from a downstream end portion of the first tray in the conveying direction, and in the second posture, the end portion of the second tray projects toward the downstream in the conveying direction from the end portion of the first tray.

4. The image recording apparatus according to claim 1, wherein the second tray includes a tray body and an auxiliary tray which can be pulled out from the tray body in a direction in which the second tray is pulled out from the opening, and the tray body and the auxiliary tray are configured to receive thereon the recording medium conveyed by the second conveying unit.

5. The image recording apparatus according to claim 1, wherein the second tray is slidable between the first posture and the second posture.

6. The image recording apparatus according to claim 1, wherein the second tray is configured to descend toward the first tray from the first posture to the second posture while the support surface of the second tray is maintained in a horizontal state.

7. The image recording apparatus according to claim 1, wherein the second tray is configured to rotate toward the first tray.

8. An image recording apparatus comprising:

a main body comprising:

an opening disposed in a particular surface of the main body; and an inner space connected to the opening;

a first tray disposed within the inner space of the main body to allow a recording medium to be placed thereon;

a second tray disposed above the first tray so that the first tray and the second tray are vertically disposed in two stages, the second tray including a first end portion opposite to a second end portion;

a conveying unit configured to convey a recording medium fed from the first tray and discharge the recording medium onto the second tray; and a recording unit configured to record an image on the recording medium during a conveyance of the recording medium, wherein the second end portion is located further from the recording unit than the first end portion, wherein the second tray is movable between a first posture and a second posture, wherein, when the second tray is in the first posture, a top surface of the second tray in the vicinity of the second end portion is substantially horizontal and positioned at a predetermined height relative to the first tray, wherein, when the second tray moves from the first posture to the second posture, the top surface in the vicinity of the second end portion is moved toward the first tray, wherein the second tray is configured to move relative to the first tray in a first direction and a second direction, the first direction in which the second tray is pushed into the opening, and the second direction in which the second tray is pulled out from the opening, wherein a posture of the second tray is changed from the first posture to the second posture when the second tray in the first posture is moved relative to the first tray in at least one of the first direction and the second direction, and wherein the first tray comprises:

a first tray body; and a slide tray provided on the first tray body and slidable in the first direction or second direction.

9. An image recording apparatus comprising:

a main body;

a first tray configured to accommodate a recording medium;

a first conveying unit configured to convey the recording medium from the first tray;

a recording unit configured to record an image on the recording medium conveyed by the first conveying unit; and a second tray provided in the main body and disposed above the first tray, the second tray including a support surface configured to support the recording medium on which the image is formed by the recording unit;

a second conveying unit configured to convey, to the second tray in a conveying direction, the recording medium on which the image is formed by the recording unit; and a cover provided above the first tray and the second tray, wherein the second tray is configured to selectively take a first condition and a second condition in which the support surface is extended toward a downstream in the conveying direction, the support surface of the second tray in the first condition being located closer to the cover than the support surface of the second tray in the second condition, and wherein the second tray is configured to receive thereon the recording medium conveyed by the second conveying unit when the second tray is in the first and second condition.

10. The image recording apparatus according to claim 9, wherein the second tray includes a first member and a second member which is disposed between the first member and the second conveying unit in the second condition, and the first memeber and the second member of the second tray in the second condition are configured to form the support surface and receive thereon the recording medium conveyed by the second conveying unit.

11. The image recording apparatus according to claim 9, wherein in the first condition, a downstream end portion of the second tray in the conveying direction does not project from a downstream end portion of the first tray in the conveying direction, and in the second condition, the end portion of the second tray projects toward the downstream in the conveying direction from the end portion of the first tray.

12. The image recording apparatus according to claim 9, wherein the second tray includes a tray body and an auxiliary tray which can be pulled out from the tray body in a direction in which the second tray is pulled out from the opening, and the tray body and the auxiliary tray are configured to receive thereon the recording medium conveyed by the second conveying unit.

13. The image recording apparatus according to claim 9, wherein the second tray is slidable between the first condition and the second condition.

14. The image recording apparatus according to claim 9, wherein the second tray is configured to descend toward the first tray from the first condition to the second condition while the support surface of the second tray is maintained in a horizontal state.

15. An image recording apparatus comprising:

a main body;

a first tray configured to accommodate a recording medium;

a first conveying unit configured to convey the recording medium from the first tray in a conveying direction;

a recording unit configured to record an image on the recording medium conveyed by the first conveying unit; and a second tray provided in the main body and disposed above the first tray, the second tray including a support surface configured to support the recording medium on which the image is formed by the recording unit;

a second conveying unit configured to convey, to the second tray in the conveying direction, the recording medium on which the image is formed by the recording unit;

a cover provided above the first tray and the second tray, wherein the second tray is configured to be movable between a first position and a second position, wherein a downstream end portion of the second tray in the conveying direction when the second tray is in the second position is located farther in the conveying direction than the downstream end portion of the second tray when the second tray is in the first position, wherein a clearance between the cover and the second tray in the second position is larger than a clearance between the cover and the second tray in the first position, and wherein the second tray is configured to receive thereon the recording medium conveyed by the second conveying unit when the second tray is in the first and second positions.

16. The image recording apparatus according to claim 15, wherein the second tray includes a first member and a second member which is disposed between the first member and the second conveying unit in the second position, and the first member and the second member of the second tray in the second position are configured to form the support surface and receive thereon the recording medium conveyed by the second conveying unit.

17. The image recording apparatus according to claim 15, wherein in the first position, a downstream end portion of the second tray in the conveying direction does not project from a downstream end portion of the first tray in the conveying direction, and in the second position, the end portion of the second tray projects toward the downstream in the conveying direction from the end portion of the first tray.

18. The image recording apparatus according to claim 15, wherein the second tray includes a tray body and an auxiliary tray which can be pulled out from the tray body in a direction in which the second tray is pulled out from the opening, and the tray body and the auxiliary tray are configured to receive thereon the recording medium conveyed by the second conveying unit.

19. The image recording apparatus according to claim 15, wherein the second tray is slidable between the first position and the second position.

20. The image recording apparatus according to claim 15, wherein the second tray is configured to descend toward the first tray from the first position to the second position while the support surface of the second tray is maintained in a horizontal state.

* * * * *